US009700108B2

(12) United States Patent
Ninomiya

(10) Patent No.: US 9,700,108 B2
(45) Date of Patent: Jul. 11, 2017

(54) COUPLER

(71) Applicant: SEBERU PICO CO., LTD., Tokyo (JP)

(72) Inventor: Tomoyasu Ninomiya, Tokyo (JP)

(73) Assignee: SEBERU PICO CO., LTD., Tokyo (JP)

( * ) Notice: Subject to any disclaimer, the term of this patent is extended or adjusted under 35 U.S.C. 154(b) by 145 days.

(21) Appl. No.: 14/377,576

(22) PCT Filed: Apr. 18, 2013

(86) PCT No.: PCT/JP2013/061450
§ 371 (c)(1),
(2) Date: Aug. 8, 2014

(87) PCT Pub. No.: WO2013/157594
PCT Pub. Date: Oct. 24, 2013

(65) Prior Publication Data

US 2015/0047156 A1 Feb. 19, 2015

(30) Foreign Application Priority Data

Apr. 20, 2012 (JP) ..... 2012-096644

(51) Int. Cl.
*A44B 1/04* (2006.01)
*A44C 5/20* (2006.01)

(52) U.S. Cl.
CPC ..... *A44C 5/2057* (2013.01); *A44C 5/2076* (2013.01); *A44C 5/2047* (2013.01); *Y10T 24/45262* (2015.01)

(58) Field of Classification Search
CPC ..... A44C 5/2057; A44C 5/2076; Y10T 24/45262; Y10T 24/44043
See application file for complete search history.

(56) References Cited

U.S. PATENT DOCUMENTS 1,193,111 A * 8/1916 Breidenbach ..... A44C 7/003 24/707.4
3,765,064 A * 10/1973 Hoober ..... A44C 5/2052 24/658

(Continued)

FOREIGN PATENT DOCUMENTS

JP S55-62216 U 4/1980
JP 9-191912 A 7/1997

(Continued)

OTHER PUBLICATIONS

International Search Report issued in PCT/JP2013/061450 mailed on May 21, 2013 (2 pages).

(Continued)

*Primary Examiner* — Victor Batson
*Assistant Examiner* — Matthew Sullivan
(74) *Attorney, Agent, or Firm* — Osha Liang LLP

(57) ABSTRACT

The coupler includes a male coupler formed with an annular groove, and a female coupler into which the male coupler is detachably inserted. The female coupler includes a first body part downwardly open, a second body part upwardly open, being rotatably connected with the first body part, and defining a hollow space together with the first body part, and a guide housed in the space, and supporting the male coupler inserted into the female coupler. The guide is composed of a material having elasticity, and exerts an elastic force on the first body part and the second body part such that they are closed to each other.

10 Claims, 36 Drawing Sheets

(56) References Cited

U.S. PATENT DOCUMENTS

| | | | | |
|---|---|---|---|---|
| 4,001,923 | A * | 1/1977 | Frankel | A44C 5/2052 24/665 |
| 6,484,376 | B1 * | 11/2002 | Khatchadourian | A44C 5/2052 24/116 A |
| 6,508,080 | B1 * | 1/2003 | Ninomiya | A44C 5/2042 24/574.1 |

FOREIGN PATENT DOCUMENTS

| | | | |
|---|---|---|---|
| JP | 2000-316616 | A | 11/2000 |
| JP | 2005-291381 | A | 10/2005 |
| JP | 2007-301236 | A | 11/2007 |
| JP | 3173806 | U | 2/2012 |

OTHER PUBLICATIONS

Written Opinion of the International Searching Authority issued in PCT/JP2013/061450 mailed on May 21, 2013 (3 pages).
Japanese Office Action in corresponding Application No. 2013-558859 mailed on Apr. 22, 2014 (4 pages).
First Office Action issued in the counterpart Chinese Patent Application No. 201380020959.5, mailed Jul. 30, 2015 (12 pages).
Extended European Search Report issued in the counterpart European Patent Application No. 13777989.8, mailed Oct. 22, 2015 (7 pages).

* cited by examiner

COUPLER

CROSS-REFERENCE TO RELATED APPLICATION

The present application is based on an International Application No. PCT/JP2013/061450 which was filed on Apr. 18, 2013 and which claims priority under 35 U.S.C. §119 from Japanese Patent Application No. 2012-096644 filed on Apr. 20, 2012.

BACKGROUND OF THE INVENTION

Field of the Invention

The invention relates to both a coupler including male and female couplers detachably coupled to each other, and a guide which is a component part of the coupler. For instance, the coupler in accordance with one or more embodiments of the present invention can be used for detachably connecting opposite ends of a line-shaped ornament (for instance, a necklace) to each other.

Description of the Related Art

Japanese Patent Application Publication No. 2000-316616 has suggested an example of a coupler used for an ornament.

FIG. 69 is a perspective view of a coupler 40 suggested in the above-identified Publication, FIG. 70 is an exploded perspective view of the coupler 40, and FIG. 71 is a longitudinal cross-sectional view of the coupler 40.

As illustrated in FIG. 69, the coupler 40 includes a male part 42 in the form of a bar, and a female part 50 which is hollow in the form of a box.

The male part 42 can be inserted into, and further, taken out of the female part 50. That is, the male part 42 and the female part 50 can be connected to and disconnected from each other.

The male part 42 is connected to one end of a line-shaped ornament such as a necklace and a chain, and the female part 50 is connected to the other end. By connecting the male part 42 and the female part 50 to each other, the line-shaped ornament makes a ring, and accordingly, a user can put the ornament around his/her neck. When a user takes the ornament out of his/her neck, the male part 42 and the female part 50 are disconnected from each other, resulting in that the ring returns to a line, and accordingly, a user can take the ornament out of his/her neck.

The male part 42 has a tapered head 45 at a top end thereof, and is formed with an annular groove 47 in the vicinity of a rear end thereof. A connection ring 49 is connected to a rear end of the male part 42. The line-shaped ornament is connected at one end thereof to the connection ring 49.

As illustrated in FIGS. 69 and 70, the female part 50 includes a box-shaped upper body 51 downwardly open, and a lower body 60 upwardly open and having such a size that the lower body 60 can be inserted into the upper body 51.

A through-hole 57 for allowing the male part 42 to pass through is formed at a wall (a wall through which the male part 42 is inserted into the female part 50) of the upper body 51.

As illustrated in FIG. 70, two cylindrical guides 54 are formed on an inner bottom of the upper body 51. Each of the guides 54 has an inner diameter equal to the same of the through-hole 57. The male part 42 inserted into the female part 50 through the through-hole 58 is supported by the two guides 54.

The upper body 51 has a pair of sidewalls 53 facing each other. Each of the sidewalls 53 is formed with a through-hole 55, into which a shaft 58 is inserted.

The upper body 51 has a connection ring 59 at an end located opposite to the through-hole 57. The other end of the line-shaped ornament is connected to the connection ring 59.

As illustrated in FIG. 70, a semi-circular cut-out is formed as a recess 61 at an upper end of a wall of the lower body 60. The recess 61 has such a size that the recess 61 can be engaged with the groove 47 of the male part 42.

A plurality of concaves and convexes are formed as a non-slip 62 at an outer bottom of the lower body 60. The lower body 60 has a pair of sidewalls 63 facing each other. Each of the sidewalls 63 is formed with a through-hole 65.

The shaft 58 passes through the through-holes 55 of the upper body 51, the through-holes 65 of the lower body 60, and a hole (no reference numeral) of a coil spring 67 to thereby rotatably connect the upper body 51 and the lower body 60 around the shaft 58, and further fix the coil spring 67 in both the upper body 51 and the lower body 60.

Thus, the upper body 51 and the lower body 60 are able to rotate or open/close to each other around the shaft 58. Furthermore, since the coil spring 67 at opposite ends thereof compresses the upper body 51 and the lower body 60 from the inner surface side, the upper body 51 and the lower body 60 are forced by virtue of an elastic force of the coil spring 67 to move in such a direction that they are close relative to each other (a condition as illustrated in FIG. 69 or 71).

The coupler 40 is used as follows.

Inserting the male part 42 into the female part 52 through the through-hole 57, the male part 42 goes into the female part 50, pushing down the lower body 60 through the recess 61.

Further inserting the male part 42, the male part 42 further goes, being supported by the guides 54. When the groove 47 of the male part 42 reaches at the recess 61, the lower body 60 is pushed upwardly by virtue of an elastic force of the coil spring 67, resulting in that the recess 61 is engaged with the groove 47, and thus, the male part 42 and the female part 50 are connected to each other.

When the male part 42 is disconnected from the female part 50, the non-slip 62 of the lower body 60 is pushed up. Thus, the lower body 60 is caused to rotate relative to the upper body 51 around the shaft 58, and accordingly, the recess 61 is lowered, and the male part 42 is disengaged from the groove 47. Then, the male part 42 can be taken out of the female part 50.

FIG. 72 is a perspective view of a coupler 41 described in the above-identified Publication.

Whereas the guides 54 are located on an inner wall of the upper body 51 in the coupler 40 illustrated in FIGS. 69 to 71, the coupler 41 is designed not to include the guide 54 in the upper body 51. Instead, the coupler 41 employs a guide 70 which is a separate part from the upper body 51.

The guide 70 includes a pair of upright walls 71 facing each other. Each of the upright walls 71 is formed with a through-hole 72. By passing the shaft 58 through the through-holes 72, the guide 70 is housed in the lower body 60 together with the coil spring 67.

How the male part 42 is inserted into the female part 50 and how the male part 42 is taken out of the female part 50 are identical with those of the coupler 40.

As illustrated in FIGS. 69 to 71, the shaft 58 is used for assembling the couplers 40 and 41. The shaft 58 is comprised of a pin having a length in the range of about 5 to about 10 mm, and a diameter in the range of about 0.5 to 1.0 mm. In order to assemble the couplers 40 and 41 through the use of such a small pin, there are required high skill, much time, and much labor.

Furthermore, since the coil spring 67 is of a millimeter order size with respect to a length, a height, and a width, and the hole defined by the coil spring 67 is a size through which the shaft 58 can narrowly pass, it requires high skill, much time, and much labor to assemble the coil spring 67 in the upper body 51 and the lower body 60, and further, to insert the shaft 58 into the hole defined by the coil spring 67.

That is, since the conventional couplers 40 and 41 are assembled through the use of small-sized parts such as the shaft 58 and the coil spring 67, it requires much time for assembling the couplers 40 and 41, even though those skilled in the art would assemble them.

SUMMARY OF THE INVENTION

In view of the above, one or more embodiments of the present invention provide a coupler which is capable of reducing a number of parts, in particular, small-sized parts such as the shaft 58 and the coil spring 67, and reducing a time necessary for assembling. Further, one or more embodiments of the present invention provide a guide to be used in the coupler.

In one or more embodiments, the present invention provides a coupler including a female coupler into which a male coupler can be inserted, and a guide housed in the female coupler in a positioned condition, and detachably supporting the male coupler, wherein at least one of the female coupler and the guide includes a lock adapted to be engaged with the male coupler inserted in the female coupler to keep the male coupler inserted in the female coupler, and the guide includes a base wall, and at least one pair of walls extending in a common direction from the base wall such that they face each other, at least one of the walls having elasticity, the at least one of the walls being able to move towards and away from the other of the walls, the lock, while the male coupler is being inserted in the female coupler, being engaged with the male coupler by virtue of the elasticity, and disengaging from the male coupler when the at least one of the walls moves towards or away from the other of the walls.

In one or more embodiments, the at least one pair of walls extends from the base wall in a direction opposite to a direction in which the male coupler is inserted into the female coupler, and at least one of the walls has a bending distal end so as to support the male coupler inserted in the female coupler or so as to be engaged with the male coupler (for instance, see FIG. 12).

In one or more embodiments, the base wall is formed with an opening through which the male coupler is able to pass (for instance, see FIG. 1).

In one or more embodiments, the coupler further includes a reinforcement formed along at least a part of a periphery of the opening and extending in a direction in which the male coupler is inserted into the female coupler or in a direction opposite to a direction in which the male coupler is inserted into the female coupler (for instance, see FIGS. 4 and 5).

In one or more embodiments, the coupler further includes at least one positioning wall extending from the base wall in a direction in which the at least one pair of walls extends, the positioning wall being detachably engaged at a distal end thereof with the female coupler (for instance, see FIG. 1).

In one or more embodiments, the positioning wall has a two-layered structure formed by bending a single plate (for instance, see FIGS. 4 and 5).

In one or more embodiments, the lock is comprised of a projection formed between a distal end and a proximal end of at least one of the at least one pair of walls, and engagable with the male coupler (for instance, see FIG. 49).

In one or more embodiments, the lock is comprised of an extension extending from a distal end of at least one of the at least one pair of walls towards the other of the at least one pair of walls (for instance, see FIG. 39).

In one or more embodiments, the female coupler includes a housing in which the guide can be housed, the housing including at least two covers being able to be detachably coupled to each other (for instance, see FIG. 1).

In one or more embodiments, the covers (1010, 1020) are able to be coupled to each other in a direction in which the male coupler is inserted into the female coupler or in a direction perpendicular to a direction in which the male coupler is inserted into the female coupler (for instance, see FIGS. 43 and 34).

In one or more embodiments, the covers (130, 140) are able to rotate relative to each other (for instance, see FIG. 1).

One or more embodiments of the present invention further provide a coupler including a female coupler into which a male coupler can be inserted, and a guide housed in the female coupler in a positioned condition, and detachably supporting the male coupler, wherein the guide (153) has elasticity, and the guide (153) includes a base wall (153A) formed with an opening (153B) through which the male coupler (110) can pass, a first wall (153D, 153E) extending from one end of the base wall in a direction in which the male coupler is inserted into the female coupler, and being bent in the opposite direction, and a second wall (153H, 153I) extending from the other end of the base wall in a direction in which the male coupler is inserted into the female coupler, and being bent in the opposite direction, the first wall and the second wall having the elasticity such that they move away from each other, the first wall having a first auxiliary wall (153F) being bent forwardly of the base wall towards the second wall, the second wall having a second auxiliary wall (153J) being bent forwardly of the base wall towards the first wall, the first auxiliary wall and the second auxiliary wall having cut-outs (153G, 153K) at distal ends thereof, said cut-outs defining an opening through which the male coupler can pass when the first auxiliary wall and the second auxiliary wall make abutment at distal ends thereof with each other (for instance, see FIG. 24).

In one or more embodiments, the guide further includes a sidewall extending from one end of the base wall (153M), and reaching the other end of the base wall around peripheries of the first or second wall (for instance, see FIG. 24).

In one or more embodiments, the sidewall is formed with a connection ring (153P), and the female coupler includes a housing (135) formed with both a hole (131) through which the male coupler can pass and an opening (136) into which the ring is inserted, the housing being composed of an extendable and contractable flexible material (for instance, see FIG. 26).

One or more embodiments of the present invention further provide a guide housed in a positioned condition in a female coupler composing a coupler together with a male coupler, the female coupler being able to house the male coupler therein, the guide detachably supporting the male coupler, the guide including a base wall, and a pair of walls extending in a common direction from the base wall such that they face each other, at least one of the walls having elasticity, the at least one of the walls being able to move towards and away from the other of the walls, the female coupler, while the male coupler is being inserted in the female coupler, being engaged with the male coupler by virtue of the elasticity to thereby lock the male coupler, and disengaging from the male coupler when the at least one of the walls moves through the female coupler towards or away from the other of the walls (for instance, see FIG. 1).

In one or more embodiments, the guide includes a lock for engaging with the male coupler inserted into the female coupler and keeping the male coupler locked in the female coupler, the lock, while the male coupler is being inserted in the female coupler, being engaged with the male coupler by virtue of the elasticity to thereby lock the male coupler, and disengaging from the male coupler when the at least one of the walls moves towards or away from the other of the walls (for instance, see FIG. 39).

In one or more embodiments, the base wall is formed with an opening through which the male coupler is able to pass, the guide further including a reinforcement formed along at least a part of a periphery of the opening and extending in a direction in which the male coupler is inserted into the female coupler or in a direction opposite to a direction in which the male coupler is inserted into the female coupler.

In one or more embodiments, the guide further includes at least one positioning wall extending from the base wall in a direction in which the at least one pair of walls extends, the positioning wall being detachably engaged at a distal end thereof with the female coupler.

In one or more embodiments, the positioning wall has a two-layered structure formed by bending a single plate (for instance, see FIGS. 4 and 5).

One or more embodiments of the present invention further provide a guide to be housed in a coupler including a male coupler, and a female coupler into which the male coupler can be inserted, the female coupler being able to keep the male coupler locked therein, and further being able to unlock the male coupler in response to a predetermined action carried out by a user to the female coupler to thereby allow the male coupler to be taken out of the female coupler, the guide being housed in the female coupler, wherein the guide (153) has elasticity, and the guide (153) includes a base wall (153A) formed with an opening (153B) through which the male coupler (110) can pass, a first wall (153D, 153E) extending from one end of the base wall in a direction in which the male coupler is inserted into the female coupler, and being bent in the opposite direction, and a second wall (153H, 153I) extending from the other end of the base wall in a direction in which the male coupler is inserted into the female coupler, and being bent in the opposite direction, the first wall and the second wall having the elasticity such that they move away from each other, the first wall having a first auxiliary wall (153F) being bent forwardly of the base wall towards the second wall, the second wall having a second auxiliary wall (153J) being bent forwardly of the base wall towards the first wall, the first auxiliary wall and the second auxiliary wall being formed at distal ends thereof with cut-outs (153G, 153K), said cut-outs defining an opening through which the male coupler can pass when the first auxiliary wall and the second auxiliary wall make abutment at distal ends thereof with each other (for instance, see FIG. 24).

It should be noted that reference numerals and figure numbers in parentheses are given only for the purpose of clearly showing a relation between the parts indicated therewith and in one or more embodiments, and that they do not limit the scope of the present invention.

The coupler in accordance with one or more embodiments of the present invention provides the advantages as follows.

Firstly, it is possible to reduce a number of parts defining the coupler.

Specifically, whereas the conventional coupler 40 illustrated in FIGS. 69 to 71 has to include the guide 54, the shaft 58 and the coil spring 67, and further, whereas the conventional coupler 41 illustrated in FIG. 72 has to include the guide 70, the shaft 58 and the coil spring 67, the coupler in accordance with one or more embodiments of the present invention employs one part, that is, the guide, in place of those three parts.

As mentioned above, the coupler in accordance with one or more embodiments of the present invention can reduce a number of parts by two in comparison with the conventional couplers 40 and 41.

Secondly, the following secondary advantages can be provided by reducing a number of parts, in particular, making the shaft 58 and the coil spring 67 unnecessary.

The first secondary advantage is that it is possible to shorten a period of time necessary for assembling the coupler.

As mentioned above, since the shaft 58 and the coil spring 68 are small-sized, even those skilled in the field required much time to assemble a coupler through the use of them. In contrast, since the coupler in accordance with one or more embodiments of the present invention can be assembled without the shaft 58 and the coil spring 67, it is possible to much shorten a time necessary for assembling the coupler.

The shortened period of time for assembling the coupler brings reduction in fabrication costs.

The second secondary advantage is that a weight of the coupler can be reduced.

By reducing a weight of the coupler, it is possible to enhance a weight balance of an ornament including the coupler.

For instance, in the case that the coupler is connected to a necklace, if the coupler is heavy, the coupler tends to sink downwardly, and hence, the coupler slips down on a front side of a user. By reducing a weight of the coupler, it is possible to prevent the coupler from slipping down.

The third secondary advantage is that the coupler can be made small-sized. The conventional couplers were required to have such a size that the shaft 58 could be inserted into the through-holes 55 of the upper body 51, the through-holes 65 of the lower body 60, and the hole defined by the coil spring 67. Since the coupler in accordance with one or more embodiments of the present invention makes it possible to reduce a number of parts and readily assemble itself, it is possible to provide the coupler smaller in size than the conventional couplers.

The fourth secondary advantage is that a defective rate of parts can be reduced.

The greater a number of parts is, the greater a defective rate of parts is. By reducing a number of parts, it is possible to reduce a defective rate of parts, and accordingly, a defective rate of final products, that is, the couplers.

The above and other features of the present invention will be made apparent from the following description made with reference to the accompanying drawings, in which like reference characters designate the same or similar parts throughout the drawings.

DESCRIPTION OF EMBODIMENTS (First Embodiment)

Figure 1:
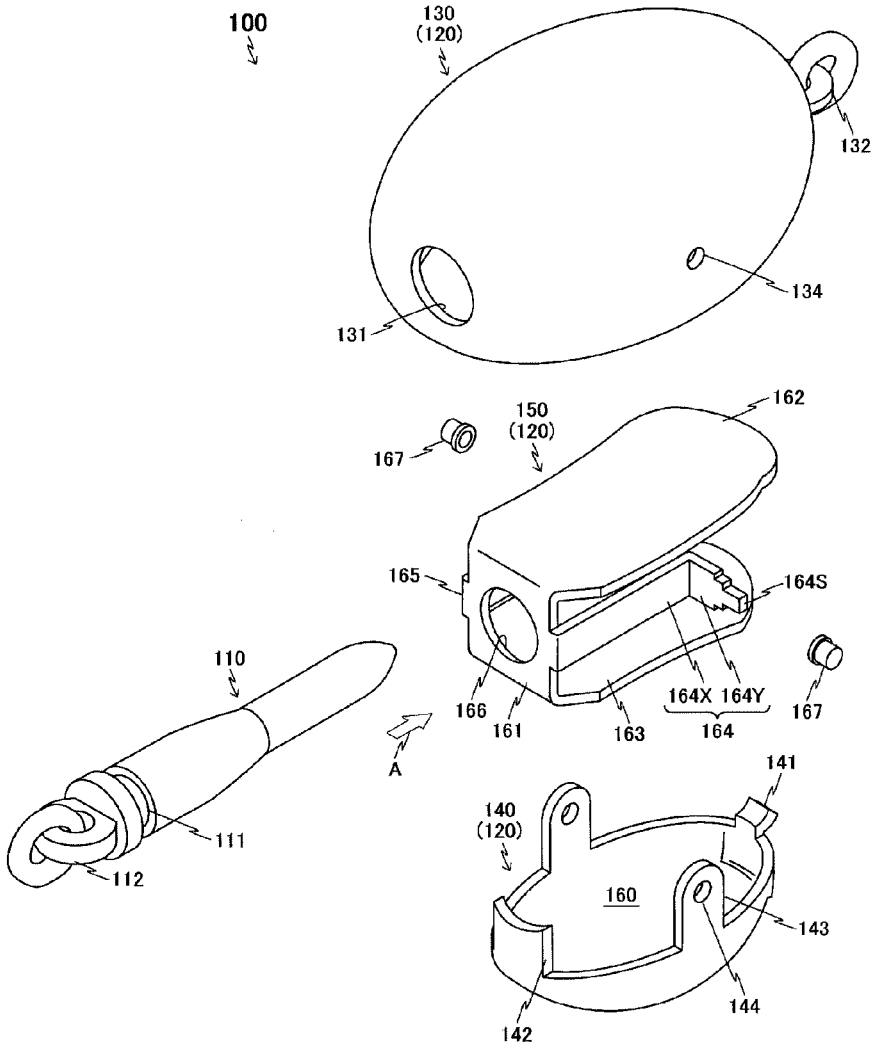
FIG. 1 is an exploded perspective view of the coupler in accordance with the first embodiment of the present invention.

FIG. 1 is an exploded perspective view of a coupler 100 in accordance with the first embodiment of the present invention.

As illustrated in FIG. 1, the coupler 100 in accordance with the first embodiment is formed as a coupler to be used for an ornament, for instance (this is common to the later-mentioned embodiments and variations). The coupler 100 includes a male coupler 110 in the form of a bar, and a female coupler 120 into which the male coupler 110 can be detachably inserted.

The male coupler 110 is formed with an annular groove 111. The male coupler 110 is formed at one end (a proximal end) with a connection ring 112 to which an end of a line-shaped ornament (for instance, a necklace) is connected, and is tapered at the other end (a distal end).

The female coupler 120 includes a dome-shaped first body part 130 downwardly open, a dome-shaped second body part 140 upwardly open, and a guide 150.

The first body part 130 is formed at an end (a left end in FIG. 1) in a length-wise direction with a through-hole 131 through which the male coupler 110 can pass, and further, at the other end (a right end in FIG. 1) with a connection ring 132. A line-shaped ornament is connected at the other end thereof to the connection ring 132.

The first body part 130 is further formed at opposite ends in a direction perpendicular to the length-wise direction thereof with a pair of through-holes 134.

The second body part 140 has an upright wall 142 at an end in a length-wise direction, and, at the other end, an arcuate projection 141 which is to be engaged with the first body part 130. The upright wall 142 has such a shape and a size that the upright wall 142 can be inserted into the annular groove 111 of the male coupler 110.

The second body part 140 is formed at opposite ends in a direction perpendicular to a length-wise direction thereof with a pair of projecting walls 143, each of which is formed with a through-hole 144.

As mentioned later, distal ends 164S of a third wall 164 and distal ends 165S of a fourth wall 165 of the guide 150 are inserted into the through-holes 134 of the first body part 130 and the through-holes 144 of the second body part 140 from inside of the first body part 130 and the second body part 140, resulting in that the first body part 130 and the second body part 140 are connected to each other rotatably around the through-holes 134 and 144.

By connecting the first body part 130 and the second body part 140 to each other in the above-mentioned manner, the first body part 130 and the second body part 140 define a hollow space 160 therein.

The guide 150 is arranged in the thus formed space 160, and, as mentioned later, has a function of supporting the male coupler 110 when the male coupler 110 is inserted into the space 160.

As illustrated in FIG. 1, the guide 150 includes a substantially square base wall 161 formed with a through-hole 166 through which the male coupler 110 can pass, a substantially rectangular first wall 162 extending from an upper edge of the base wall 161 in a direction A in which the male coupler 110 is inserted into the female coupler 120, a second wall 163 extending from a lower edge of the base wall 161 in the direction A, a third wall 164 extending from a right edge of the base wall 161 in the direction A, and a fourth wall 165 (only a part thereof is illustrated in FIG. 1) extending from a left edge of the base wall 161 in the direction A.

The first wall 162 and the second wall 163 are identical in shape with each other, and the third wall 164 and the fourth wall 165 are identical in shape with each other.

The third wall 164 includes a first portion 164X extending in the direction A, and a second portion 164Y perpendicularly and outwardly extending from a distal end of the first portion 164X.

Similarly, the fourth wall 165 includes a first portion 165X (not illustrated) extending in the direction A, and a second portion 165Y (not illustrated) perpendicularly and outwardly extending from a distal end of the first portion 165X.

The distal end 164S of the second portion 164Y of the third wall 164 and the distal end 165S of the second portion 165Y of the fourth wall 165 (only the distal end 164S is illustrated in FIG. 1) are disposed outwardly of the right and left edges of the base wall 161, and have such a shape that they can be inserted into the through-holes 134 of the first body part 130 and the through-holes 144 of the second body part 140.

Whereas the first wall 162 and the second wall 163 have a width equal to the same of the base wall 161, the third wall 164 and the fourth wall 165 have a width smaller than the same of the base wall 161. That is, as illustrated in FIG. 1, the third wall 164 and the fourth wall 165 are located almost at a center in a height-wise direction of the base wall 161, and gaps are formed between the third/fourth walls 164/165 and the first/second walls 162/163.

When the guide 150 is arranged in the space 160, the distal ends 164S of the third wall 164 and the distal ends 165S of the fourth wall 165 are fit into the through-holes 144 of the second body part 140 and the through-holes 134 of the first body part 130 from inside of the first body part 130 and the second body part 140. Thus, the guide 150 is positioned within the space 160.

That is, the third wall 164 and the fourth wall 165 define means for positioning the guide 150 in the space 160.

The guide 150 comprised of the base wall 161, the first wall 162, the second wall 163, the third wall 164, and the fourth wall 165 are integrally formed as a one piece. For instance, the guide 150 can be fabricated by pressing a single metal plate.

The guide 150 is composed of a material having elasticity. Accordingly, the first wall 162 and the second wall 163 act as a spring around the base wall 161. Similarly, the third wall 164 and the fourth wall 165 act as a spring around the base wall 161.

Figure 2:
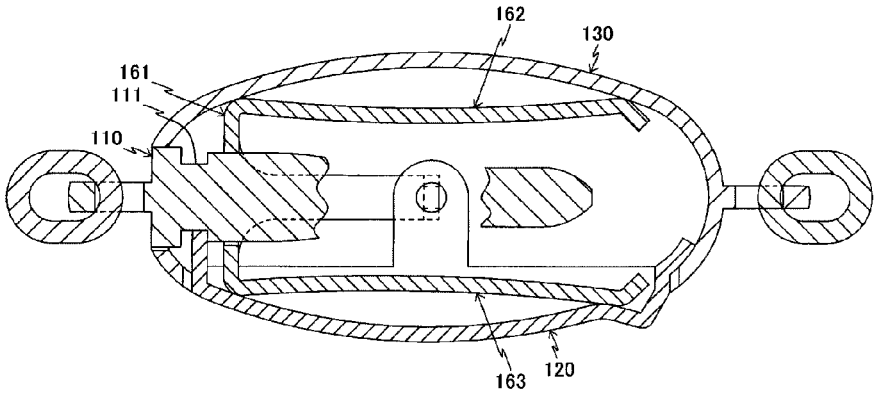
FIG. 2 is a longitudinal cross-sectional view of the coupler in accordance with the first embodiment, showing that the male coupler is inserted into the female coupler.

FIG. 2 is a longitudinal cross-sectional view of the coupler 100 in accordance with the first embodiment, showing that the male coupler 110 is inserted into the female coupler 120.

As illustrated in FIG. 2, when the guide 150 is arranged in the female coupler 120, the first wall 162 makes contact at distal and proximal ends thereof with an inner wall of the first body part 130, and the second wall 163 makes contact at distal and proximal ends thereof with an inner wall of the second body part 140.

As mentioned earlier, since the guide 150 is composed of an elastic material, the first wall 162 and the second wall 163 can act as a spring.

As illustrated in FIG. 2, since the first wall 162 makes contact at a distal end thereof with an inner wall of the first body part 130, the first wall 162 exerts a force compressing the first body part 130 from inside to outside of the first body part 130 (that is, upwardly) around the base wall 161. That is, the first body part 130 receives a force causing the first body part 130 to rotate in a counter-clockwise direction around the through-holes 134.

Similarly, since the second wall 163 makes contact at a distal end thereof with an inner wall of the second body part 140, the second wall 163 exerts a force compressing the second body part 140 from inside to outside of the second body part 140 (that is, downwardly) around the base wall 161. That is, the second body part 140 receives a force causing the second body part 140 to rotate in a clockwise direction around the through-holes 144.

Thus, the first body part 130 and the second body part 140 keep closed to each other (a condition illustrated in FIG. 2).

Furthermore, since the distal ends 164S of the third wall 164 and the distal ends 165S of the fourth wall 165 are inserted into the through-holes 134 of the first body part 130 and the through-holes 144 of the second body part 140, the third wall 164 and the fourth wall 165 exert an elastic force on inner walls of the first body part 130 and the second body part 140. Accordingly, the third wall 164 and the fourth wall 165 have a function of supporting the guide 150 in the space 160 in a left-right direction.

The coupler 100 having the above-mentioned structure is assembled as follows.

First, the distal ends 164S of the third wall 164 and the distal ends 165S of the fourth wall 165 are fit into the through-holes 144 of the second body part 140 from inside of the second body part 140.

Then, each of the distal end 164S of the third wall 164 and the distal end 165S of the fourth wall 165 outwardly projecting through the through-holes 144 of the second body part 140 is fit into each of the through-holes 134 of the first body part 130 from inside of the first body part 130. Thus, the first body part 130 and the second body part 140 are connected to each other rotatably around the through-holes 134 and 144.

The coupler 100 can be manually assembled in the above-mentioned manner.

The coupler 100 assembled in the above-mentioned manner is used as follows.

Firstly, a line-shaped ornament such as a necklace is connected at one end thereof to the connection ring 132 of the first body part 130, and at the other end to the connection ring 112 of the male coupler 110. Thus, a line-shaped ornament makes a ring by inserting the male coupler 110 into the female coupler 120, and the ring returns to a line by taking the male coupler 110 out of the female coupler 120.

When the male coupler 110 is inserted into the female coupler 120, as illustrated in FIG. 2, the male coupler 110 is inserted into the through-hole 131 of the first body part 130, and further, into the through-hole 166 of the base wall 161 of the guide 150 arranged in the space 160, in which case, the male coupler 110 is supported by the through-hole 166 of the base wall 161. Accordingly, the male coupler 110 can be straightly inserted, and it is ensured that the male coupler 110 can be fixed in the female coupler 120, as mentioned later.

The male coupler 110 goes in the direction A, pushing the second body part 140 down through the upright wall 142.

Causing the male coupler 110 to further go in the direction A, the second body part 140 is pushed up by the elastic force of the first wall 162 and the second wall 163 when the annular groove 111 of the male coupler 110 aligns with the upright wall 142 of the second body part 140, and thus, the upright wall 142 goes engaged with the annular groove 111. FIG. 2 illustrates this condition.

The upright wall 142 is fit into the annular groove 111 in the above-mentioned manner, resulting in that the male coupler 110 is fixed in the female coupler 120.

Figure 3:
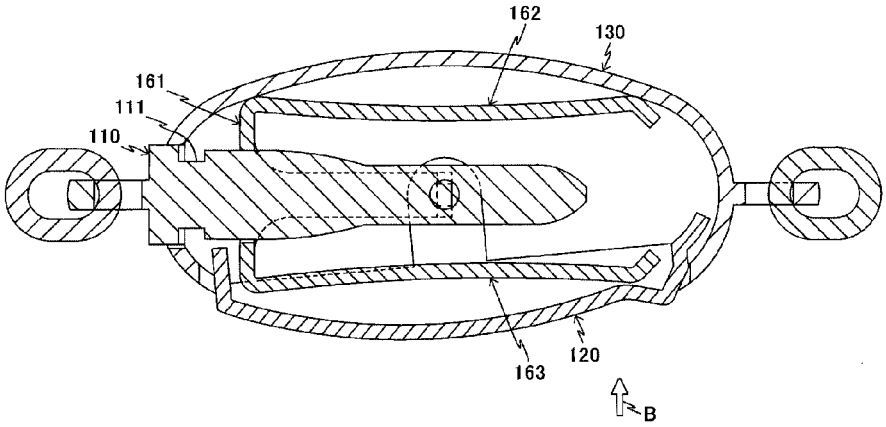
FIG. 3 is a longitudinal cross-sectional view of the coupler in accordance with the first embodiment, showing how the male coupler is taken out of the female coupler.

FIG. 3 is a longitudinal cross-sectional view showing how the male coupler 110 is taken out of the female coupler 120.

When the male coupler 110 is taken out of the female coupler 120, as illustrated in FIG. 3, the second body part 140 is pushed up in a direction B at an end located opposite to the upright wall 142. That is, the second body part 140 is pushed up in the direction B so that the second body part 140 rotates around the through-holes 144 in a counter-clockwise direction.

As illustrated in FIG. 3, when the second body part 140 rotates around the through-holes 144 in a counter-clockwise direction, the upright wall 142 also rotates in a counter-clockwise direction, and accordingly, the upright wall 142 is disengaged from the annular groove 111 of the male coupler 110. Specifically, the male coupler 110 is no longer fixed in the female coupler 120.

Accordingly, by pulling the male coupler 110 in a direction opposite to the direction A, keeping the second body part 140 pushed in the direction B, the male coupler 110 can be pulled out of the female coupler 120, in which case, the through-hole 166 of the base wall 161 supports the male coupler 110. Thus, the male coupler 110 is prevented from moving downwardly due to the gravity, resulting in that the male coupler 110 can be readily pulled out of the female coupler 120.

After the male coupler 110 was pulled out of the female coupler 120, by stopping pushing the second body part 140 in the direction B (specifically, releasing a user's fingers from the second body part 140), the second body part 140 rotates in a clockwise direction around the through-holes 144 by virtue of the elastic force of the second wall 163, and thus, returns to an initial position (the position illustrated in FIG. 1).

As mentioned above, the coupler 100 in accordance with the first embodiment makes it unnecessary to use the shaft 58 and the coil spring 67 both necessarily used in the conventional couplers 40 and 41 illustrated in FIGS. 69 to 72.

The coupler 100 in accordance with the first embodiment provides the following advantages.

Firstly, it is possible to reduce a number of parts defining the coupler 100.

Figure 69:
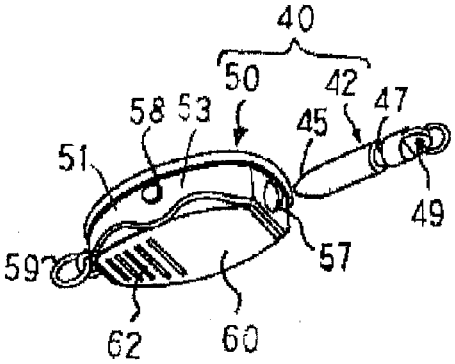
FIG. 69 is a perspective view of the conventional coupler.
Figure 70:
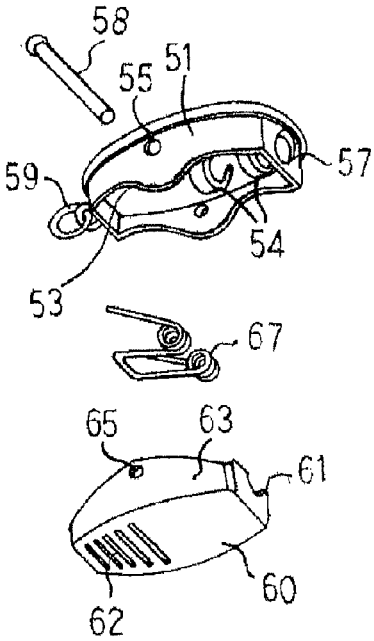
FIG. 70 is an exploded perspective view of the conventional coupler illustrated in FIG. 69.
Figure 71:
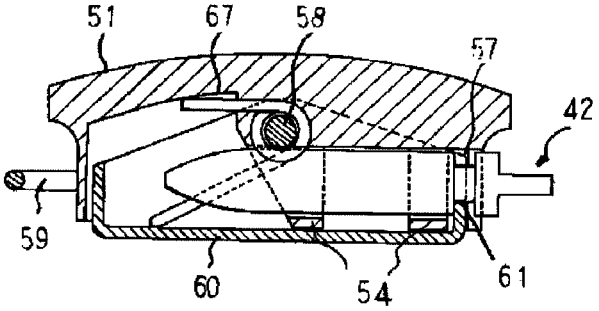
FIG. 71 is a longitudinal cross-sectional view of the conventional coupler illustrated in FIG. 69.

Specifically, whereas the conventional coupler 40 illustrated in FIGS. 69 to 71 has to include the guide 54, the shaft 58 and the coil spring 67, the coupler 100 in accordance with the first embodiment employs one part, that is, the guide 150, in place of those three parts.

Figure 72:
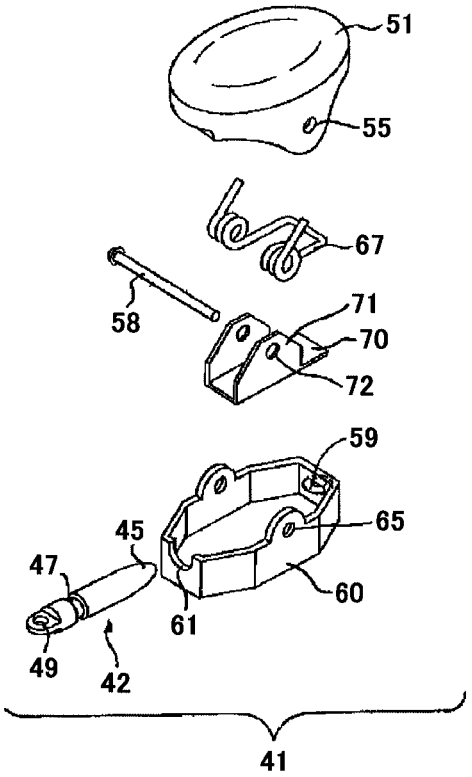
FIG. 72 is a perspective view of another conventional coupler.

Further, whereas the conventional coupler 41 illustrated in FIG. 72 has to include the guide 70, the shaft 58 and the coil spring 67, the coupler 100 in accordance with the first embodiment employs one part, that is, the guide 150, in place of those three parts.

As mentioned above, the coupler 100 in accordance with the first embodiment can reduce a number of parts by two in comparison with the conventional couplers 40 and 41.

Secondly, the following secondary advantages can be provided by reducing a number of parts, in particular, making the shaft 58 and the coil spring 67 unnecessary.

The first secondary advantage is that it is possible to shorten a period of time necessary for assembling the coupler.

As mentioned above, since the shaft 58 and the coil spring 68 are small-sized, even those skilled in the field required much time to assemble a coupler through the use of them. In contrast, since the coupler 100 in accordance with the first embodiment can be assembled without the shaft 58 and the coil spring 67, it is possible to much shorten a time necessary for assembling the coupler 100.

The shortened period of time for assembling the coupler brings reduction in fabrication costs.

The second secondary advantage is that a weight of the coupler can be reduced.

By reducing a weight of the coupler, it is possible to enhance a weight balance of an ornament including the coupler.

For instance, in the case that the coupler is connected to a necklace, if the coupler is heavy, the coupler tends to sink downwardly, and hence, the coupler slips down on a front side of a user. By reducing a weight of the coupler, it is possible to prevent the coupler from slipping down.

The third secondary advantage is that the coupler can be made small-sized. The conventional couplers were required to have such a size that the shaft 58 could be inserted into the through-holes 55 of the upper body 51, the through-holes 65 of the lower body 60, and the hole of the coil spring 67. Since the coupler 100 makes it possible to reduce a number of parts and be readily assembled, it is possible to provide the coupler smaller in size than the conventional couplers.

The fourth secondary advantage is that a defective rate of parts can be reduced.

The greater a number of parts is, the greater a defective rate of parts is. By reducing a number of parts, it is possible to reduce a defective rate of parts, and accordingly, a defective rate of final products, that is, the couplers.

The structure of the coupler 100 in accordance with the first embodiment is not to be limited to the above-mentioned one, but may be varied in many ways.

For instance, though the first wall 162 and the second wall 163 may be designed flat, they may be designed to be inwardly cambered, as illustrated in FIGS. 2 and 3. Specifically, the first wall 162 may be designed to be downwardly slightly cambered, and the second wall 163 may be designed to be upwardly slightly cambered. In other words, the first wall 162 and the second wall 163 may be designed to be convex towards a center of the guide 150.

By designing the first wall 162 and the second wall 163 to be convex, it is possible to cause the first wall 162 and the second wall 163 to make contact at proximal and distal ends thereof with inner walls of the first body part 130 and the second body part 140.

As illustrated in FIG. 1, if necessary, the distal ends 164S and 165S of the third wall 164 and the fourth wall 165 may be covered with a cover 167 at outside of the female coupler 120.

By selecting an ornamental cover as the cover 167, the appearance of the coupler 100 can be enhanced.

In order for the distal ends 164S and 165S of the third wall 164 and the fourth wall 165 to be readily inserted into the through-holes 134 and 144, they may be rounded at corners or be shaped semi-circular.

Though the first wall 162 and the second wall 163 of the guide 150 are designed to be identical with each other in shape in the coupler 100 in accordance with the first embodiment, it is not always necessary to do so.

For instance, one of them may be designed to be greater in a length and/or a width than the other, or to be not identical with each other in shape in accordance with inner shapes of the first body part 130 and the second body part 140.

The guide 150 is composed of metal having elasticity, but may be composed of resin. However, the guide 150 composed of resin has durability inferior to the same of the guide 150 composed of metal.

The first body part 130 and the second body part 140 may be composed of a material having rigidity, such as metal, resin, ceramics and wood. For instance, the first body part 130 and the second body part 140 may be composed of a transparent material (transparent resin or ceramics), in which case, since a user of the coupler 100 can exteriorly observe the operation of the guide 150, it is possible to enhance designability of the coupler 100.

Though the upright wall 142 is formed on the second body part 140 in the coupler 100 in accordance with the first embodiment, the upright wall 142 may be designed on the first body part 130, or the upright wall 142 may be formed on both the first body part 130 and the second body part 140.

Figure 4:
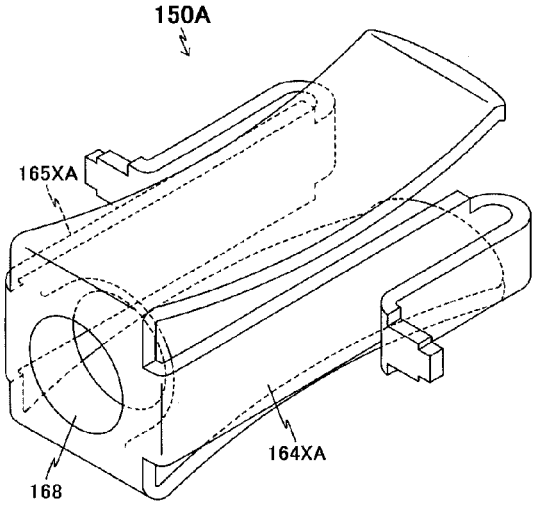
FIG. 4 is a perspective view of a guide as a variation of the guide in the coupler in accordance with the first embodiment.

FIG. 4 is a perspective view of a guide 150A as a variant of the guide 150.

The first portion 164X of the third wall 164 and the first portion 165X of the fourth wall 165 of the guide 150 are comprised of a single plate in the guide 150 in the first embodiment. In the guide 150A, as illustrated in FIG. 4, each of the first portion 164XA of the third wall 164 and the first portion 165XA of the fourth wall 165 is formed by bending a single plate in J-shape to thereby form a two-layered structure.

By designing the first portion 164XA of the third wall 164 and the first portion 165XA of the fourth wall 165 to be of a two-layered structure, it is possible to enhance an elastic force and durability against fatigue with respect to the third wall 164 and the fourth wall 165.

Furthermore, as illustrated in FIG. 4, the base wall 161 is formed around a peripheral edge of the through-hole 161 with a cylindrical reinforcement 168 extending in the direction A.

Though a strength of the base wall 161 formed with the through-hole 166 is unavoidably reduced, it is possible to prevent reduction in a strength of the base wall 161 by adding the reinforcement 168 to the base wall 161.

In addition, since the reinforcement 168 is cylindrical, the reinforcement 168 acts as a guide for the male coupler 110 when the male coupler 110 passes through the through-hole 166.

Figure 5:
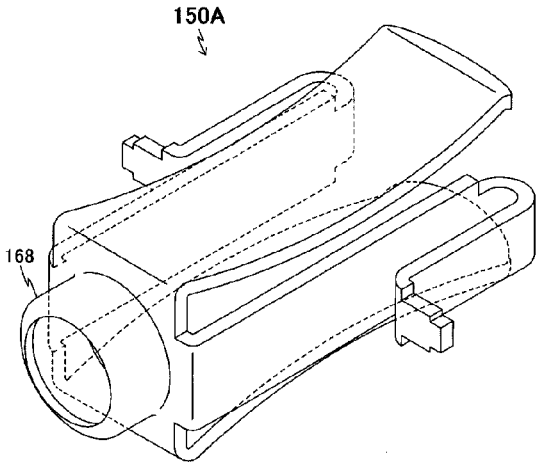
FIG. 5 is a perspective view of a guide as a variation of the guide in the coupler in accordance with the first embodiment.

As illustrated in FIG. 5, the reinforcement 168 may be designed to extend in a direction opposite to the direction A.

Figure 6:
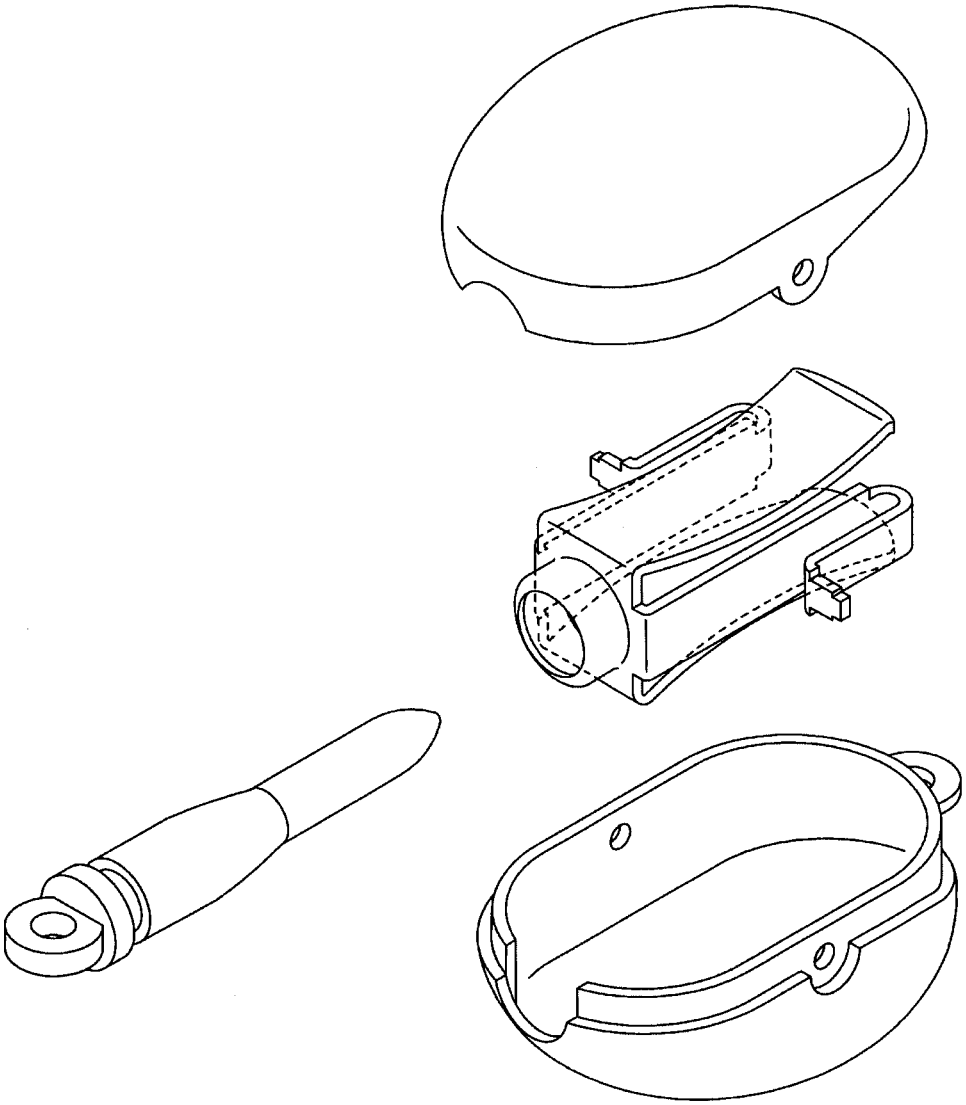
FIG. 6 is a perspective view of an example of a coupler including the guide illustrated in FIG. 5.

FIG. 6 is a perspective view of an example of a coupler including the guide 150A illustrated in FIG. 5.

As is obvious in view of FIG. 6, a first body part and a second body part are different in shape from the first body part 130 and the second body part 140 both illustrated in FIG. 1. This means that the first body part and the second body part may be designed to have any shape, if they can be rotatably connected to each other and define therein the space 160 in which the guide is to be arranged.

(Second Embodiment)

Figure 7:
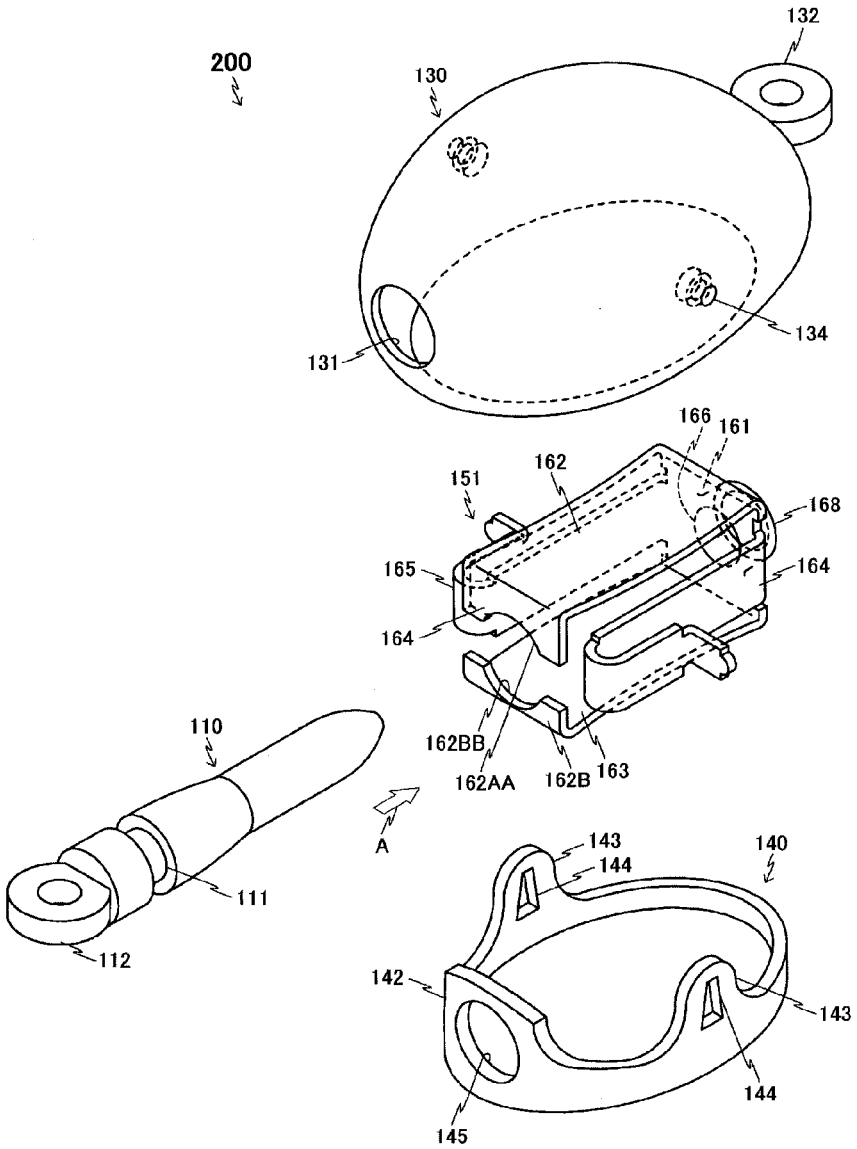
FIG. 7 is an exploded perspective view of a coupler in accordance with the second embodiment of the present invention.

FIG. 7 is an exploded perspective view of a coupler 200 in accordance with the second embodiment of the present invention.

The coupler 200 in accordance with the second embodiment is designed to include a guide 151 in place of the guide 150 used in the first embodiment.

As illustrated in FIG. 7, the guide 151 includes a base wall 161 formed with a through-hole 166 through which the male coupler 110 can pass, a first wall 162 extending from an upper edge of the base wall 161 in a direction opposite to the direction A in which the male coupler 110 is inserted into the female coupler 120, a second wall 163 extending from a lower edge of the base wall 161 in the same direction as the first wall 162, a third wall 164 extending from one of side-edges of the base wall 161 in the same direction as the first wall 162, and a fourth wall 165 extending from the other side-edge of the base wall 161 in the same direction as the first wall 162.

The base wall 161 is formed along a peripheral edge of the through-hole 166 with a cylindrical reinforcement 168 outwardly extending.

The first wall 162 includes at a distal end thereof a first extension 162A extending towards the second wall 163, and the second wall 163 includes at a distal end thereof a second extension 162B extending towards the first wall 161.

As illustrated in FIG. 7, a distal end of the first extension 162A and a distal end of the second extension 162B are spaced away from each other. The first extension 162A is formed at a distal end with an arcuate cut-out 162AA, and the second extension 162B is formed at a distal end with an arcuate cut-out 162BB. When the first extension 162A and the second extension 162B makes contact at distal ends thereof with each other, the two cut-outs 162AA and 162BB define a circular opening through which the male coupler 110 can pass and by which the male coupler 110 is supported.

The third wall 164 and the fourth wall 165 are identical in a structure and functions with the third wall 164 and the fourth wall 165 of the guide 150 in the first embodiment except that the third wall 164 and the fourth wall 165 of the guide 151 have a two-layered structure.

Similarly to the guide 150 in the first embodiment, the guide 151 is composed of a material having elasticity. Thus, the first wall 162 and the second wall 163 can act as a spring around the base wall 161. Similarly, the third wall 164 and the fourth wall 165 can act as a spring around the base wall 161.

The upright wall 142 of the second body part 140 in the second embodiment is formed with a through-hole 145 through which the male coupler 110 can pass. The through-holes 144 of the second body part 140 are designed to be vertically long and to have a short upper edge and a long lower edge to thereby define a trapezoid, unlike the through-holes 144 in the first embodiment.

The coupler 200 in accordance with the second embodiment, having the above-mentioned structure, can be wholly manually assembled in the same way as the coupler 100 in accordance with the first embodiment.

Figure 8:
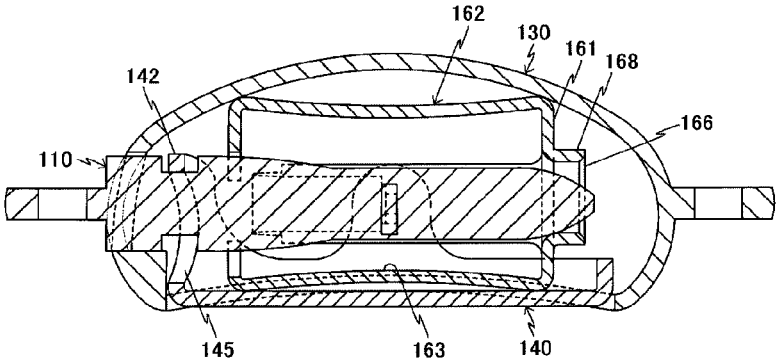
FIG. 8 is a longitudinal cross-sectional view of the coupler in accordance with the second embodiment, showing that the male coupler is inserted into the female coupler.
Figure 9:
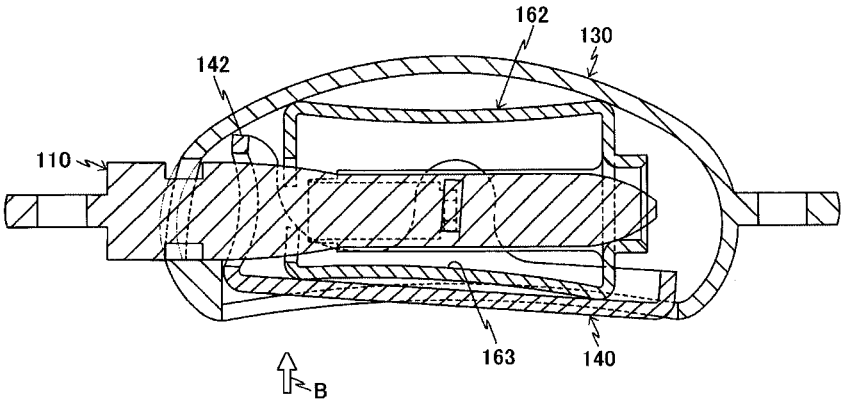
FIG. 9 is a longitudinal cross-sectional view of the coupler in accordance with the second embodiment, showing that the male coupler is taken out of the female coupler.

FIG. 8 is a longitudinal cross-sectional view of the coupler 200 in accordance with the second embodiment, showing that the male coupler 110 is inserted into the female coupler, and FIG. 9 is a longitudinal cross-sectional view of the coupler 200 in accordance with the second embodiment, showing that the male coupler 110 is taken out of the female coupler.

The coupler 200 in accordance with the second embodiment is used as follows.

First, a line-shaped ornament such as a necklace is connected at one end to the connection ring 132 of the first body part 130, and at the other end to the connection ring 112 of the male coupler 110.

When the male coupler 110 is inserted into the female coupler 120, as illustrated in FIG. 8, the male coupler 110 is inserted into the through-hole 131 of the first body part 130, and then, into the through-hole 145 of the upright wall 142.

The male coupler 110 enters the guide 151 in the direction A, preventing the second body part 140 from lowering due to the elastic forces of the first wall 162 and the second wall 163 by making contact with the through-hole 145 at an outer surface.

Further inserting the male coupler 110, when the annular groove 111 of the male coupler 110 aligns with the through-hole 145 of the upright wall 142, the second body part 140 lowers by virtue of the elastic forces of the first wall 162 and the second wall 163, and thus, the upright wall 142 goes engaged with the annular groove 111 from upward. FIG. 8 illustrates this condition.

The upright wall 142 is engaged with the annular groove 111 through the through-hole 145 in the above-mentioned manner, resulting in that the male coupler 110 is fixed in the female coupler 120.

When the male coupler 110 is taken out of the female coupler 120, as illustrated in FIG. 9, the upright wall 142 of the second body part 140 is pushed up in the direction B. Since the through-holes 144 of the second body part 140 have a vertical length, the second body part 140 upwardly slides. The second wall 163 is also pushed up through the second body part 140 to thereby move towards the first wall 162 around the base wall 161. Since the through-holes 144 are designed to have a vertical length, the first body part and the second body part in the coupler 200 are connected to each other rotatably not around the through-holes 144, but around the base wall 161. Thus, the second body part 140 substantially upwardly and downwardly slides.

When the second body part 140 upwardly moves (that is, the second body part 140 rotates around the base wall 161 in a clockwise direction), as illustrated in FIG. 9, the upright wall 142 also upwardly moves, resulting in that the through-hole 145 of the upright wall 142 and the annular groove 111 of the male coupler 110 are disengaged with each other. Thus, now the male coupler 110 is not fixed relative to the female coupler 120.

Thus, by pulling the male coupler 110 in a direction opposite to the direction A, keeping the second body part 140 pushed in the direction B, the male coupler 110 can be pulled out of the female coupler 120.

After the male coupler 110 was pulled out of the female coupler 120, releasing the second body part 140 from being pushed in the direction B (that is, releasing a user's fingers from the second body part 140), the second body part 140 rotates around the through-holes 144 in a counter-clockwise direction by virtue of the elastic force of the second wall 163, and thus, returns to its original position (the position illustrated in FIG. 8).

As mentioned above, the coupler 200 in accordance with the second embodiment provides not only the same advantages as those of the coupler 100 in accordance with the first embodiment, but also the additional advantage of enhancement in operability, since the first and second body parts are designed to rotate around the base wall 161, it is possible to rotate the first and second body parts, even if they are pushed in the vicinity of centers thereof, to thereby disengage them from each other.

The structure of the coupler 200 in accordance with the second embodiment is not to be limited to the above-mentioned one, but may be varied in many ways.

For instance, a shape of the guide 151 is not to be limited to the shape illustrated in FIG. 7, but may be varied in many ways.

Figure 10:
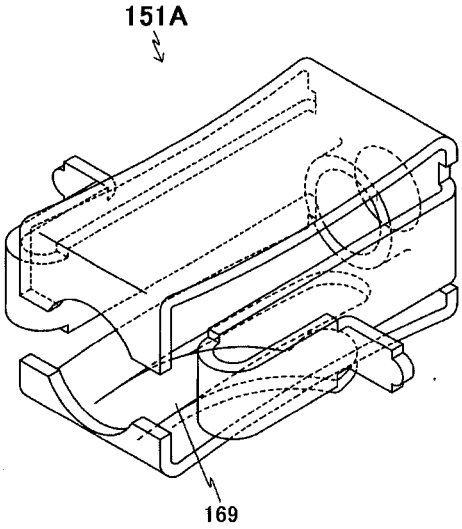
FIG. 10 is a perspective view of a guide as a variation of the guide in accordance with the second embodiment.
Figure 11:
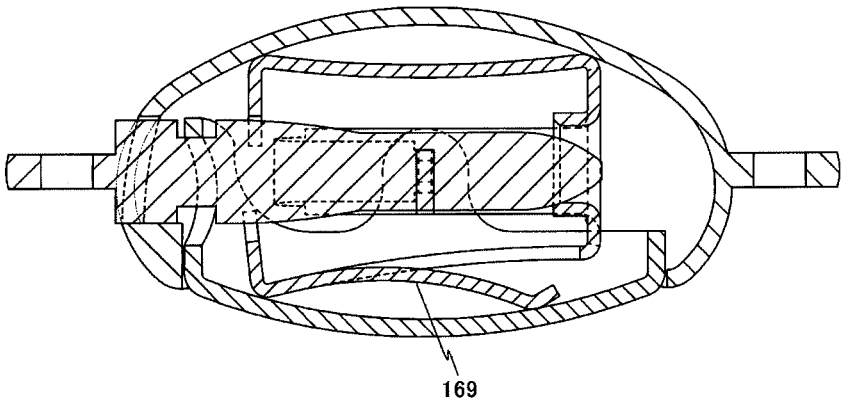
FIG. 11 is a longitudinal cross-sectional view showing that the male coupler is inserted into the female coupler including the guide illustrated in FIG. 10.

FIG. 10 is a perspective view of a guide 151A as a variation of the guide 151, and FIG. 11 is a longitudinal cross-sectional view showing that the male coupler 110 is inserted into the female coupler 120 including the guide 151A.

As illustrated in FIGS. 10 and 11, the guide 151A is designed to include an auxiliary elastic part 169 formed at the second wall 163. The auxiliary elastic part 169 is formed to extend in a lengthwise direction of the second wall 163 by making a U-shaped cut in the second wall 163 in a lengthwise direction thereof. Specifically, by making a U-shaped cut in the second wall 163 such that an open end of "U" is directed to a distal end of the second wall 163, the auxiliary elastic part 169 is formed so as to have a proximal end in the vicinity of a distal end of the second wall 163, and a distal end in the vicinity of a proximal end of the second wall 163. A distal end of the auxiliary elastic part 169 is located below the second wall 163.

As illustrated in FIG. 11, in the coupler 200 including the guide 151A, the first wall 162 of the guide 151A makes contact at distal and proximal ends thereof with an inner wall of the first body part 130 in the female coupler 120 to thereby exert an elastic force for pushing outwardly (that is, upwardly) the first body part 130, and the second wall 163 of the guide 151A makes contact at a distal end thereof with an inner wall of the second body part 140, and further, the auxiliary elastic part 169 makes contact at a distal end thereof with an inner wall of the second body part 140 in the female coupler 120 to thereby exert an elastic force for pushing outwardly (that is, downwardly) the second body part 140.

Thus, the guide 151A is able to have an elastic force greater than the same of the guide 151 by including the auxiliary elastic part 169. Accordingly the guide 151A can make contact with inner walls of the first body part 130 and the second body part 140 with an elastic force greater than the same of the guide 150, preventing occurrence of lash between the guide 151A and the first body part 130/the second body part 140.

It should be noted that though the auxiliary elastic part 169 is formed only at the second wall 163 in the guide 151A, the auxiliary elastic part 169 may be formed at the first wall 162 or at both of the first wall 162 and the second wall 163.

Furthermore, the guide 151A is designed to include the single auxiliary elastic part 169 at the second wall 153, but may be designed to include two or more auxiliary elastic parts in parallel with one another.

The guide 151A is designed to have the auxiliary elastic part 169 by making a U-shaped cut in the second wall 163. The auxiliary elastic part 169 may be formed in other ways. For instance, an elastic part having the same shape as that of the auxiliary elastic part 169 may be attached onto a surface of the second wall 163 by welding and so on.

In the guide 151 in the second embodiment, the base wall 161 is designed to have the through-hole 166 and the reinforcement 168, and each of the third wall 164 and the fourth wall 165 has a folded structure (a two-layered structure). As an alternative, the guide 151 can be formed simpler.

Figure 12:
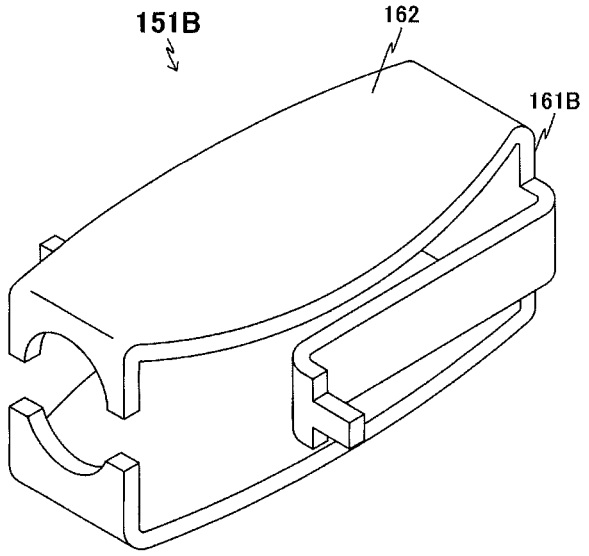
FIG. 12 is a perspective view of a guide as second variation of the guide in the coupler in accordance with the second embodiment.

FIG. 12 is a perspective view of a guide 151B as second variation of the guide 151.

In comparison with the guide 151 illustrated in FIG. 7, the base wall 161 of the guide 151B is designed not to have the through-hole 166 and the reinforcement 168. Furthermore, the third wall 164 and the fourth wall 165 do not have a folded structure, but are designed to have the same structure as those of the third wall 164 and the fourth wall 165 of the guide 150 (see FIG. 1) in the first embodiment.

The coupler 200 in accordance with the second embodiment may be designed to include the guide 151B in place of the guide 151.

Furthermore, the structures of the first body part 130 and the second body part 140, both of which are components of the female coupler 120 in the coupler 200 in accordance with the second embodiment, are not to be limited to the structures illustrated in FIG. 7, but may be varied in many ways.

Figure 13:
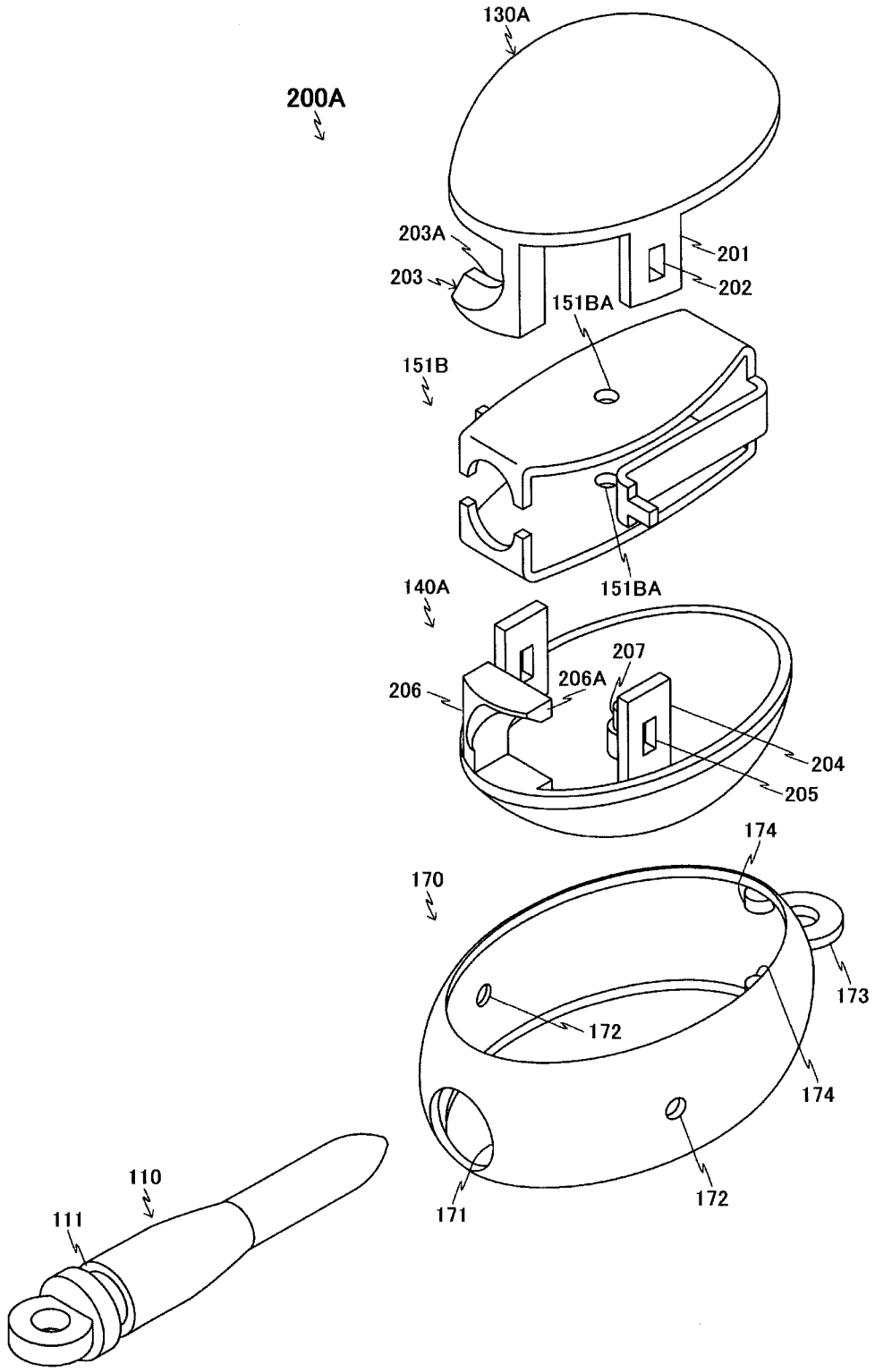
FIG. 13 is an exploded perspective view of a coupler in accordance with the first variation of the second embodiment.
Figure 14:
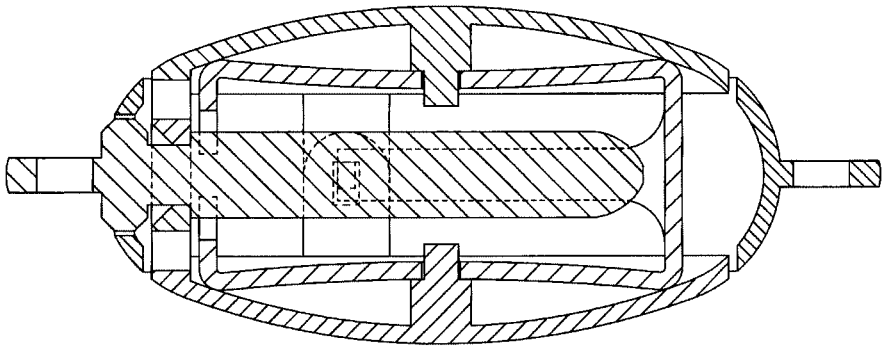
FIG. 14 is a longitudinal cross-sectional view of the coupler in accordance with the first variation of the second embodiment, showing that the male coupler is inserted into the female coupler.
Figure 15:
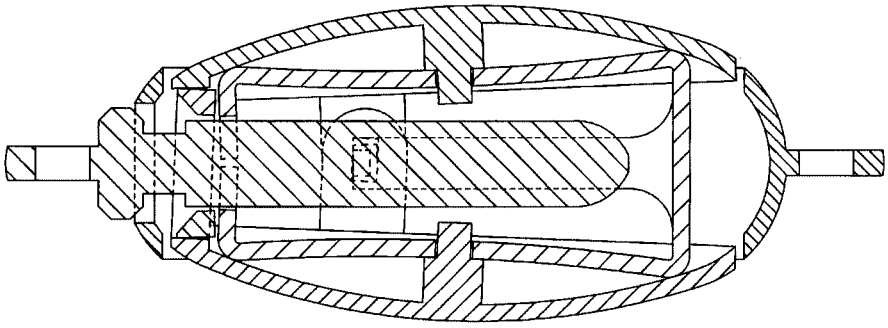
FIG. 15 is a longitudinal cross-sectional view of the coupler in accordance with the first variation of the second embodiment, showing that the male coupler is taken out of the female coupler.

FIG. 13 is an exploded perspective view of a coupler 200A in accordance with the first variation of the second embodiment, FIG. 14 is a longitudinal cross-sectional view of the coupler 200A, showing that the male coupler 110 is inserted into the female coupler 120, and FIG. 15 is a longitudinal cross-sectional view showing that the male coupler 110 is taken out of the female coupler 120.

The female coupler 120 in the coupler 200A includes a first body part 130A, a second body part 140A rotatably connected with the first body part 130A and defining a hollow space 160 therein together with the first body part 130A, a guide 151A illustrated in FIG. 12, and an outer cover 170 housing therein both the first body part 130A and the second body part 140A such that the first body part 130A and the second body part 140A can rotate relative to each other.

The first body part 130A is open downwardly and is in the form of an upwardly projecting dome, and further, has a pair of sidewalls 201. Each of the sidewalls 201 is formed with a vertically long rectangular opening 202 into which distal ends 164S and 165S of the guide 151B are fit.

The first body part 130A is designed to include a first support 203 at a distal end thereof (a left end in FIG. 13). The first support 203 extends downwardly, that is, towards the second body part 140A. The first support 203 is J-shaped, and is formed at a distal end thereof with an engagement part 203A engagable to a lower area of the annular groove 111 of the male coupler 110.

The second body part 140A is open upwardly and is in the form of an downwardly projecting dome, and further, has a pair of sidewalls 204. Each of the sidewalls 204 is formed with a vertically long rectangular opening 205 into which distal ends 164S and 165S of the guide 151B are fit.

The second body part 140A is designed to include a second support 206 at a distal end thereof (a left end in FIG. 13). The second support 206 extends upwardly, that is, towards the first body part 130A. The second support 206 is J-shaped, and is formed at a distal end thereof with an engagement part 206A engagable to an upper area of the annular groove 111 of the male coupler 110.

The outer cover 170 is vertically open, and is in the form of a ring having an ellipse cross-section. The outer cover 170 has a size sufficient to house therein both the first body part 130A and the second body part 140A (the guide 151A is sandwiched between the first body part 130A and the second body part 140A).

The outer cover 170 has a through-hole 171 through which the male coupler 110 can pass at a front thereof, and a pair of through-holes 172 into which the distal ends 164S and 165S of the guide 151B are fit at a sidewall thereof. The outer cover 170 has a connection ring 173 at a rear (a right end in FIG. 13) thereof.

The outer cover 173 is formed at an inner wall thereof with a pair of projections 174. As illustrated in FIGS. 14 and 15, when the first body part 130A and the second body part 140A are housed in the outer cover 170, the projections 174 positions the first body part 130A and the second body part 140A relative to the outer cover 170.

The distal ends 164S and 165S of the guide 151B are fit into the openings 202 of the first body part 130A, the openings 205 of the second body part 140A, and the through-holes 172 of the outer cover 170, and thus, the guide 151B is positioned.

The guide 151B is formed at the first and second walls thereof with through-holes 151BA, and the first body part 130A and the second body part 140A are formed at inner walls thereof with projections 207 to be fit into the through-holes 151BA. The projections 207 are fit into the through-holes 151BA to thereby cause the guide 151B to be positioned relative to the first body part 130A and the second body part 140A.

The coupler 200A in accordance with the first variation is used as follows.

Inserting the male coupler 110 into the female coupler 120 through the through-holes 171 of the outer cover 170, as illustrated in FIG. 14, the male coupler 110 goes forward, making contact with both the first support 203 of the first body part 130A and the second support 206 of the second body part 140A to thereby prevent the first support 203 from upwardly moving and the second support 206 from downwardly moving.

When the male coupler 110 goes forward further into the guide 151B, as illustrated in FIG. 14, the cut-out 162AA formed at a distal end of the first extension 162A of the first wall 162 supports an upper area of the male coupler 110, and the cut-out 162BB formed at a distal end of the second extension 162B of the second wall 163 supports a lower area of the male coupler 110.

When the male coupler 110 reaches at a location where the annular groove 111 of the male coupler 110 vertically aligns with both the first support 203 of the first body part 130A and the second support 206 of the second body part 140A, the engagement part 203A of the first support 203 of the first body part 130A is fit into a lower area of the annular groove 111 of the male coupler 110, and the engagement part 206A of the second support 206 of the second body part 140A is fit into an upper area of the annular groove 111 of the male coupler 110 by virtue of the elastic force of the guide 151B. Thus, the male coupler 110 is fixed in the guide 151B. FIG. 14 illustrates this situation.

When the male coupler 110 is to be taken out of the guide 151B, as illustrated in FIG. 15, the first body part 130A is pushed towards the second body part 140A in the direction B, and the second body part 140A is pushed towards the first body part 130A in the direction B.

As a result, the first support 203 of the first body part 130A downwardly moves and the second support 206 of the second body part 140A upwardly moves, and hence, the annular groove 111 of the male coupler 110 goes disengaged from the first support 203 and the second support 206. Thereafter, the male coupler 110 can be pulled out of the guide 151B.

As mentioned above, the coupler 200A in accordance with the first variation provides the same advantages as those provided by the coupler 200 in accordance with the second embodiment. As is obvious in light of the first variation, if the through-holes into which the distal ends of the third and fourth walls are fit had a length in a direction (a vertical direction in FIG. 13) in which the elastic forces of the first and second walls are exerted, the advantages provided by the coupler 200 can be obtained. The through-holes may be designed to be trapezoidal, rectangular, and so on.

Figure 16:
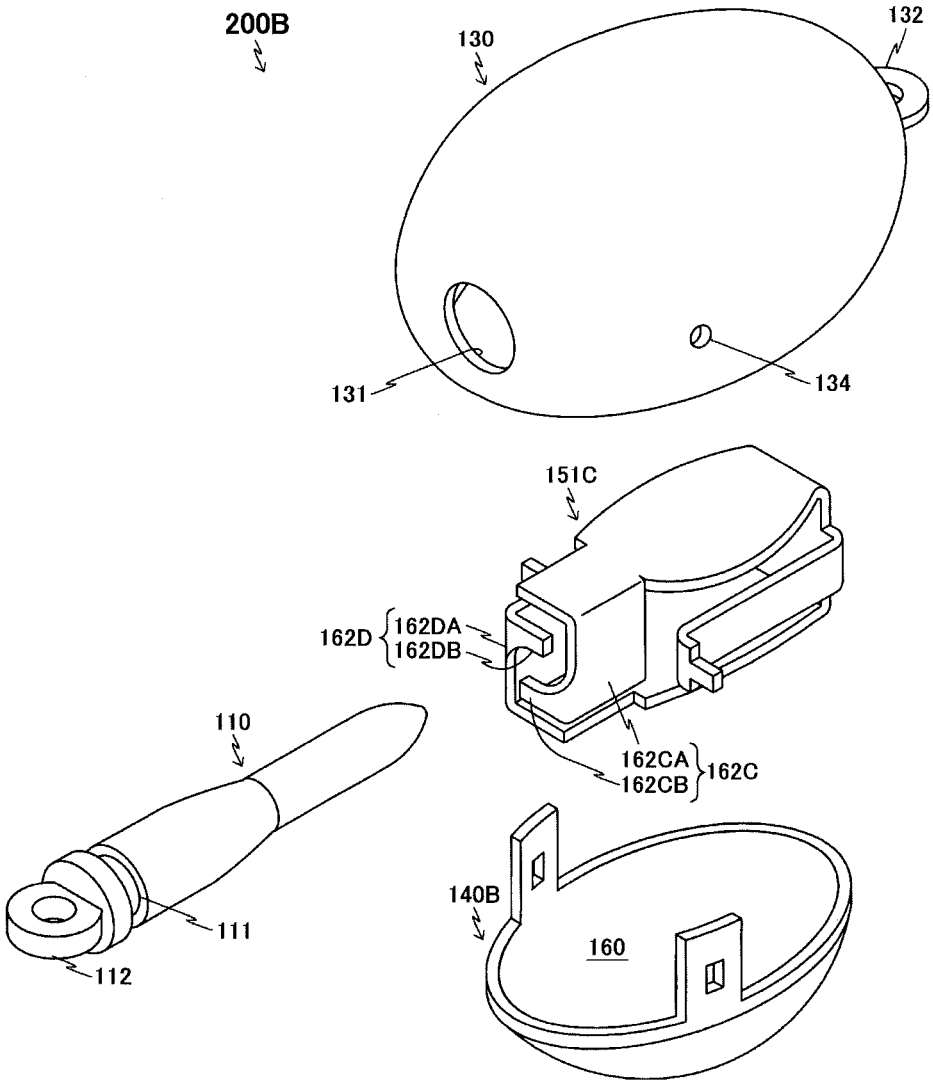
FIG. 16 is an exploded perspective view of a coupler in accordance with the second variation of the second embodiment.

FIG. 16 is an exploded perspective view of a coupler 200B in accordance with the second variation of the second embodiment.

In comparison with the coupler 200 in accordance with the second embodiment (see FIG. 7), the coupler 200B is designed to include a guide 151C in place of the guide 151B.

In comparison with the guide 151B (see FIG. 12), the guide 151C is designed to include a first extension 162C and a second extension 162D in place of the first extension 162A and the second extension 162B.

The first extension 162C includes a first portion 162CA extending towards the second wall 163 from one of side edges including a distal end of the first wall 162, and a second portion 162CB extending inwardly of the guide 151C from a lower end of the first portion 162CA in parallel with the first wall 162.

The second extension 162D includes a first portion 162DA extending towards the first wall 162 from one of side edges (a side edge located opposite to the side edge of the first wall 162 at which the first extension 162CA is formed) including a distal end of the second wall 163, and a second portion 162DB extending inwardly of the guide 151C from an upper end of the first portion 162DA in parallel with the second wall 163.

As illustrated in FIG. 16, the second portion 162DB of the second extension 162D is located ahead of a distal end of the first wall 162, and the second portion 162CB of the first extension 162C is located ahead of the second portion 162DB of the second extension 162D and a distal end of the second wall 163. Accordingly, even if the second portion 162CB of the first extension 162C and the second portion 162DB of the second extension 162D move upwardly and downwardly, they do not interfere with each other.

When viewed from a front (that is, in the direction A), the second portion 162CB of the first extension 162C and the second portion 162DB of the second extension 162D are substantially J-shaped arcuate.

As illustrated in FIG. 16, the second portion 162CB of the first extension 162C and the second portion 162DB of the second extension 162D are spaced from each other and face each other in a common plane. Thus, as mentioned later, when the male coupler 110 is inserted into the guide 151C, the second portion 162CB of the first extension 162C engages with a lower area of the male coupler 110, and the second portion 162DB of the second extension 162D engages with an upper area of the male coupler 110.

Since the second portion 162CB of the first extension 162C and the second portion 162DB of the second extension 162D are engaged with the annular groove 111 of the male coupler 110 in the coupler 200B, the second body part 140B is not formed with the upright wall 142 (see FIG. 7).

The coupler 200B in accordance with the second variation is used as follows.

Inserting the male coupler 110 into the female coupler 120 through the through-hole 131 of the first body part 130, the male coupler 110 goes forward, making contact with the second portion 162CB of the first extension 162C and the second portion 162DB of the second extension 162D to thereby prevent the second portion 162CB of the first extension 162C from upwardly moving and the second portion 162DB of the second extension 162D from downwardly moving.

When the male coupler 110 reaches at a location where the annular groove 111 of the male coupler 110 vertically aligns with both the second portion 162CB of the first extension 162C and the second portion 162DB of the second extension 162D, the second portion 162CB of the first extension 162C is fit into a lower area of the annular groove 111 of the male coupler 110, and the second portion 162DB of the second extension 162D is fit into an upper area of the annular groove 111 of the male coupler 110 by virtue of the elastic force of the guide 151C. Thus, the male coupler 110 is fixed in the guide 151C.

When the male coupler 110 is to be taken out of the guide 151C, the first body part 130A and the second body part 140A are pushed towards each other. Thus, the first wall 162 and the second wall 163 move towards each other.

As a result, the second portion 162CB of the first extension 162C downwardly moves and the second portion 162DB of the second extension 162D upwardly moves, and hence, the annular groove 111 of the male coupler 110 goes disengaged from the first extension 162C and the second extension 162D. Thereafter, the male coupler 110 can be pulled out of the guide 151C.

As mentioned above, the coupler 200B in accordance with the second variation provides the same advantages as those provided by the coupler 200 in accordance with the second embodiment.

Figure 17:
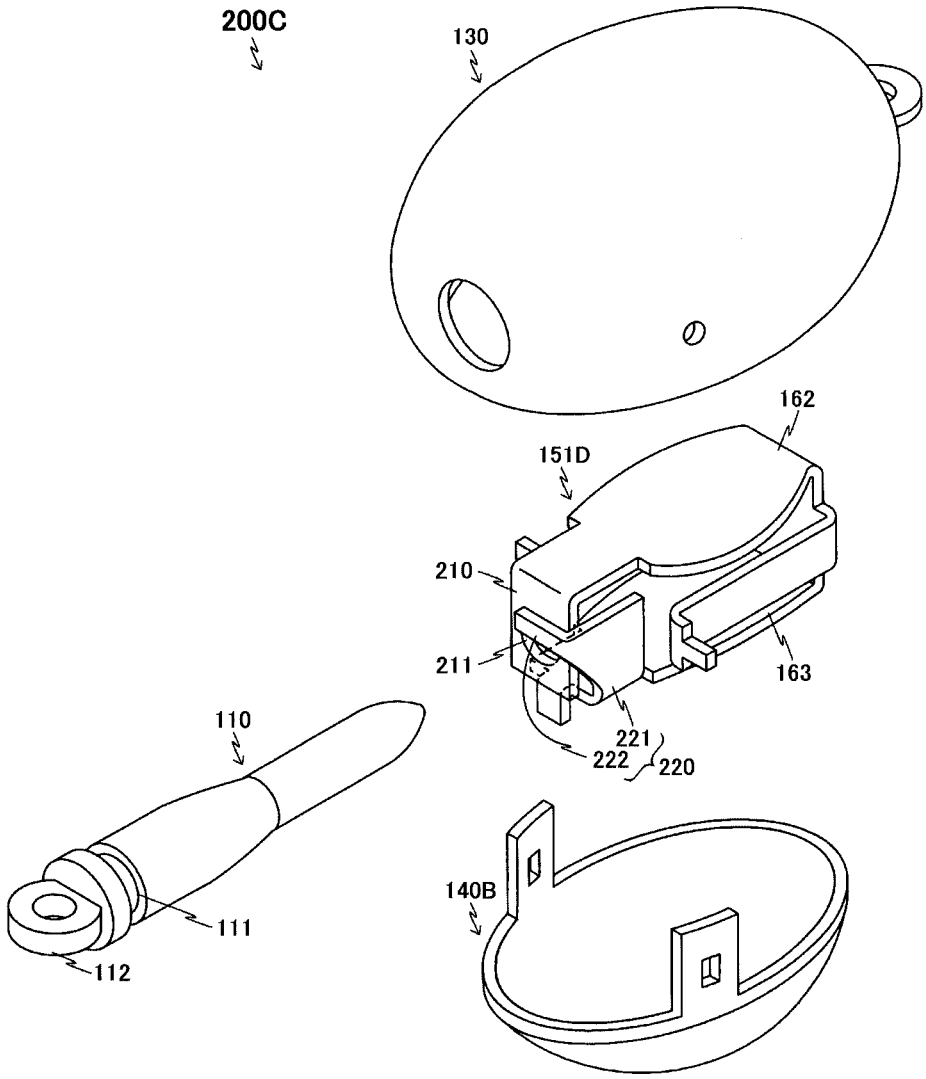
FIG. 17 is an exploded perspective view of a coupler in accordance with the third variation of the second embodiment.
Figure 18:
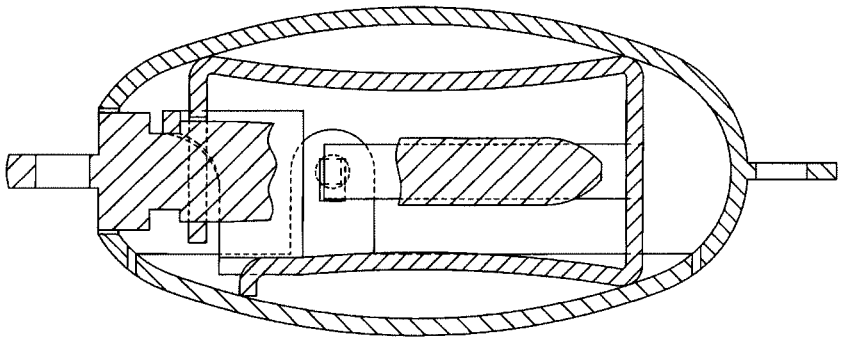
FIG. 18 is a longitudinal cross-sectional view of the coupler in accordance with the third variation of the second embodiment, showing that the male coupler is inserted into the female coupler.
Figure 19:
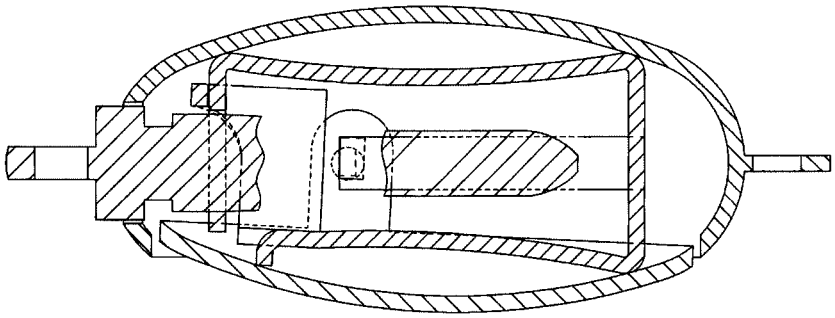
FIG. 19 is a longitudinal cross-sectional view of the coupler in accordance with the third variation of the second embodiment, showing that the male coupler is taken out of the female coupler.

FIG. 17 is an exploded perspective view of a coupler 200C in accordance with the third variation of the second embodiment, FIG. 18 is a longitudinal cross-sectional view of the coupler 200C, showing that the male coupler 110 is inserted into the female coupler 120, and FIG. 19 is a longitudinal cross-sectional view showing that the male coupler 110 is taken out of the female coupler 120.

In comparison with the coupler 200B (see FIG. 16) in accordance with the second variation, the coupler 200C in accordance with the third variation is designed to include a guide 151D in place of the guide 151C.

As illustrated in FIG. 17, the guide 151D is different from the guide 151C in a shape of the first extension 210 and the second extension 220.

The first extension 210 is bent perpendicularly at a distal end of the first wall 162, and extends downwardly. The first extension 210 is formed with a circular through-hole 211 through which the male coupler 110 can pass.

The second extension 220 includes a vertical portion 221 vertically upwardly extending from one of side edges of the second wall 163 which includes a distal end of the second wall 163, and having such a height that the vertical portion 221 does not interfere with the first wall 162, and a horizontal portion 222 extending from an upper edge of the vertical portion 221 in a direction perpendicular to the direction A.

The horizontal portion 222 of the second extension 220 is located ahead of the first extension 210.

The horizontal portion 222 of the second extension 220 acts in the same manner as the second portion 162DB of the second extension 162D in the guide 151C illustrated in FIG. 16. That is, the second extension 220 corresponds to the second extension 162D of the the guide 151C illustrated in FIG. 16.

Only the horizontal portion 222 of the second extension 220 engages to an upper area of the annular groove 111 of the male coupler 110 in the guide 151D, whereas the second portion 162CB of the first extension 162C engages to a lower area of the annular groove 111 of the male coupler 110 and the second portion 162DB of the second extension 162D engages to an upper area of the annular groove 111 of the male coupler 110 in the guide 151C.

As mentioned above, the coupler 200C in accordance with the third variation provides the same advantages as those provided by the coupler 200 in accordance with the second embodiment.

The first extension 210 is formed at the first wall 162 and the second extension 220 is formed at the second wall 163 in the coupler 200C. In contrast, the first extension 210 may be formed at the second wall 163, and the second extension 220 may be formed at the first wall 162, in which case, the structure of the guide is vertically point-symmetrical with the guide 151D.

Figure 20:
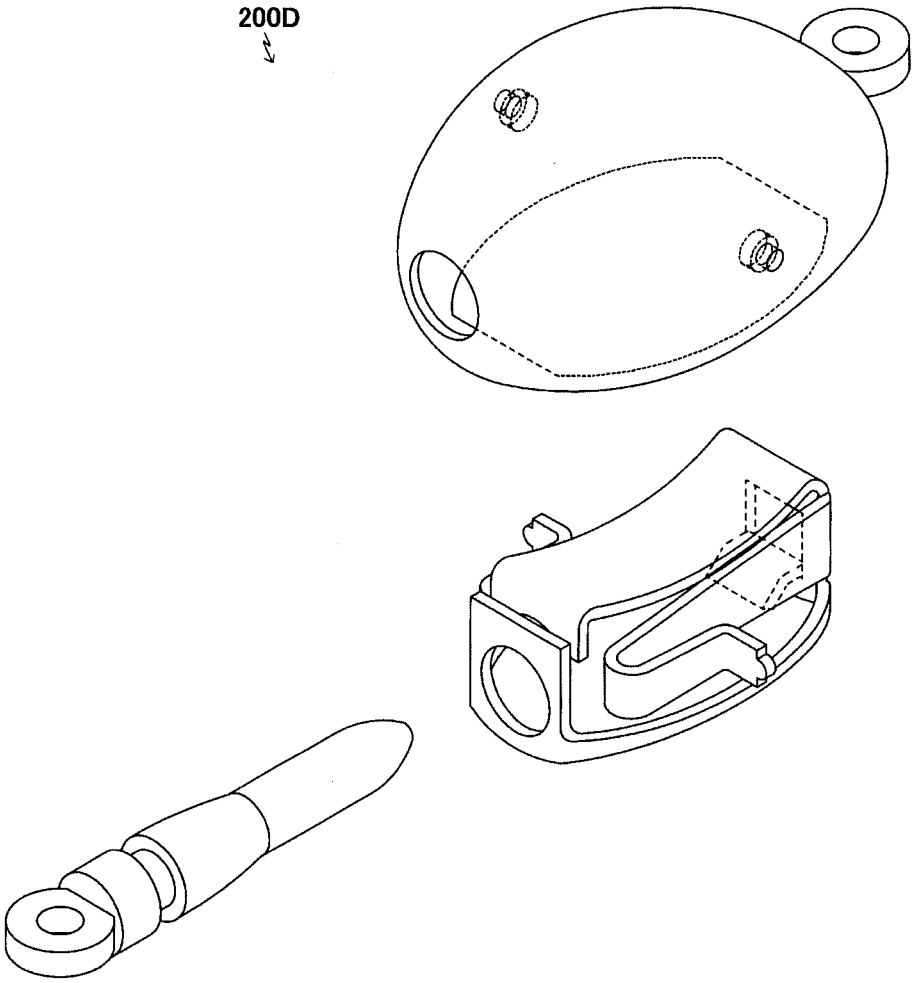
FIG. 20 is an exploded perspective view of a coupler in accordance with the fourth variation of the second embodiment.

FIG. 20 is an exploded perspective view of a coupler 200D in accordance with the fourth variation of the second embodiment.

In comparison with the coupler 200 in accordance with the second embodiment, the guide 151 and the second body part 140 are unified into one piece in the coupler 200D. Specifically, the second wall 163 of the guide 151 is formed at a distal end thereof with the upright wall 142 in place of the second extension 162B. The guide 151 is designed not to include the projecting walls 143.

(Third Embodiment)

Figure 21:
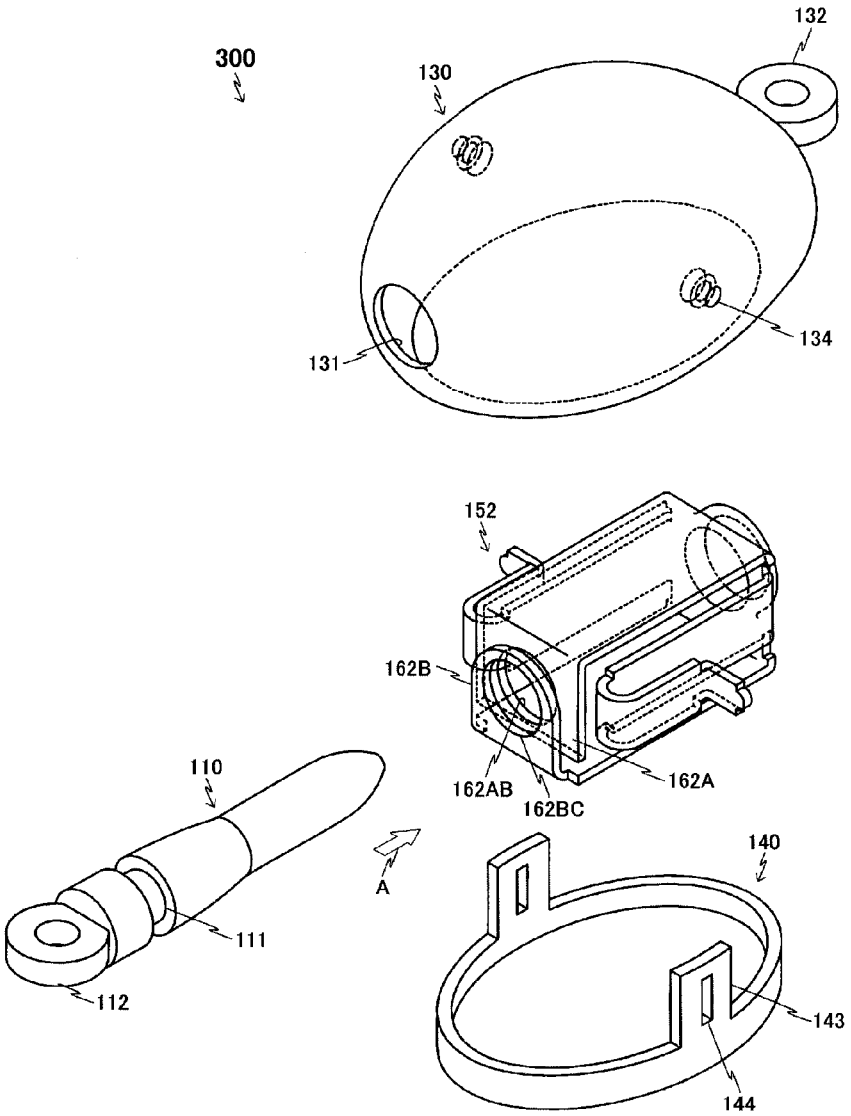
FIG. 21 is an exploded perspective view of a coupler in accordance with the third embodiment.
Figure 22:
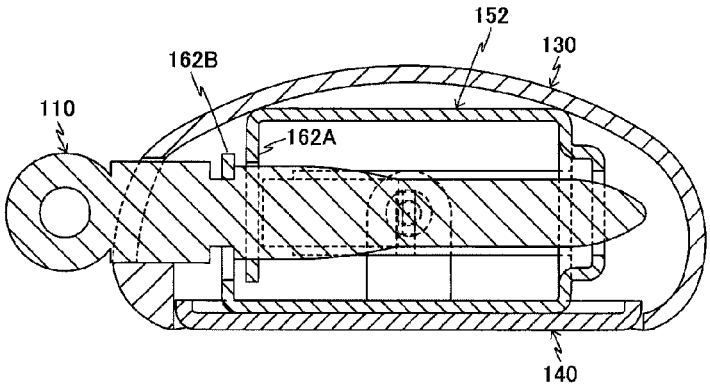
FIG. 22 is a longitudinal cross-sectional view of the coupler in accordance with the third embodiment, showing that the male coupler is inserted into the female coupler.
Figure 23:
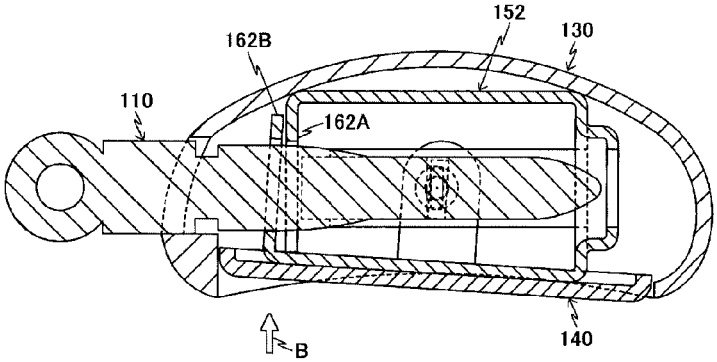
FIG. 23 is a longitudinal cross-sectional view of the coupler in accordance with the third embodiment, showing that the male coupler is taken out of the female coupler.

FIG. 21 is an exploded perspective view of a coupler 300 in accordance with the third embodiment, FIG. 22 is a longitudinal cross-sectional view of the coupler 300, showing that the male coupler 110 is inserted into the female coupler 120, and FIG. 23 is a longitudinal cross-sectional view showing that the male coupler 110 is taken out of the female coupler 120.

The coupler 300 in accordance with the third embodiment is structurally different from the coupler 200 (see FIG. 7) in accordance with the second embodiment in that the coupler 300 includes a guide 152 in place of the guide 151.

Due to a structural difference between the guide 151 in the second embodiment and the guide 152 in the third embodiment, the second body part 140 in the third embodiment is designed not to include the upright wall 142 (see FIG. 7).

A first extension 162A perpendicularly downwardly extending from a distal end of the first wall 162 is formed with a through-hole 162AB through which the male coupler 110 can pass, in place of the cut-out 162AA.

A second extension 162B perpendicularly upwardly extending from a distal end of the second wall 163 is formed with a through-hole 162BC through which the male coupler 110 can pass, in place of the cut-out 162BB.

The second extension 162B is located ahead of the first extension 162A. The first extension 162A and the second extension 162B are located such that they do not interfere with each other.

When the first wall 162 and the second wall 163 of the guide 152 are not deformed, the through-hole 162AB of the first extension 162A and the through-hole 162BD of the second extension 162B are coaxial with each other.

The coupler 300 in accordance with the third embodiment is used as follows.

Firstly, a line-shaped ornament such as a necklace is connected at one end thereof to the connection ring 132 of the first body part 130, and at the other end to the connection ring 112 of the male coupler 110.

When the male coupler 110 is inserted into the female coupler 120, as illustrated in FIG. 22, the male coupler 110 is inserted into the through-hole 131 of the first body part 130, and further, into the through-hole 162AB of the first extension 162A and the through-hole 162BC of the second extension 162B.

The male coupler 110 goes into the guide 151 in the direction A, making contact at an outer surface thereof with the through-hole 162BC of the second extension 162B to thereby prevent the second wall 163 from downwardly moving by virtue of the elastic force thereof.

By further inserting the male coupler 110 in the direction A, when the annular groove 111 of the male coupler 110 vertically aligns with the through-hole 162BC of the second extension 162B, the second wall 163 downwardly moves by virtue of the elastic force thereof to thereby cause the through-hole 162BC of the second extension 162B to engage to an upper area of the annular groove 111. FIG. 22 illustrates this situation.

The second wall 163 is fit into the annular groove 111 through the through-hole 162BC of the second extension 162B in the above-mentioned manner, and thus, the male coupler 110 is fixed in the female coupler 120.

When the male coupler 110 is taken out of the female coupler 120, as illustrated in FIG. 23, the second extension 162B of the guide 152 is pushed up through the second body part 140 in the direction B.

Thus, as illustrated in FIG. 23, since the second extension 162B is pushed up, the through-hole 162BC of the second extension 162B and the annular groove 111 of the male coupler 110 are disengaged from each other. Specifically, the male coupler 110 is no longer fixed relative to the female coupler 120.

Accordingly, by pulling the male coupler 110 in a direction opposite to the direction A, keeping the second body part 140 (accordingly, the second extension 162B of the guide 152) pushed in the direction B, the male coupler 110 can be pulled out of the female coupler 120.

After the male coupler 110 was pulled out of the female coupler 120, by stopping pushing the second body part 140 in the direction B (specifically, releasing a user's fingers from the second body part 140), the second body part 140 rotates in a counter-clockwise direction around the through-holes 144 by virtue of the elastic force of the second wall 163, and thus, returns to an initial position (the position illustrated in FIG. 22).

As mentioned above, the coupler 300 in accordance with the third embodiment provides the same advantages as those provided by the coupler 200 in accordance with the second embodiment.

(Fourth Embodiment)

Figure 24:
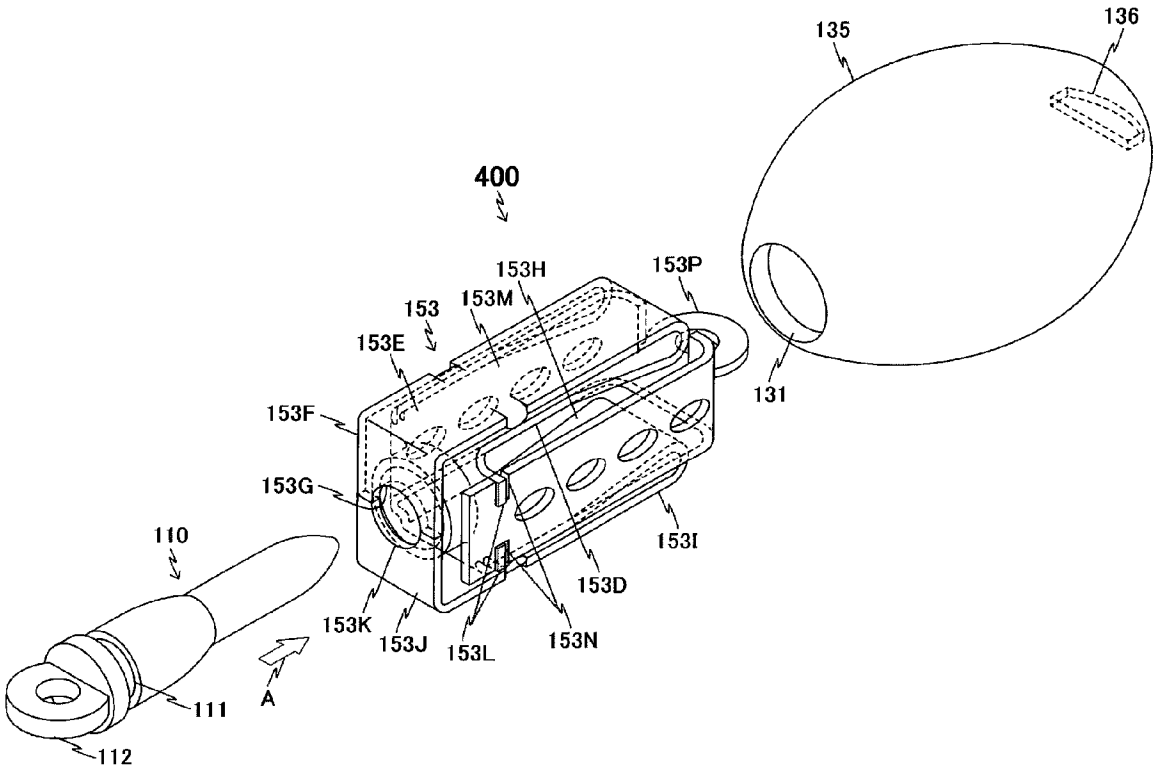
FIG. 24 is an exploded perspective view of a coupler in accordance with the fourth embodiment of the present invention.

FIG. 24 is an exploded perspective view of a coupler 400 in accordance with the fourth embodiment of the present invention.

As illustrated in FIG. 24, the coupler 400 in accordance with the fourth embodiment includes a male coupler 110, a guide 153, and a housing 135.

The housing 135 is composed of a deformable elastic material such as rubber and silicone, and is in the form of a hollow egg in which the guide 153 can be housed.

The housing 135 is formed at one end with a through-hole 131 through which the male coupler 110 can pass, and at the other end with a slit 136 through which a connection ring 153P (mentioned later) of the guide 153 can exteriorly extend.

Figure 25:
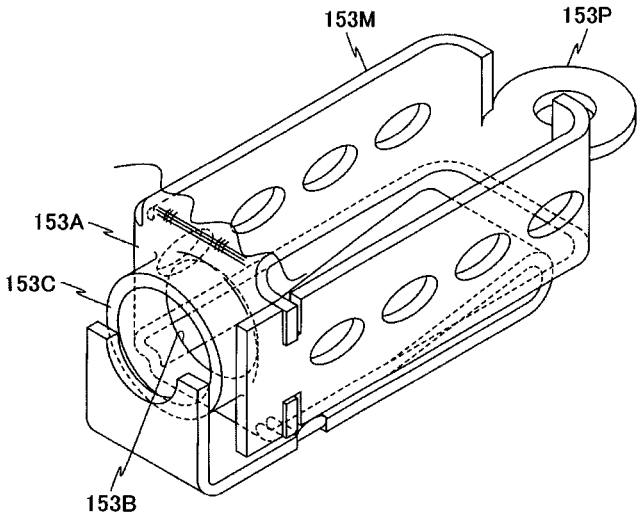
FIG. 25 is an exploded perspective view of the guide in accordance with the fourth embodiment with a part thereof being removed.

FIG. 25 is an exploded perspective view of the guide 153 with a part thereof being removed.

As illustrated in FIGS. 24 and 25, the guide 153 includes a base wall 153A formed centrally with a through-hole 153B through which the male coupler 110 can pass, a cylindrical reinforcement 153C forwardly extending from a peripheral edge of the through-hole 153A, a first portion 153D extending backwardly (in the direction A in which the male coupler 110 is inserted) from an upper edge of the base wall 153A, a second portion 153E upwardly bending in U-shape from a distal end of the first portion 153D, and forwardly extending beyond the reinforcement 153C, a third portion 153F perpendicularly downwardly extending from a distal end of the second portion 153E, and having a semi-circular cut-out 153G at a distal end thereof, a fourth portion 153H extending backwardly (in the direction A in which the male coupler 110 is inserted) from a lower edge of the base wall 153A, a fifth portion 153I downwardly bending in U-shape from a distal end of the fourth portion 153H, and forwardly extending beyond the reinforcement 153C, a sixth portion 153J perpendicularly upwardly extending from a distal end of the fifth portion 153I, and having a semi-circular cut-out 153K at a distal end thereof, and a seventh portion 153M (see FIG. 25) extending along an outer wall of the fourth portion 153H from one of side edges (for instance, a left side edge) of the base wall 153A beyond the other side edge (for instance, a right side edge) of the base wall 153A.

The third portion 153F and the sixth portion 153J aligns at distal ends thereof with each other in front of the reinforcement 153C, and thus, the cut-out 153G of the third portion 153F and the cut-out 153K of the sixth portion 153J define an opening having an outer diameter allowing the annular groove 111 of the male coupler 110 to be fit thereinto.

The seventh portion 153M is formed at a rear end thereof with a connection ring 153P.

The seventh portion 153M is formed at upper and lower edges thereof with cut-outs 153N in alignment with the other side edge of the base wall 153A. An extension 153L extending from the other side edge of the base wall 153A is fit into the cut-outs 153N.

The coupler 400 in accordance with the fourth embodiment is used as follows.

First, the guide 153 is housed in the housing 135. Since the housing 135 is elastically deformable, the through-hole 131 is extendable, and hence, the guide 153 can be housed in the housing 135 through the through-hole 131. In a situation that the guide 153 is housed in the housing 135, the connection ring 153P of the guide 153 projects outwardly through the slit 136.

Figure 26:
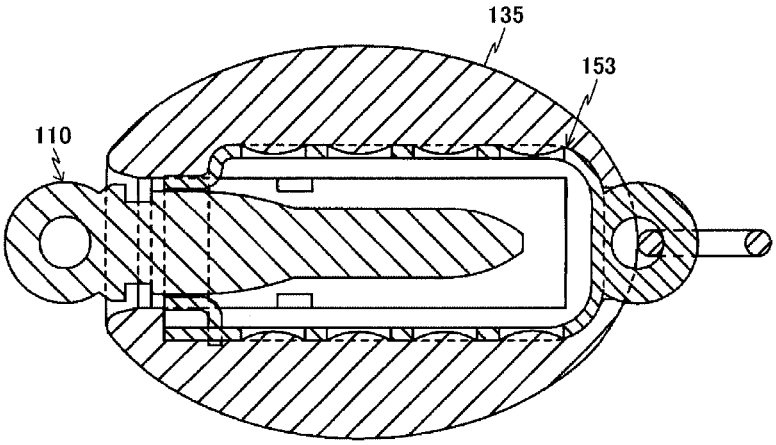
FIG. 26 is a plan view (a view seen from above) of the coupler in accordance with the fourth embodiment, showing that the male coupler is housed in the guide.
Figure 27:
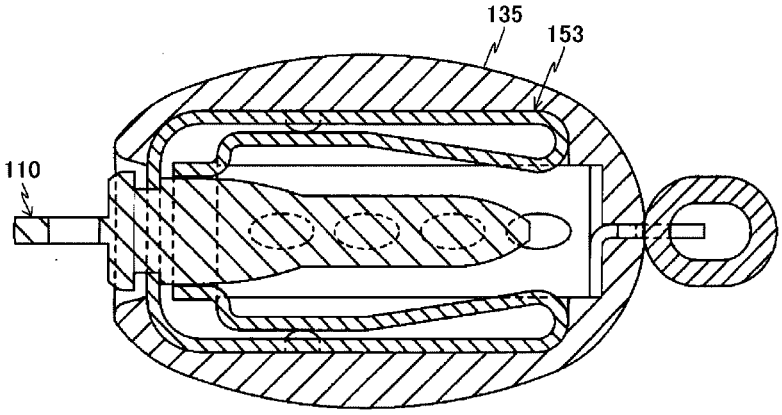
FIG. 27 is a side view (a view seen in a horizontal direction) of the coupler in accordance with the fourth embodiment, showing that the male coupler is housed in the guide.
Figure 28:
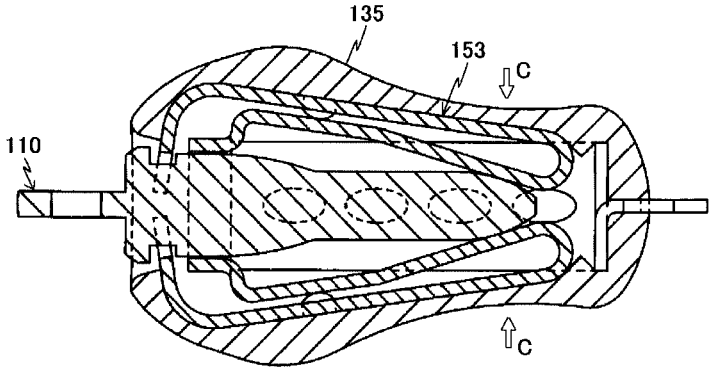
FIG. 28 is a side view (a view seen in a horizontal direction) of the coupler in accordance with the fourth embodiment, showing that the male coupler is taken out of the guide.

FIG. 26 is a plan view (a view seen from above) of the male coupler 110 housed in the housing 135, FIG. 27 is a side view (a view seen in a horizontal direction) of the male coupler 110 housed in the housing 135, and FIG. 28 is a side view (a view seen in a horizontal direction) of the male coupler 110 taken out of the guide 153.

Inserting the male coupler 110 into the opening defined by both the cut-out 153G of the third portion 153F and the cut-out 153K of the sixth portion 153J, the opening is spread upwardly and downwardly by the male coupler 110.

Further inserting the male coupler 110, when the groove 111 of the male coupler 110 arrives at a location where the groove 111 aligns with distal ends of the third portion 153F and the sixth portion 153J, the third portion 153F downwardly moves by virtue of the elastic forces of the first portion 153D and the second portion 153E to thereby fit into an upper area of the groove 111 of the male coupler 110, and further, the sixth portion 153J upwardly moves by virtue of the elastic forces of the fourth portion 153H and the fifth portion 153I to thereby fit into a lower area of the groove 111 of the male coupler 110. Thus, as illustrated in FIG. 27, the guide 153 is connected to the male coupler 110.

When the male coupler 110 is taken out of the guide 153, as illustrated in FIG. 28, the second portion 153E and the fifth portion 153I are pushed towards each other in the vicinity of the connection ring 153P. As a result, as illustrated in FIG. 28, the third portion 153F moves upwardly, and the sixth portion 153J moves downwardly, thereby the third portion 153F and the sixth portion 153J are disengaged from the groove 111 of the male coupler 110. Thus, the male coupler 110 can be pulled out of the guide 153.

As mentioned above, the coupler 400 in accordance with the fourth embodiment provides the same advantages as those provided by the coupler 100 in accordance with the first embodiment.

In the coupler 400 in accordance with the fourth embodiment, since the cut-out 153G formed at the third portion 153F and the cut-out 153K formed at the sixth portion 153J are designed to be engaged to the groove 111, and the housing 135 is composed of a deformable elastic material, the guide can be pushed through the housing. Accordingly, it is not necessary to rotate a plurality of body parts connected to one another, and the housing can be formed as one piece. It is possible to further reduce a number of parts of the coupler by employing the housing designed not to rotate and to be one piece.

As is obvious in light of the present embodiment as well as the other embodiments, a housing may be selected among various housings in the coupler in accordance with the present invention. It is a remarkable advantage particularly for ornaments including a coupler to be able to select an outer housing among various housings in accordance with a user's favorite.

In the guide 153 in the coupler 400 in accordance with the fourth embodiment, the two walls corresponding to the first wall 162 and the second wall 163 of the guide 150 in the first embodiment are designed to have a two-layered structure by bending a single plate. The two-layered structure ensures enhancement in both a strength and elastic force.

Furthermore, since the guide 153 can be readily housed in and taken out of the housing 135, the housing 135 can be readily exchanged to another one, ensuring enhancement in appearance of the coupler 400.

(Fifth Embodiment)

Figure 29:
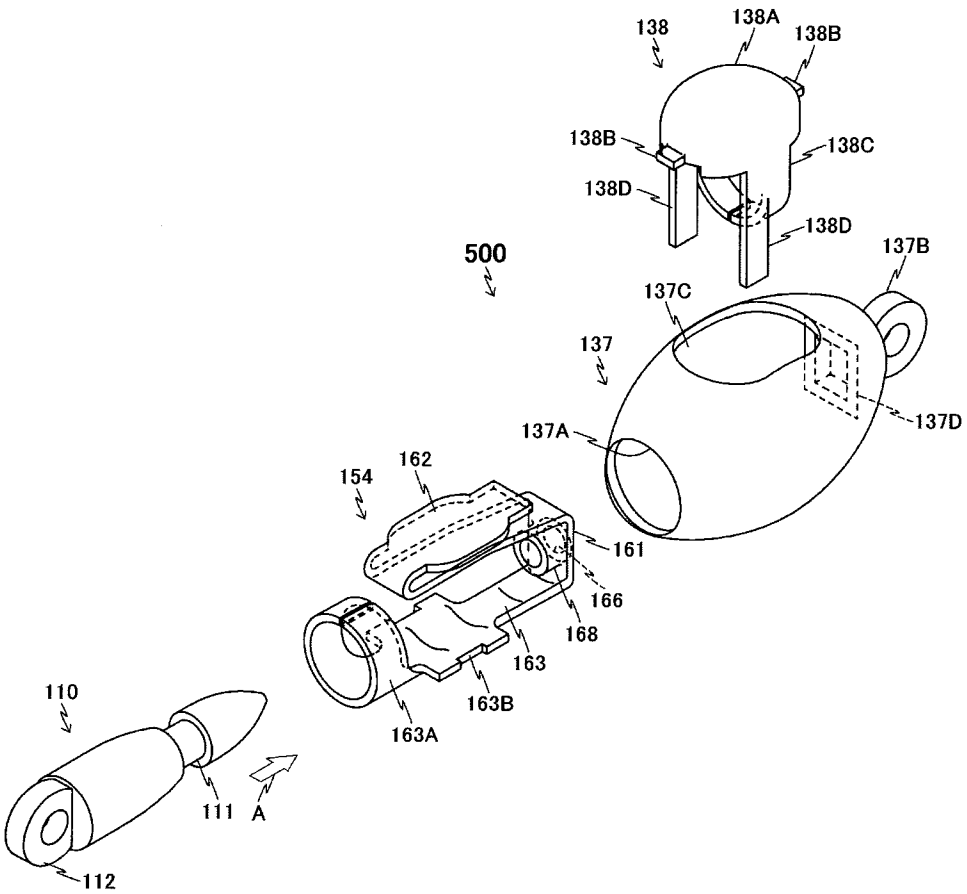
FIG. 29 is an exploded perspective view of a coupler in accordance with the fifth embodiment.
Figure 30:
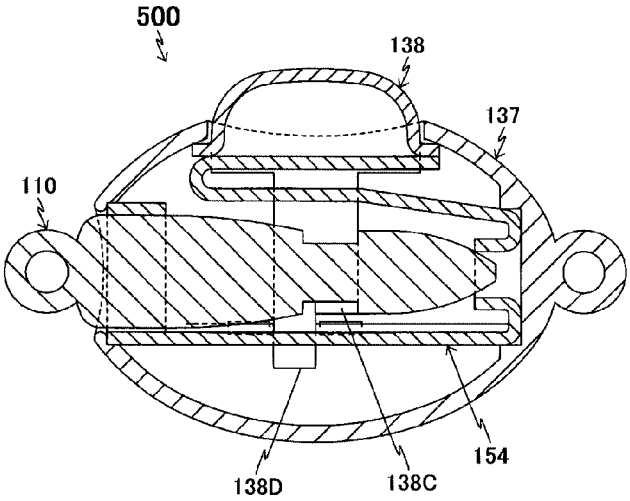
FIG. 30 is a longitudinal cross-sectional view of the coupler in accordance with the fifth embodiment.

FIG. 29 is an exploded perspective view of a coupler 500 in accordance with the fifth embodiment of the present invention, and FIG. 30 is a longitudinal cross-sectional view of the coupler 500.

As illustrated in FIG. 29, the coupler 500 in accordance with the fifth embodiment includes a male coupler 110, a guide 154, a housing 137, and a release button 138.

The guide 154 includes a base wall 161 formed centrally with a through-hole 166, a first wall 162 extending from an upper edge of the base wall 161 in a direction opposite to the direction A, and a second wall 163 extending from a lower edge of the base wall 161 in the same direction as a direction in which the first wall 162 extends.

The guide 154 is composed of an elastic material, and hence, the first wall 162 and the second wall 163 have such an elastic force that they go away from each other around the base wall 161.

The base wall 161 is formed along a peripheral edge of the through-hole 166 with a cylindrical reinforcement 168 extending in a direction opposite to the direction A.

The first wall 162 is upwardly folded at a distal end thereof towards the base wall 161 to thereby have a two-layered structure.

The second wall 163 has at a distal end thereof a cylindrical annular wall 163A through which the male coupler 110 can pass and which has an axis in the direction A. The annular wall 163A and the reinforcement 168 have a function of supporting the male coupler 110.

The housing 137 is in the form of a hollow egg, and is formed at one end thereof with a through-hole 137A, and at the other end with a connection ring 137B. The guide 154 is housed into the housing 137 through the through-hole 137.

The housing 137 is formed at an upper wall with an opening 137C. As illustrated in FIG. 30, the release button 138 projects outwardly through the opening 137C.

The housing 137 is formed at an inner wall thereof with a recess 137D in the neighborhood of the connection ring 137B. The recess 137D has a shape so as to allow the base wall 161 of the guide 154 to be fit thereinto.

The release button 138 includes a first portion 138A outwardly projecting through the opening 137C of the housing 137, a pair of engagement portions 138B outwardly extending in opposite directions from a lower edge of the first portion 138A, a pair of second portions 138C in the form of a quadrant, extending below the first portion 138A towards inside of the first portion 138A from a lower edge of the first portion 138A, and a third portion 138D in the form of a plate, vertically downwardly extending in the neighborhood of to the second portions 138C from a lower edge of the first portion 138A.

The second portions 138C make contact at distal ends thereof with each other centrally below the first portion 138A, and thus, the second portions 138C cooperate with each other to define a semi-circular arch. As mentioned later, the arch-shaped second portions 138C engage to a lower area of the annular groove 111 of the male coupler 110.

The pair of third portions 138D is engaged to a pair of recesses 163B formed at the second wall 163 of the guide 154, respectively, to thereby be fixed to the guide 154 in the housing 137.

As illustrated in FIG. 30, the pair of engagement portions 138B is engaged to an inner wall of the housing 137 to thereby cause the first portion 138A to be fixed in the housing 137. As illustrated in FIG. 30, in a situation that the release button 138 is housed in the housing 137, the first portion 138A is located on the first wall 162.

The coupler 500 in accordance with the fifth embodiment, having the above-mentioned structure, is used as follows.

Inserting the male coupler 110 into the housing 137, the male coupler 110 passes through the annular wall 163A of the guide 154. Pushing downwardly to lower the arch-shaped second portion 138C of the release button 138, the male coupler 110 goes forward in the guide 154 in the direction A. When the male coupler 110 reaches at a location where the annular groove 111 of the male coupler 110 vertically aligns with the arch-shaped second portion 138C, the arch-shaped second portion 138C is pushed upwardly by virtue of the elastic force of the first wall 162. Thus, the arch-shaped second portion 138C engages to a lower area of the annular groove 111 of the male coupler 110, and accordingly, the male coupler 110 is fixed to the guide 154 and accordingly the housing 137.

When the male coupler 110 is pulled out of the housing 137, the release button 138 is pushed down. When the release button 138 is pushed down, the arch-shaped second portion 138C moved downwardly, and thus, the second portion 138C and the annular groove 111 of the male coupler 110 are disengaged from each other. Keeping this condition (keeping the release button 138 pushed down), the male coupler 110 is pulled in a direction opposite to the direction A, and thus, the male coupler 110 can be taken out of the housing 137.

As mentioned above, the coupler 500 in accordance with the fifth embodiment provides the same advantages as those provided by the coupler 100 in accordance with the first embodiment. Though the coupler 500 in accordance with the fifth embodiment is designed to use the housing 137 in the form of a single piece, similarly to the coupler 400 in accordance with the fourth embodiment, the housing 137 in the fifth embodiment is not composed of an elastic material unlike the housing 135 in the coupler 400. Since the housing 137 has the opening 137C through which the release button 138 is exteriorly exposed, and the first portion 138A is on the first wall 162, the first wall 162 can be pushed by pushing the release button 138. Accordingly, even if the housing is not composed of an elastic material, the housing 137 can be formed as a single piece.

Furthermore, since the second portion 138C of the release button 138 is engaged to the groove 111, the guide 154 is not formed with a part to be engaged to the groove 111.

The structure of the coupler 500 in accordance with the fifth embodiment is not to be limited to the above-mentioned one, but may be varied in many ways.

Figure 31:
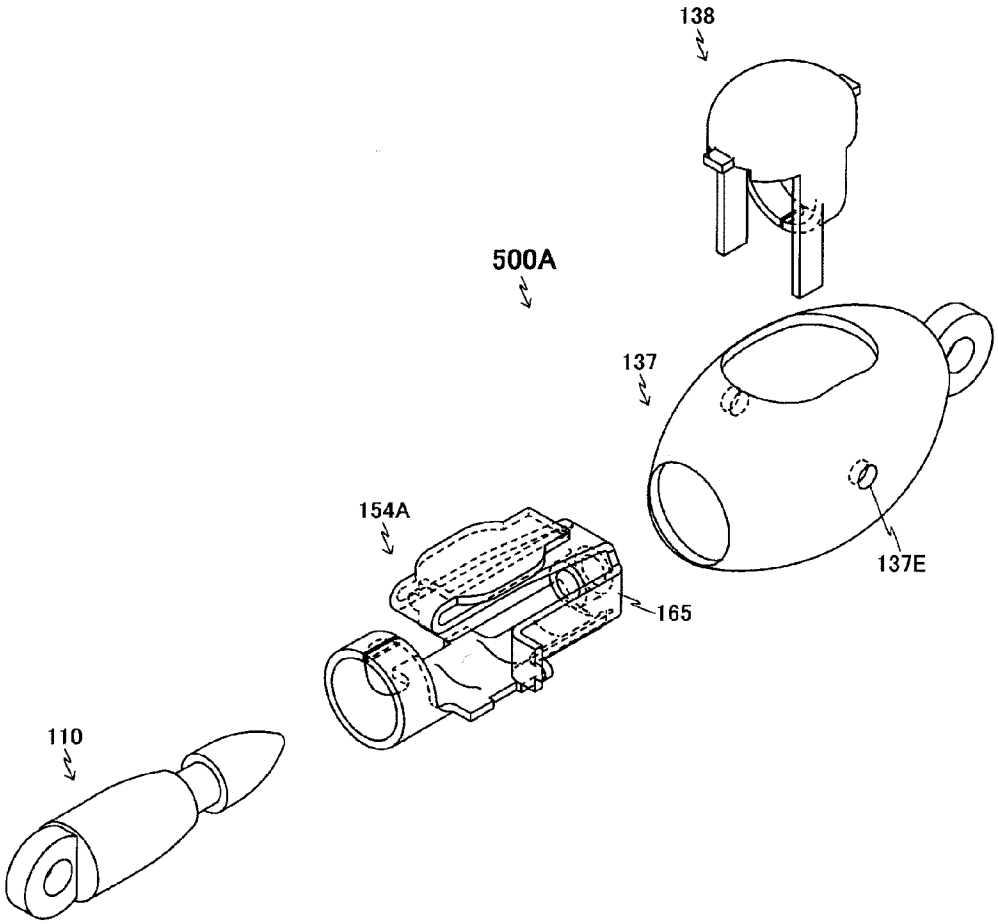
FIG. 31 is an exploded perspective view of a coupler in accordance with the variation of the fifth embodiment.
Figure 32:
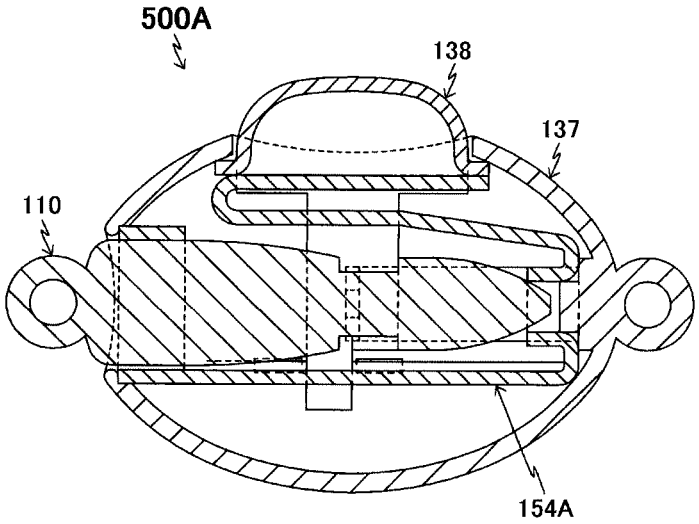
FIG. 32 is a longitudinal cross-sectional view of the coupler in accordance with the variation of the fifth embodiment, showing that the male coupler is inserted into the female coupler.
Figure 33:
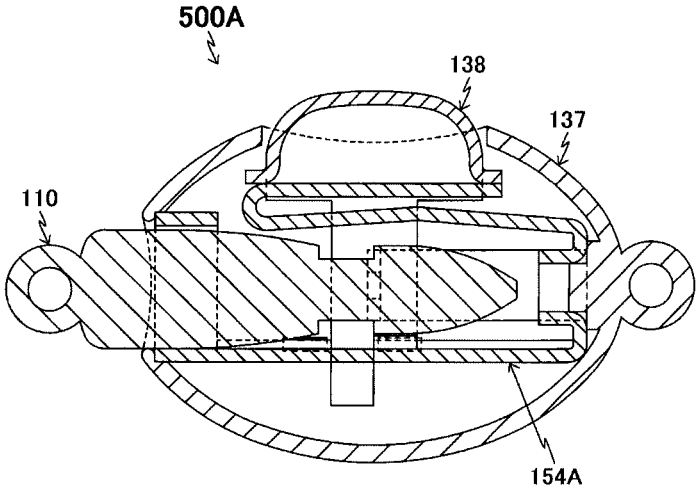
FIG. 33 is a longitudinal cross-sectional view of the coupler in accordance with the variation of the fifth embodiment, showing that the male coupler is taken out of the female coupler.

FIG. 31 is an exploded perspective view of a coupler 500A in accordance with the variation of the fifth embodiment, FIG. 32 is a longitudinal cross-sectional view of the coupler 500A, showing that the male coupler 110 is inserted into the female coupler 120, and FIG. 33 is a longitudinal cross-sectional view showing that the male coupler 110 is taken out of the female coupler 120.

As illustrated in FIG. 31, the guide 154A in the variation is designed to include walls similar to the third wall 164 and the fourth wall 165 of the guide 150 in the first embodiment. Since the guide 154A includes the third wall 164 and the fourth wall 165, the housing 137 has, in place of the recess 137D, through-holes 137E to which the third wall 164 and the fourth wall 165 are engaged.

The guide 154 of the variation can be more stably positioned than the fifth embodiment in which the guide 154 is positioned in the housing 137 by fitting the base wall 161 of the guide 154 into the recess 137D (see FIG. 29) of the housing 137, since the guide 154A is positioned in the housing 137 by means of the third wall 164 and the fourth wall 165.

(Sixth Embodiment)

Figure 34:
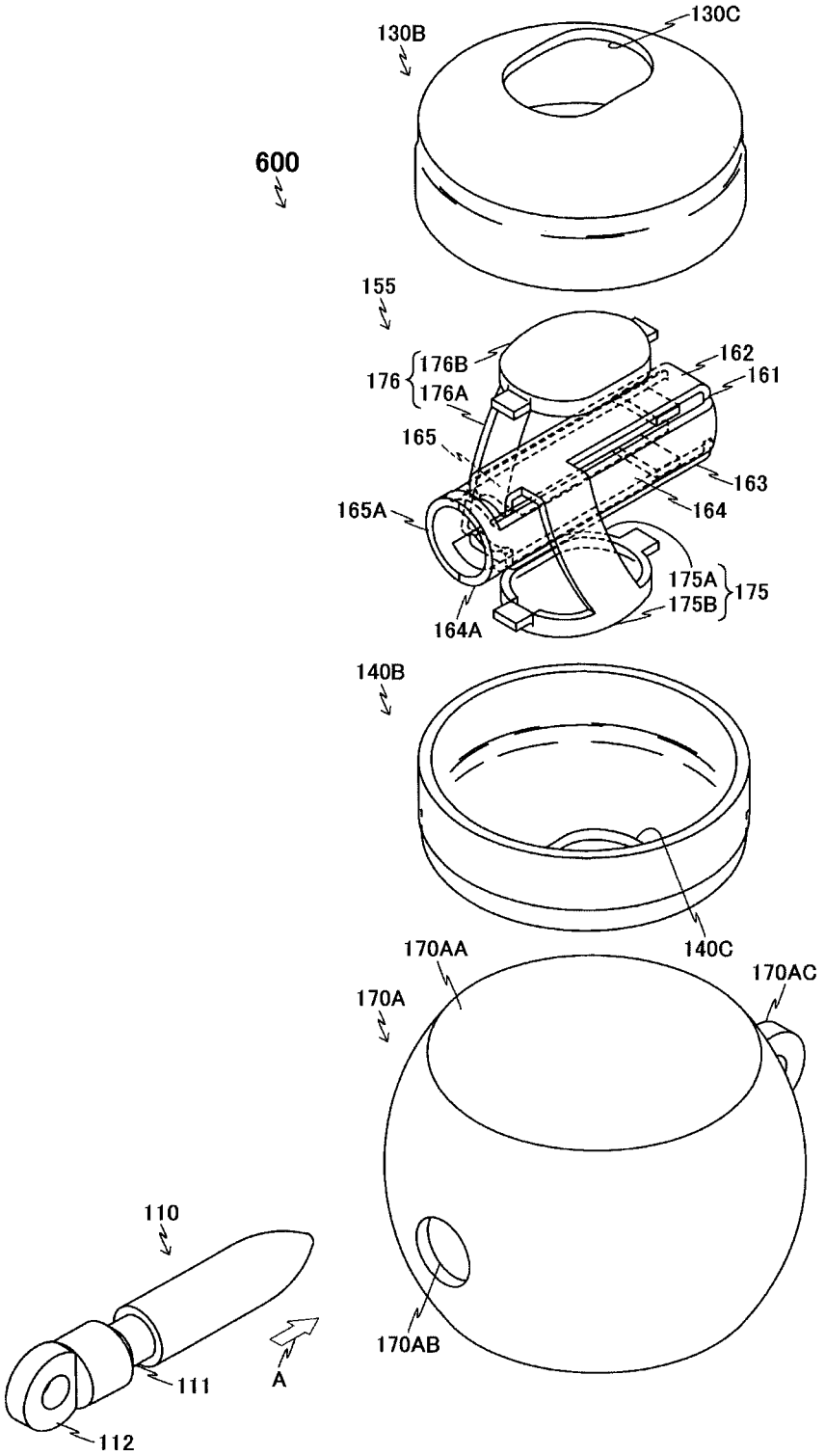
FIG. 34 is an exploded perspective view of a coupler in accordance with the sixth embodiment.
Figure 35:
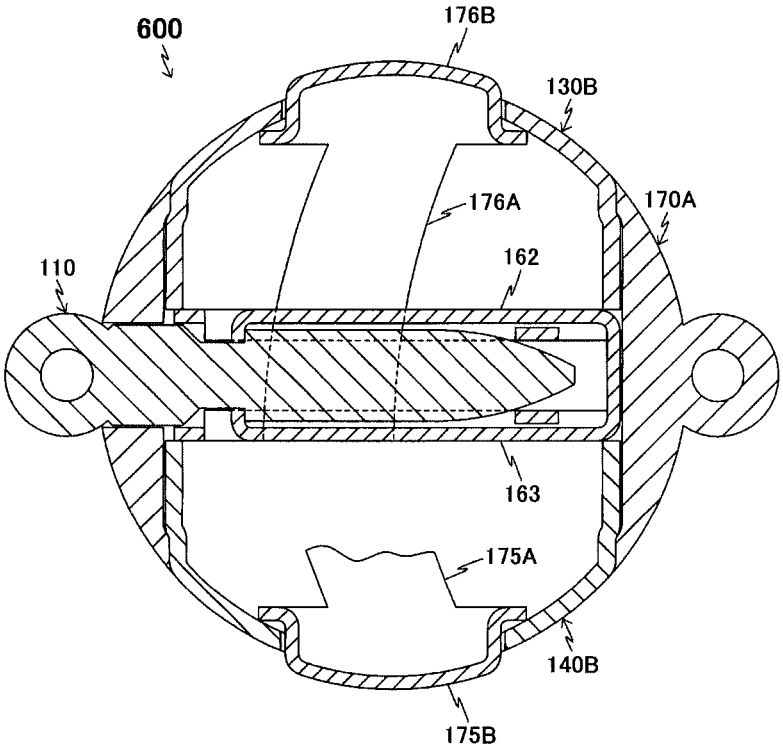
FIG. 35 is a longitudinal cross-sectional view of the coupler in accordance with the sixth embodiment, showing that the male coupler is inserted into the female coupler.
Figure 36:
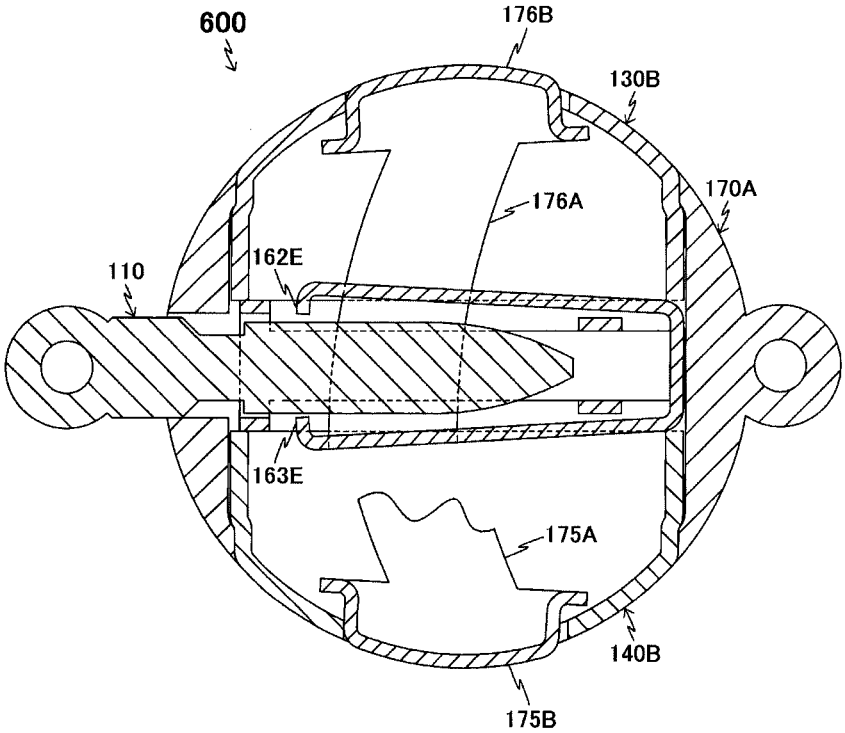
FIG. 36 is a longitudinal cross-sectional view of the coupler in accordance with the sixth embodiment, showing that the male coupler is taken out of the female coupler.

FIG. 34 is an exploded perspective view of a coupler 600 in accordance with the sixth embodiment, FIG. 35 is a longitudinal cross-sectional view showing that the male coupler 110 is inserted into the female coupler 120, and FIG. 36 is a longitudinal cross-sectional view showing that the male coupler 110 is taken out of the female coupler 120.

As illustrated in FIG. 34, the coupler 600 in accordance with the sixth embodiment includes a male coupler 110 and a female coupler 120. The female coupler 120 includes a guide 155, a first body part 130B, a second body part 140B, and an outer cover 170.

The first body part 130B is open downwardly, convex upwardly, and is in the form of a dome. The first body part 130B is formed at an upper wall thereof with an oval opening 130C.

The second body part 140B is open upwardly, convex downwardly, and is in the form of a dome. The first body part 130B is formed at a bottom thereof with an oval opening 140C.

The outer cover 170 is formed vertically with a through-hole 170AA. As illustrated in FIGS. 35 and 36, the first body part 130B and the second body part 140B can be fit into the through-hole 170AA. The guide 155 is housed in the through-hole 170AA of the outer cover 170 in such a condition as being sandwiched between the first body part 130B and the second body part 140B.

The outer cover 170 is formed at an outer surface thereof with a through-hole 170AB through which the male coupler 110 can pass, and further with a connection ring 170AC at the opposite side.

The guide 155 includes a base wall 161, a first wall 162 extending from an upper edge of the base wall 161 in a direction opposite to the direction A in which the male coupler 110 is inserted into the female coupler 120, a second wall 163 extending from a lower edge of the base wall 161 in the same direction as a direction in which the first wall 162 extends, a third wall 164 extending from a left side edge of the base wall 161 in the same direction as a direction in which the first wall 162 extends, a first extension 175, and a second extension 176.

The first wall 162 is bent at a distal end 162E thereof towards the second wall 163. Similarly, the second wall 163 is bent at a distal end 163E thereof towards the first wall 162 (see FIGS. 35 and 36).

The first wall 162 and the second wall 163 have such an elastic force that they move toward each other around the base wall 161. That is, the distal end 162E of the first wall 162 and the distal end 163E of the second wall 163 are forced to move towards each other.

The third wall 164 and the fourth wall 165 are longer than the first wall 162 and the second wall 163, and have at distal ends thereof a first support 164A and a second support 165A, each of which is semi-circular. The first support 164A and the second support 165A make contact with each other ahead of the first wall 162 and the second wall 613 to thereby define an annular ring having a central axis extending in the direction A.

The first extension 175 includes a first portion 175A extending around the third wall 164 from a left side edge of the first wall 162 beyond the second wall 163, and an ellipse second portion 175B connected to a lower end of the first portion 175A, and spreading in parallel with both the first wall 162 and the second wall 163.

The second extension 176 includes a first portion 176A extending around the fourth wall 165 from a right side edge of the second wall 163 beyond the first wall 162, and an ellipse second portion 176B connected to an upper end of the first portion 176A, and spreading in parallel with both the first wall 162 and the second wall 163.

As illustrated in FIGS. 35 and 36, the guide 155 is sandwiched between the first body part 130B and the second body part 140B while being fit into the through-hole 170AA of the outer cover 170A. Furthermore, the guide 155 is fit into the through-hole 170AA of the outer cover 170A such that the second portion 176B of the second extension 176 is exposed at an upper wall thereof through the opening 130C of the first body part 130B and the second portion 175B of the first extension 175 is exposed at an upper wall thereof through the opening 140C of the second body part 140B.

The coupler 600 in accordance with the sixth embodiment, having the above-mentioned structure, is used as follows.

As illustrated in FIG. 35, inserting the male coupler 110 through the through-hole 170AB of the outer cover 170A into the guide 155 housed in the outer cover 170A, the male coupler 110 goes in the direction A, being supported by a ring defined by the first support 164A and the second support 165A. While the male coupler 110 is going in the guide 155, the male coupler 110 makes contact at an outer surface thereof with the distal end 162E of the first wall 162 and the distal end 163E of the second wall 163 to thereby push the first wall 162 up and push the second wall 163 down.

When the male coupler 110 further goes in the direction A, and arrives at a location where the annular groove 111 of the male coupler 110 vertically aligns with the distal end 162E of the first wall 162 and the distal end 163E of the second wall 163, the distal end 162E of the first wall 162 moves downwardly by virtue of the elastic force of the first wall 162 to thereby engage an upper area of the annular groove 111, and further, the distal end 163E of the second wall 163 moves upwardly by virtue of the elastic force of the second wall 163 to thereby engage a lower area of the annular groove 111. FIG. 35 illustrates this condition. Thus, the male coupler 110 is fixed in the guide 155 and accordingly in the female coupler 120.

When the male coupler 110 is taken out of the female coupler 120, the second portion 175B of the first extension 175 is pushed upwardly and the second portion 176B of the second extension 176 is pushed downwardly. Thus, as illustrated in FIG. 36, the first wall 162 and the second wall 163 move away from each other, and hence, the distal end 162E of the first wall 162 moves upwardly and the distal end 163E of the second wall 163 moves downwardly. As a result, the distal end 162E of the first wall 162 and the distal end 163E of the second wall 163 are disengaged from the annular groove 111 of the male coupler 110, and hence, the male coupler 110 can be taken out of the female coupler 120 by pulling the male coupler 110 in a direction opposite to the direction A.

As mentioned above, the coupler 600 in accordance with the sixth embodiment provides the same advantages as those provided by the coupler 100 in accordance with the first embodiment.

The structure of the coupler 600 in accordance with the sixth embodiment is not to be limited to the above-mentioned one, but may be varied in many ways.

In the coupler 600 in accordance with the sixth embodiment, the distal end 162E of the first wall 162 and the distal end 163E of the second wall 163 are designed to engage to the annular groove 111 of the male coupler 110. As an alternative, in place of designing the distal end 162E of the first wall 162 and the distal end 163E of the second wall 163 to engage to the annular groove 111, the first wall 162 and the second wall 163 may have a projection at a location other than the distal end, in which case, the projection is engaged to the annular groove 111.

(Seventh Embodiment)

Figure 37:
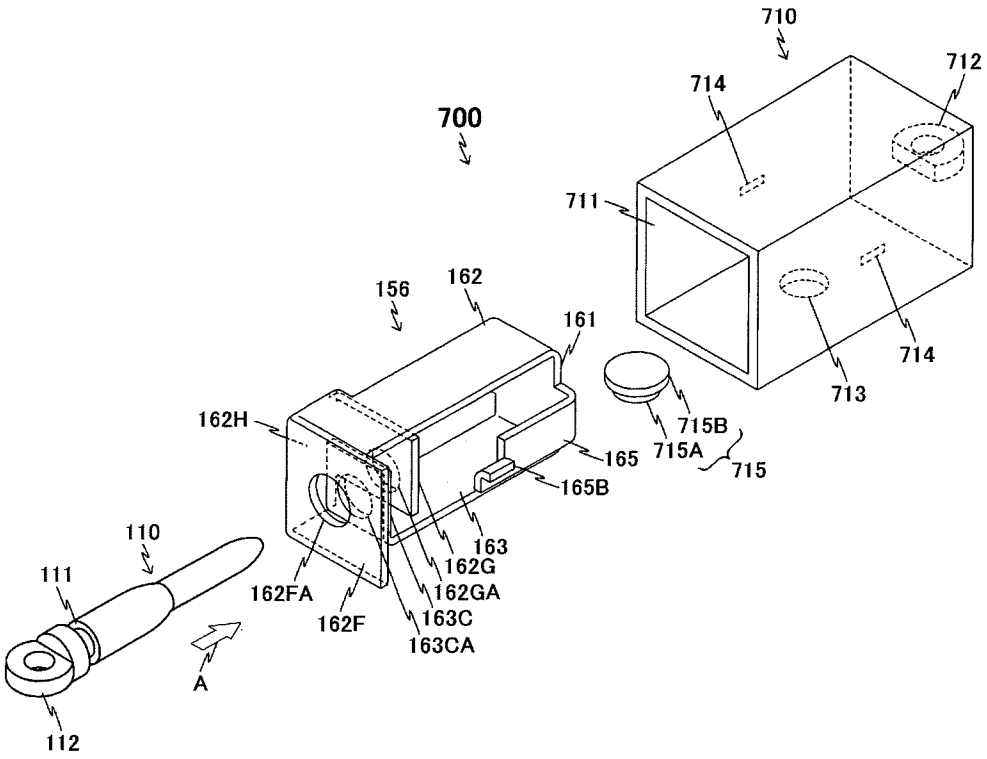
FIG. 37 is an exploded perspective view of a coupler in accordance with the seventh embodiment.
Figure 38:
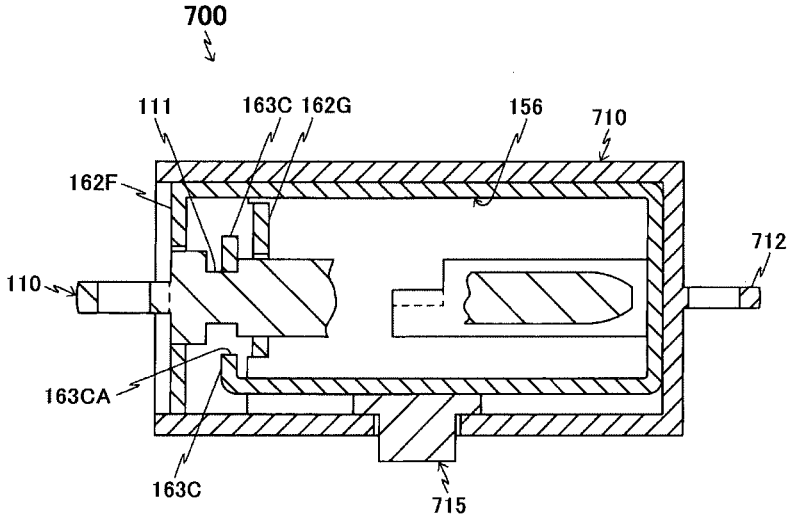
FIG. 38 is a longitudinal cross-sectional view of the coupler in accordance with a variation of the seventh embodiment, showing that the male coupler is inserted into the female coupler.

FIG. 37 is an exploded perspective view of a coupler 700 in accordance with the seventh embodiment, and FIG. 38 is a longitudinal cross-sectional view of the coupler 700, showing that the male coupler 110 is inserted into the female coupler 120.

The coupler 700 in accordance with the seventh embodiment includes a male coupler 110 and a female coupler 120. The female coupler 120 includes a first body part 710, a guide 156, and a push button 715.

The first body part 710 is in the form of a rectangular parallelepiped, and defines therein a space in which the guide 156 can be housed.

The first body part 710 is open at one of faces 711, and includes a connection ring 712 at a face opposite to the open face 711.

The first body part 710 is formed at a bottom with a circular through-hole 713, and at both left and right side walls with a rectangular slit 714.

The guide 156 includes a substantially square base wall 161, a first wall 162 extending from an upper edge of the base wall 161 in a direction opposite to the direction A, a second wall 163 extending from a lower edge of the base wall 161 in parallel with the first wall 162, a third wall 164 (not illustrated in FIG. 37) extending from a right side edge of the base wall 166 in a direction opposite to the direction A, and a fourth wall 165 extending from a left side edge of the base wall 166 in parallel with the third wall 164.

The guide 156 is housed in the first body part 710, and supports the male coupler 110 when the male coupler 110 is inserted into the first body part 710.

The guide 156 is composed of a material having elasticity. Accordingly, the first wall 162, the second wall 163, the third wall 164 and the fourth wall 165 can act as a spring around the base wall 161. Specifically, the first wall 162 and the second wall 163 have elastic forces causing the first wall 162 and the second wall 163 to move away from each other around the base wall 161. Similarly, the third wall 164 and the fourth wall 165 have elastic forces causing the third wall 164 and the fourth wall 165 to move away from each other around the base wall 161.

The first wall 162 includes a vertical portion 162H downwardly extending from a right side edge thereof. A first side 162F and a second side 162G extend from side edges (vertical edges) of the vertical portion 162H in a direction perpendicular to the direction A. The first side 162F is located ahead of a distal end of the second wall 163, and the second side 162G is located on the second wall 163.

The first side 162F is formed with a through-hole 162FA through which the male coupler 110 can pass, and the second side 162G is formed with a through-hole 162GA through which the male coupler 110 can pass.

The first side 162F has a size so as to cover the open face 711 of the first body part 710 therewith when the guide 156 is housed in the first body part 710. That is, the first side 162F acts as a cover to the open face 711 of the first body part 710.

An extension 163C is formed as a lock, and is formed to extend upwardly (towards the first wall 162) from a distal end of the second wall 163.

The extension 163C is formed centrally with a through-hole 163CA through which the male coupler 110 can pass. The male coupler 110 can simultaneously pass the through-hole 162FA, the through-hole 162GA, and the through-hole 163CA.

Each of the third wall 164 and the fourth wall 165 is partially bent at a distal end thereof to thereby define an outwardly projection convex 164B and 165B (only the convex 165B is illustrated in FIG. 37). The convexes 164B and 165B have a shape allowing the convexes 164B and 165B to be fit into the slits 714 of the first body part 710.

When the guide 156 is inserted into the first body part 710, the convexes 164B and 165B are fit into the slits 714 of the first body part 710 to thereby cause the guide 156 to be positioned and housed in the first body part 710.

The push button 715 includes a cylindrical first portion 715A fittable into the through-hole 713 of the first body part 710, and a cylindrical second portion 715B having a diameter greater than the same of the through-hole 713.

The coupler 700 in accordance with the seventh embodiment, having the above-mentioned structure, is assembled as follows.

First, the first portion 715A of the push button 740 is fit into the through-hole 713 of the first body part 710.

Then, the guide 156 is inserted into the first body part 710, and the convex 164B of the third wall 164 and the convex 165B of the fourth wall 165 are fit into the slits 714. Thus, the guide 156 is positioned and fixed in the first body part 710.

The push button 715 is sandwiched between the second wall 163 of the guide 156 and an inner wall of the first body part 710.

As mentioned earlier, since the first wall 162 and the second wall 163 act as a spring around the base wall 161, in a condition that the guide 156 is inserted into the first body part 710, as illustrated in FIG. 38, the second wall 163 keeps the push button 740 pushed outwardly.

The coupler 700 in accordance with the seventh embodiment is assembled in the above-mentioned manner.

The thus assembled coupler 700 in accordance with the seventh embodiment is used as follows.

The male coupler 110 pass the through-hole 162FA of the first side 162F, the through-hole 163CA of the extension 163C, and the through-hole 162GA of the second side 162G in this order, and thus, is inserted into the guide 156.

In the guide 156, the male coupler 110 is supported by the through-hole 162FA of the first side 162F and the through-hole 162GA of the second side 162G.

The through-hole 163CA of the extension 163C is engaged to the annular groove 111 of the male coupler 110, and hence, the male coupler 110 is fixed in the guide 156.

When the male coupler 110 is taken out of the guide 156, the push button 740 is pushed inwardly of the first body part 710.

Thus, the second wall 163 of the guide 156 moves towards the first wall 162 (towards upside of FIG. 38).

The extension 163C also moves upwardly, and hence, the through-hole 163CA moves upwardly, resulting in that the extension 163C is released from the annular groove 111 of the male coupler 110.

As mentioned above, since the male coupler 110 and the guide 156 are disengaged from each other by pushing the push button 715, the male coupler 110 can be pulled out of the guide 156.

After the male coupler 110 was pulled out, by stopping pushing the push button 715 (specifically, releasing a user's fingers from the push button 715), the second wall 163 of the guide 156 returns to an initial position (the position illustrated in FIG. 38) by virtue of the elastic force thereof.

If the coupler is designed to be able to disengage the male coupler and the guide by pushing only either one of the first or second walls, like the coupler 700 in accordance with the seventh embodiment, only the wall to, be pushed (the second wall 163 in the 700 in accordance with the seventh embodiment) may be designed to have an elastic force.

As mentioned above, the coupler 700 in accordance with the seventh embodiment provides the same advantages as those provided by the coupler 100 in accordance with the first embodiment.

The structure of the coupler 700 in accordance with the seventh embodiment is not to be limited to the above-mentioned one, but may be varied in many ways.

Though the first body part 710 is in the form of a substantially rectangular parallelepiped in the coupler 700 in accordance with the seventh embodiment, the first body part 710 may be designed to have another shape such as a cylinder, in which case, the guide 156 may be designed to have another shape as a whole in accordance with a shape of the first body part 710.

Though the coupler 700 in accordance with the seventh embodiment is designed to include the push button 715, the coupler 700 may be designed not to include the push button 715, if necessary. Specifically, if it is possible to directly push the second wall 163 of the guide 156 through the through-hole 713 of the first body part 710, since the guide 156 and the male coupler 110 can be disengaged from each other, the push button 715 may be omitted.

It is not always necessary to form the first side 162F and the second side 162G through the vertical portion 162H. They may be formed to downwardly extend from the first wall 162. For instance, the first side 162F and the second side 162G may be welded to a lower surface of the first wall 162. However, it should be noted that the first side 162F and the second side 162G can be formed by pressing a single plate, if the guide 156 had the vertical portion 162H.

The third wall 164 and the fourth wall 165 may be omitted, if necessary, in which case, the coupler may include another means for stably positioning the guide 156 in the first body part 710, such as designing the first body part 710 to have an internal size almost equal to an external size of the guide 156.

(Eighth Embodiment)

Figure 39:
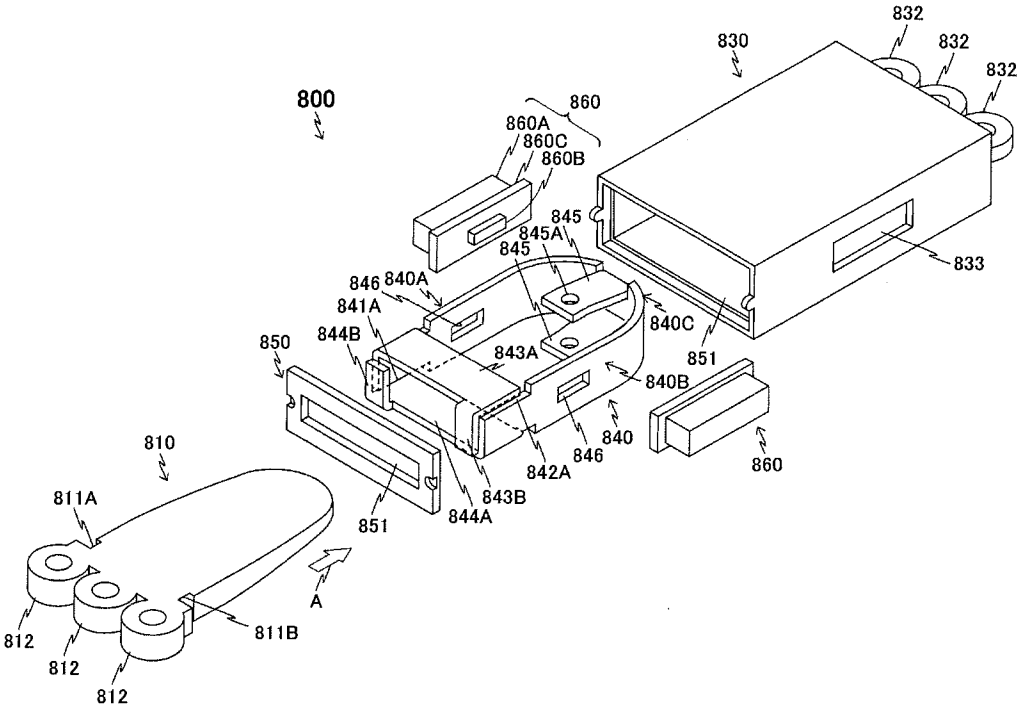
FIG. 39 is an exploded perspective view of a coupler in accordance with the eighth embodiment.
Figure 40:
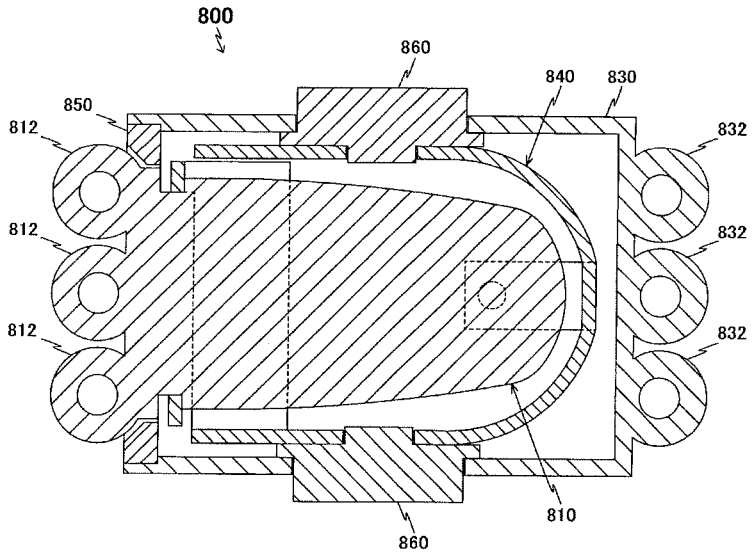
FIG. 40 is a longitudinal cross-sectional view of the coupler in accordance with a variation of the eighth embodiment, showing that the male coupler is inserted into the female coupler.

FIG. 39 is an exploded perspective view of a coupler 800 in accordance with the eighth embodiment, and FIG. 40 is a longitudinal cross-sectional view showing that the male coupler 110 is inserted into the female coupler 120.

As illustrated in FIG. 39, the coupler 800 in accordance with the eighth embodiment includes a male coupler 810, and a female coupler 820 into which the male coupler 810 can be inserted and out of which the male coupler 810 can be pulled.

The male coupler 810 is comprised of a substantially U-shaped plate, and becomes smaller in a thickness in the direction A in which the male coupler 810 is inserted into the female coupler 820. The male coupler 810 is thinnest at a distal end thereof.

The male coupler 810 is formed at a proximal end thereof with three connection rings 812.

The male coupler 810 is formed at side edges in a direction perpendicular to the direction A with a pair of grooves 811A and 811B in the neighborhood of the connection rings 812.

As illustrated in FIG. 39, the female coupler 820 includes a housing 830, a guide 840, a plate 850, and a pair of push buttons 860.

The housing 830 is in the form of a rectangular parallelepiped, and defined a space in which both the male coupler 810 and the guide 840 can be housed.

The housing 830 has six faces, one of which is an open face 831.

The housing 830 is formed at a face located opposite to the open face 831 with three connection rings 832.

The housing 830 has rectangular openings 833 at sidewalls extending in parallel with the direction A.

The plate 850 is detachably attached to the open face 831 of the housing 830. The plate 850 has a rectangular opening 851 through which the male coupler 810 can pass.

The guide 840 is U-shaped as a whole, and includes a first portion 840A extending in the direction A, a second portion 840B facing the first portion 840A and extending in parallel with the first portion 840A, and an arcuate third portion 840C connecting an end of the first portion 840A to an end of the second portion 840B.

The guide 840 is composed of a material having elasticity. Thus, the first portion 840A and the second portion 840B can act as a spring around the third portion 840C. Specifically, the first portion 840A and the second portion 840B have elastic forces which cause the first portion 840A and the second portion 840B move away from each other around the third portion 840C.

The guide 840 has a size to be housed in the housing 830. The guide 840 is inserted into the housing 830 through the open face 831. After the guide 840 was housed in the housing 830, the plate 850 is attached to the open face 831 of the housing 830.

As illustrated in FIG. 39, the first portion 840A of the guide 840 has a first extension 843.

The first extension 843 includes a horizontal portion 843A extending towards the second portion 840B from an upper edge of the first portion 840A, but not reaching at the second portion 840B, and a vertical portion 843B extending downwardly from a front side edge of the horizontal portion 843A. As mentioned later, the vertical portion 843B is engaged to the groove 811B from above, when the male coupler 810 is inserted into the guide 840.

As illustrated in FIG. 39, the second portion 840B is formed at an upper edge thereof with a cut-out 842A on an extension line of the horizontal portion 843A of the first extension 843. Thus, when the horizontal portion 843A moves in a direction perpendicular to the direction A, the horizontal portion 843A does not interfere with the second portion 840B.

The vertical portion 843B is located ahead of a distal end of the second portion 840B. Thus, when the horizontal portion 843A moves in a direction perpendicular to the direction A, the vertical portion 843B does not interfere with the second portion 840B.

As illustrated in FIG. 39, the second portion 840B of the guide 840 has a second extension 844.

The second extension 844 includes a horizontal portion 844A extending towards the first portion 840A from a lower edge of the second portion 840B, but not reaching at the first portion 840A, and a vertical portion 844B extending upwardly from a front side edge of the horizontal portion 844A. As mentioned later, the vertical portion 844B is engaged to the groove 811A from below, when the male coupler 810 is inserted into the guide 840.

As illustrated in FIG. 39, the first portion 840A is formed at a lower edge thereof with a cut-out 841A on an extension line of the horizontal portion 844A of the second extension 844. Thus, when the horizontal portion 844A moves in a direction perpendicular to the direction A, the horizontal portion 844A does not interfere with the first portion 840A.

The vertical portion 844B is located ahead of a distal end of the first portion 840A. Thus, when the horizontal portion 844A moves in a direction perpendicular to the direction A, the vertical portion 844B does not interfere with the first portion 840A.

A pair of supports 845 forwardly extends in parallel with each other from upper and lower edges of the third portion 840C of the guide 840. The supports 845 support a distal end of the male coupler 810 from above and below when the male coupler 810 is inserted into the guide 840.

Each of the supports 845 has a through-hole 845A. The housing 830 is formed at inner walls thereof with projections (not illustrated) fitting into the through-holes 845A. The supports 845 are positioned in the housing 830 by fitting the projections into the through-holes 845A.

As illustrated in FIG. 39, the first portion 840A and the second portion 840B are formed with rectangular openings 846 at the same location.

The push button 860 includes a first block portion 860A fittable into the opening 833 of the housing 830, and projecting outwardly of the housing 830 through the opening 833 (see FIG. 40) when fit into the opening 833, a second block portion 860B fittable into the opening 840 of the first portion 840A or the second portion 840B (see FIG. 40), and a third block portion 860C sandwiched between the first block portion 860A and the second block portion 860B, and having a size bigger than both a size of the opening 833 of the housing 830 and a size of the opening 846 of the guide 840 (see FIG. 40).

As illustrated in FIG. 40, when both the guide 840 and the push button 860 are housed in the housing 830, the third block portion 860C is sandwiched between the housing 830 and the guide 840, the first block portion 860A is fit into the opening 833 of the housing 830 and projects outwardly through the opening 833, and the second block portion 860B is fit into the opening 846 of the guide 840.

By inwardly pushing the first block portion 860A projecting through the opening 833 of the housing 830, the first portion 840A and the second portion 840B of the guide 840 can be pushed from outside of the housing 830.

As mentioned earlier, the first portion 840A and the second portion 840B of the guide 840 have elastic forces causing the first portion 840A and the second portion 840B to move away from each other around the third portion 840C. As illustrated in FIG. 40, since the guide 840 is housed in the housing 830, with the push buttons 860 sandwiched between the housing 830 and each of the first portion 840A and the second portion 840B, the first portion 840A and the second portion 840B are kept pushed by the push buttons 860 so as to cause the first portion 840A and the second portion 840B to move towards each other.

The coupler 800 in accordance with the eighth embodiment, having the above-mentioned structure, is assembled as follows.

Firstly, the push buttons 860 are put into the housing 830, and the first block portions 860A are fit into the openings 833 of the housing 830.

Then, keeping the first portion 840A and the second portion 840B of the guide 840 pushed with a user's fingers towards each other, the guide 840 is brought into the housing 830, and the second block portions 860B of the push button 860 are fit into the openings 846 of the first and second portions 840A and 840B. Then, the projections formed at inner walls of the housing 830 are inserted into the through-holes 845A of the supports 845.

Thus, the guide 840 is positioned in the housing 830.

Then, the plate 850 is attached to the open face 831 of the housing 830.

Thus, the coupler 800 in accordance with the eighth embodiment has been assembled.

The thus assembled coupler 800 in accordance with the eighth embodiment is used as follows.

Inserting the male coupler 810 through the opening 851 of the plate 850 into the guide 840 housed in the housing 830, the male coupler 810 makes contact with both the vertical portion 843B of the first extension 843 and the vertical portion 844B of the second extension 844, and goes forwardly into the guide 840, outwardly pushing both the vertical portion 843B of the first extension 843 and the vertical portion 844B of the second extension 844.

When the grooves 812A and 812B of the male coupler 810 reaches the vertical portions 844B and 843B, respectively, the vertical portions 844B and 843B pushed outwardly by the male coupler 810 rebound by virtue of the elastic forces of the guide 840 to thereby engage with the grooves 812A and 812B of the male coupler 810.

Thus, the male coupler 810 is fixed in the housing 840. In this situation, as illustrated in FIG. 39, the male coupler 810 is vertically sandwiched at a distal end thereof between the supports 845.

When the male coupler 810 is taken out of the guide 840, the first block portions 860A of the push buttons 860 are pushed towards inside of the housing 830.

Thus, the first and second portions 840A and 840B of the guide 840 are deformed towards each other around the third portion 840C.

Since the vertical portion 843B of the first extension 843 outwardly moves, the vertical portion 843B is released out of the groove 811B of the male coupler 810, and accordingly, the first extension 843 is disengaged from the groove 811B. Similarly, since the vertical portion 844B of the second extension 844 outwardly moves, the vertical portion 844B is released out of the groove 811A of the male coupler 810, and accordingly, the second extension 844 is disengaged from the groove 811A.

As mentioned above, since the male coupler 810 can be disengaged from the guide 840 by pushing the first block portions 860A of the push buttons 860, the male coupler 810 can be pulled out of the guide 840.

After the male coupler 810 was pulled out, by stopping pushing the first block portions 860A of the push buttons 860 (specifically, releasing a user's fingers from the first block portions 860A), the first portion 840A and the second portion 840B of the guide 840 return to an initial position (the position illustrated in FIG. 40) by virtue of the elastic force of the guide 840.

As mentioned above, the coupler 800 in accordance with the eighth embodiment provides the same advantages as those provided by the coupler 100 in accordance with the first embodiment.

The structure of the coupler 800 in accordance with the eighth embodiment is not to be limited to the above-mentioned one, but may be varied in many ways.

The housing 830 in the coupler 800 in accordance with the eighth embodiment is designed to be parallelepiped, but may be designed to have any shape if it can house the guide 840 therein.

The coupler 800 in accordance with the eighth embodiment is designed to include the vertical portions 843B and 844B, and the grooves 811A and 811B, but may be designed to include only the vertical portion 843B and the groove 811B or the vertical portion 844B and the groove 811A.

The guide 840 in the eighth embodiment is designed to include the supports 845, but may be designed not to include the same, if necessary.

The coupler 800 in accordance with the eighth embodiment is designed to include the pair of push buttons 860, but may be designed not to include the same, if the first and second portions 840A and 840B of the guide 840 can be pushed exteriorly of the housing 830.

The guide 840 may be formed integral with the push buttons 860.

(Ninth Embodiment)

Figure 41:
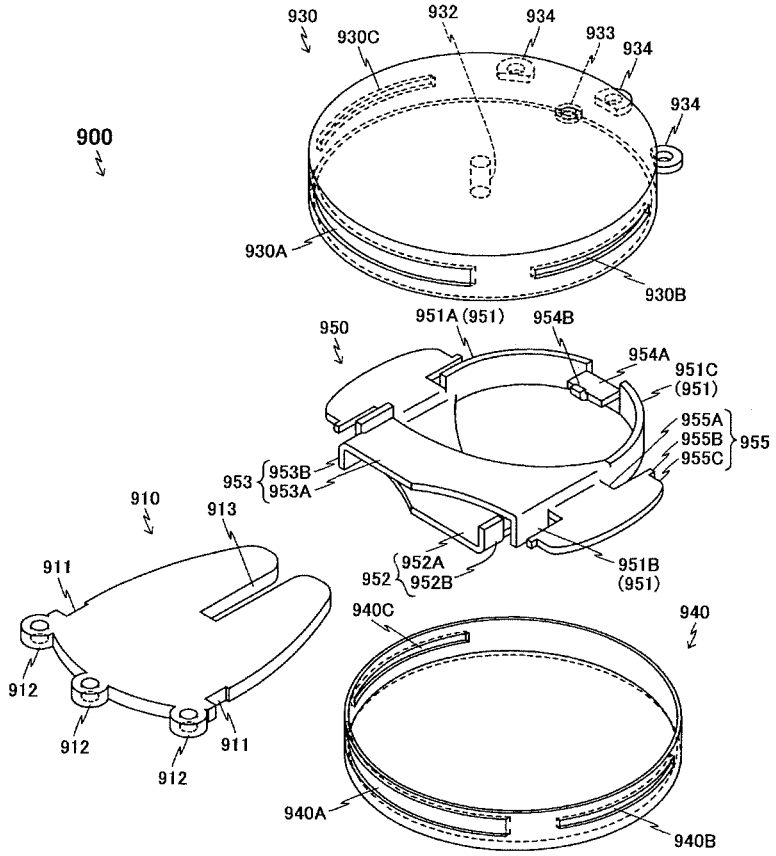
FIG. 41 is an exploded perspective view of a coupler in accordance with the ninth embodiment.
Figure 42:
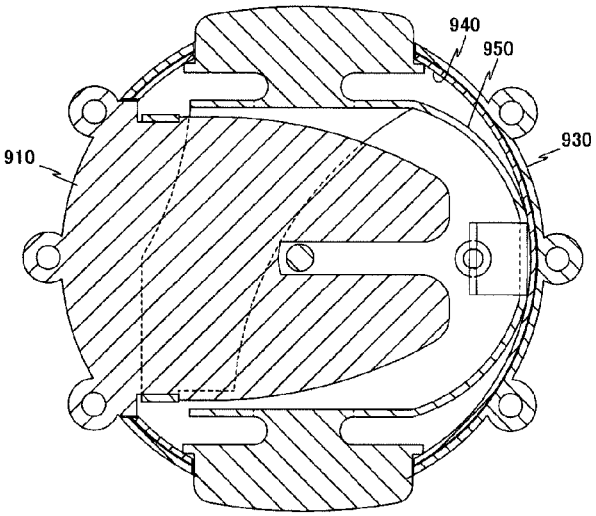
FIG. 42 is a longitudinal cross-sectional view of the coupler in accordance with the ninth embodiment, showing that the male coupler is inserted into the female coupler.

FIG. 41 is an exploded perspective view of a coupler 900 in accordance with the ninth embodiment, and FIG. 42 is a longitudinal cross-sectional view showing that the male coupler 910 is inserted into the female coupler 920.

As illustrated in FIG. 41, the coupler 900 in accordance with the ninth embodiment includes a male coupler 910, and a female coupler 920 into which the male coupler 910 can be inserted and out of which the male coupler 910 can be pulled.

The female coupler 920 includes a first cover 930, a second cover 940, and a guide 950.

The male coupler 910 is comprised of a plate having a constant thickness, and has a shape so as to be able to be inserted into the guide 950. The male coupler 910 is formed at side edges in the vicinity of a rear end with cut-outs 911, and further formed at the rear end with three connection rings 912. The male coupler 910 is formed at a front end thereof with a slit 930 extending towards the rear end of the male coupler 910 along a central axis.

The guide 950 includes a main body 951 having a substantially U-shaped cross-section, a first extension 952, a second extension 953, and a pair of wings 954.

The main body 951 includes a first wall 951A in the form of a plate, a second wall 951B extending in parallel with the first wall 951A and having the same shape as that of the first wall 951A, and a C-shaped connection wall 951C connecting an end of the first wall 951A to an end of the second wall 951B.

The main body 951 is composed of a material having elasticity. Accordingly, the main body 951 can act as a spring. Specifically, an elastic force acts on the first wall 951A such that the first wall 951A moves away from the second wall 951B. Pushing the first wall 951A of the main body 951 towards the second wall 951B, a repulsion force acts on the first wall 951A to cause the first wall 951A to return to an initial position. Similarly, an elastic force acts on the second wall 951B such that the second wall 951B moves away from the first wall 951A. Pushing the second wall 951B of the main body 951 towards the first wall 951A, a repulsion force acts on the second wall 951B to cause the second wall 951B to return to an initial position.

The first extension 952 includes a first portion 952A obliquely and forwardly extending toward the second wall 111B from a lower edge of the first wall 951A, and a second portion 952B upwardly extending from a front edge of the first portion 952A.

The first portion 952A has a length not to reach the second wall 951B.

The first portion 952A is located below a lower edge of the second wall 951B. Accordingly, even if the first extension 952 moves towards the second wall 951B, the first portion 952A does not interfere with the second wall 951B.

Furthermore, the second portion 952B of the first extension 952 has a width smaller than a total width of the first portion 952A, and the second portion 952B is entirely located ahead of the second wall 951B. Accordingly, even if the first extension 952 moves towards the second wall 951B, the second portion 952B does not interfere with the second wall 951B.

The second extension 953 includes a first portion 953A obliquely and forwardly extending towards the first wall 951A from an upper edge of the second wall 951B, and a second portion 953B downwardly extending from a front edge of the first portion 953A.

The first and second portions 953A and 953B of the second extension 953 are vertically and horizontally symmetrical with the first and second portions 952A and 952B of the first extension 952 about a central axis of the guide 950.

The guide 950 includes a positioning portion 954A formed by partially inwardly bending the connection wall 951C. The positioning portion 954A has an upwardly extending projection 954B.

The guide 950 further includes the wings 955 outwardly extending from the first and second walls 951A and 951B.

Each of the wings 955 includes a first wing portion 955A outwardly extending from the first wall 951A or the second wall 951B, a second wing portion 955B having a width greater than the same of the first wing portion 955A, and a third wing portion 955C having a width smaller than the same of the second wing portion 955B, and having an arcuate outer edge.

The first cover 930 is downwardly open and cylindrical. The first cover 930 is formed at a sidewall thereof with a first slit 930A through which the male coupler 910 can pass, and a second slit 930B and a third slit 930C through both of which the third wing portion 954C of the wing 954 can pass, but the second wing portion 954B cannot pass.

Furthermore, the first cover 930 is formed at a sidewall thereof with three connection rings 934 at a opposite side to the first slit 930A.

The first cover 930 is formed at an inner surface of a ceiling with a cylindrical projection 932 fittable into the slit 321 of the male coupler 910, and a ring 933 into which the projection 954B of the guide 950 is fittable.

The second cover 940 is upwardly open and is cylindrical. The second cover 940 is formed at a sidewall thereof with a first slit 940A, a second slit 940B and a third slit 940C corresponding to the first slit 930A, the second slit 930B, and the third slit 930C of the first cover 930.

The first cover 930 and the second cover 940 are fittable into each other, and they, when fit into each other, define a space in which the guide 950 can be housed.

The female coupler 920 in the coupler 900 in accordance with the ninth embodiment having the above-mentioned structure is assembled as follows.

First, the guide 950 is inserted into the second cover 940. In this situation, since the second wing portions 955B are interiorly engaged to the second slit 940B and the third slit 940C, the guide 950 is fixed in the second cover 940.

Then, the second cover 940 is fit into the first cover 930 from below, where the projection 954B of the guide 950 is fit into the ring 933 of the first cover 930. When the first cover 930 and the second cover 940 are fit into each other, as illustrated in FIG. 42, the third wing portions 955C are partially exposed through the second slit 930B and the third slit 930C of the first cover 930.

The thus assembled coupler 900 in accordance with the ninth embodiment is used as follows.

Inserting the male coupler 910 through the first slit 930A of the first cover 930 and the first slit 940A of the second cover 940 into the guide 950 housed in the first cover 930 and the second cover 940, similarly to the coupler 800 (see FIG. 39), the male coupler 910 is engaged with the guide 950.

Thus, the male coupler 910 is fixed in the guide 950 and accordingly in the first cover 930 and the second cover 940.

When the male coupler 910 is taken out of the guide 950, the two wings 954 partially exposed through the second slits 930B and 940B and the third slits 930C and 940C are pushed inwardly.

Thus, the first wall 951A and the second wall 951B of the female coupler 920 are deformed to move towards each other around the connection wall 951C.

Thus, similarly to the guide 840 in the eighth embodiment, the female coupler 920 and the male coupler 910 are disengaged from each other, and accordingly, the male coupler 910 can be pulled out of the female coupler 920.

After the male coupler 910 was pulled out of the female coupler 920, by stopping pushing the wings 954 (specifically, releasing a user's fingers from the wings 954), the first wall 951A and the second wall 951B of the female coupler 920 returns to an initial position (the position illustrated in FIG. 42) by virtue of the elastic forces thereof.

As mentioned above, the coupler 900 in accordance with the ninth embodiment provides the same advantages as those provided by the coupler 100 in accordance with the first embodiment, and provides an additional advantage that outlooking thereof can be enhanced through the use of the first cover 930 and the second cover 940 both acting as a housing.

In comparison with the coupler 800 in accordance with the eighth embodiment, since the wings 955 of the guide 950 act as a push button, the coupler 900 may be designed not to include push buttons.

As illustrated in FIGS. 39 and 41, the eighth and ninth embodiments in which the first and second walls are located at left and right sides are characterized in that the coupler can be designed to be thin. Specifically, the coupler can be designed to have a thickness of about 3 mm.

(Tenth Embodiment)

Figure 43:
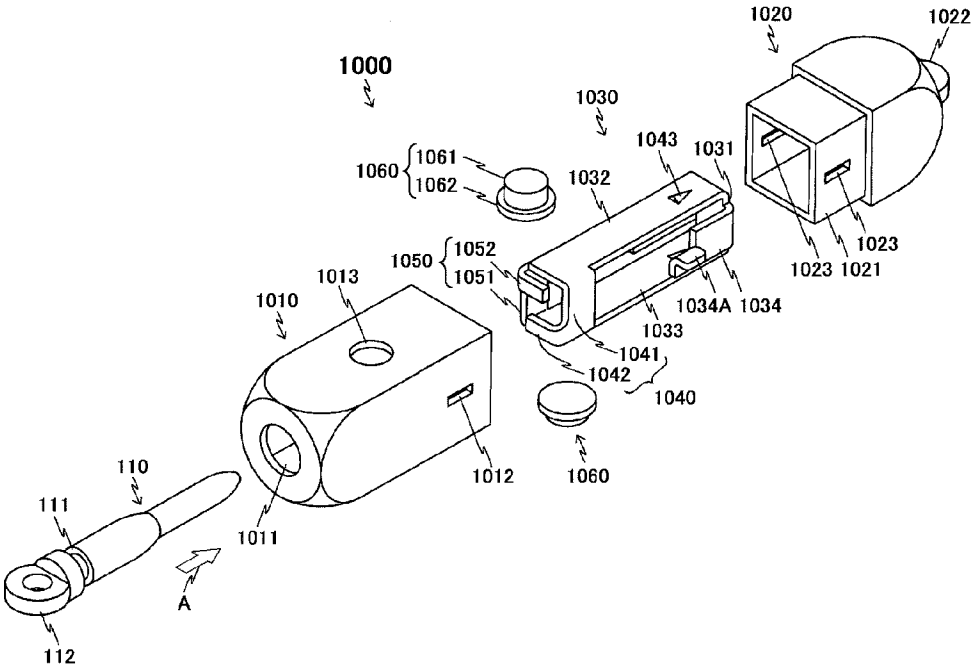
FIG. 43 is an exploded perspective view of a coupler in accordance with the tenth embodiment.
Figure 44:
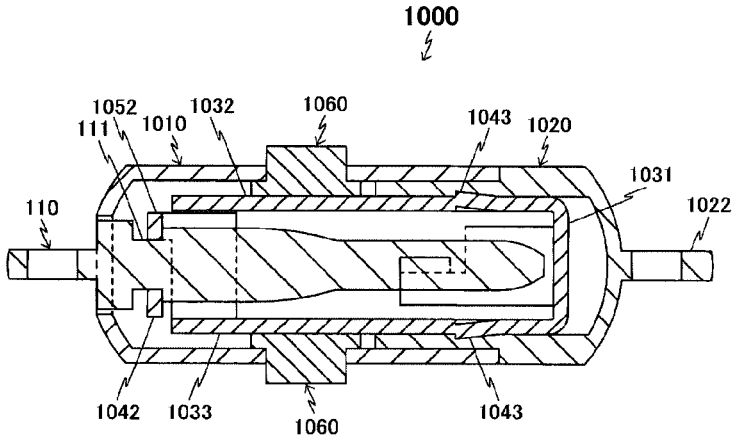
FIG. 44 is a longitudinal cross-sectional view of the coupler in accordance with the tenth embodiment, showing that the male coupler is inserted into the female coupler.

FIG. 43 is an exploded perspective view of a coupler 1000 in accordance with the tenth embodiment, and FIG. 44 is a longitudinal cross-sectional view showing that the male coupler 110 is inserted into the female coupler 1020.

The coupler 1000 in accordance with the tenth embodiment includes a male coupler 110 and a female coupler 1001 into which the male coupler 110 can be inserted and out of which the male coupler 110 can be pulled.

The female coupler 1001 includes a first body 1010, a second body 1020, a guide 1030, and a pair of push buttons 1060.

The first body 1010 is a substantially rectangular parallelepiped. One of faces of the first body 1010 is an open face (not illustrated in FIG. 43). The first body 1010 is formed at a face located opposite to the open face with a through-hole 1011 through which the male coupler 110 can pass.

The second body 1020 has a frame 1021 fittable into the first body 1010 through the open face of the first body 1010. The first body 1010 and the second body 1020 are detachably connected to each other by fitting the frame 1021 into the first body 1010.

The first body 1010 and the second body 1020 define a space in which the guide 1030 can be housed, when they are connected to each other.

The second body 1020 is formed with a connection ring 1022 at a side opposite to the frame 1021.

The frame 1021 of the second body 1020 is formed at a pair of opposing sidewalls thereof facing each other with openings 1023 identical in shape with each other.

The first body 1010 is formed with a pair of openings 1012 with which the openings 1023 align when the second body 1020 is fit into the first body 1010. The openings 1012 are identical in shape with the openings 1023.

Furthermore, the first body 1010 is formed with circular holes 1013 at faces located perpendicular to faces at which the openings 1012 are formed. The holes 1013 are located in an area not to interfere with the frame 1021.

The guide 1030 includes a substantially rectangular base wall 1031, a first wall 1032 extending from an upper edge of the base wall 1031 in a direction opposite to a direction A in which the male coupler 110 is inserted into the first body 1010, a second wall 1033 extending from a lower edge of the base wall 1031 in parallel with the first wall 1032, a third wall 1034 from a left side edge of the base wall 1031 in a direction opposite to the direction A, and a fourth wall 1035 from a right side edge of the base wall 1031 in parallel with the third wall 1034.

As mentioned later, the guide 1030 is housed in both the first body 1010 and the second body 1020, and supports the male coupler 110 when the male coupler 110 is inserted into both the first body 1010 and the second body 1020.

The guide 1030 is composed of a material having elasticity. Accordingly, the first wall 1032, the second wall 1033, the third wall 1034 and the fourth wall 1035 can act as a spring around the base wall 1031. Specifically, the first wall 1032 and the second wall 1033 have elastic forces causing the first wall 1032 and the second wall 1033 to move away from each other around the base wall 1031 (a vertical direction in FIG. 43). Similarly, the third wall 1034 and the fourth wall 1035 have elastic forces causing the third wall 1034 and the fourth wall 1035 to move away from each other around the base wall 1031.

The first wall 1032 includes at a distal end thereof a first extension 1040 designed to engage with the annular groove 111 of the male coupler 110.

The first extension 1040 includes a first portion 1041 extending from a left side edge of the first wall 1032 towards the second wall 1033 (that is, downwardly), and a second portion 1042 extending from a lower edge of the first portion 1041 in a direction perpendicular to a direction A in which the male coupler 110 is inserted into the first body 1010, and designed to engage with a lower area of the annular groove 111 of the male coupler 110.

The second wall 1033 includes at a distal end thereof a second extension 1050 designed to engage with the annular groove 111 of the male coupler 110.

The second extension 1050 includes a first portion 1051 extending from a right side edge of the second wall 1033 towards the first wall 1032 (that is, upwardly), and a second portion 1052 extending from an upper edge of the first portion 1051 in a direction perpendicular to the direction A in which the male coupler 110 is inserted into the first body 1010, and designed to engage with an upper area of the annular groove 111 of the male coupler 110.

Each of the first wall 1032 and the second wall 1033 is formed on an outer surface thereof with a projection 1043 having a function of biting into the second body 1020 in order to prevent the guide 1030 from disengaging from the second body 1020 after the guide 1030 was fit into the second body 1020.

The third wall 1034 and the fourth wall 1035 are partially bent at distal ends thereof to define outwardly extending projections 1034A and 1035A (only the projection 1034A is illustrated in FIG. 43). When the guide 1030 is inserted into the second body 1020, the projections 1034A and 1035A are fit into both the openings 1023 of the second body 1020 and the openings 1012 of the first body 1010, thus the guide 1030 being housed and positioned in both the first body 1010 and the second body 1020.

Each of the push buttons 1060 includes a cylindrical first portion 1061 fittable into the hole 1013 of the first body 1010, and a cylindrical second portion 1062 having a diameter greater than the same of the hole 1013.

The coupler 1000 in accordance with the tenth embodiment, having the above-mentioned structure, is assembled as follows.

First, the guide 1030 is inserted into the second body 1020, and the projection 1034A of the third wall 1034 and the projection 1035A of the fourth wall 1035 are fit into the openings 1023. Thus, the guide 1030 is fixed and positioned in the second body 1020.

Then, for instance, the first body 1010 is caused to stand, and the first portions 1061 of the push buttons 1060 are fit into the holes 1013 of the first body 1010.

Then, keeping the first body 1010 standing, the frame 1021 of the second body 1020 is fit into the first body 1010 through the open face of the first body 1010, and the projection 1034A of the third wall 1034 and the projection 1035A of the fourth wall 1035 are fit into the openings 1012 of the first body 1010.

As mentioned earlier, the first wall 1032 and the second wall 1033 can act as a spring around the base wall 1031, and deformed in a direction F. Thus, the guide 1030 housed in the first body 1010 and the second body 1020 keeps outwardly pushing the push buttons 1060, as illustrated in FIG. 44.

The female coupler 1001 in the coupler 1000 in accordance with the tenth embodiment is assembled in the above-mentioned manner.

The thus assembled coupler 1001 in the coupler 1000 in accordance with the tenth embodiment is used as follows.

Inserting the male coupler 110 into the first body 1010 through the through-hole 1011 of the first body 1010, the male coupler 110 makes contact with both the second portion 1042 of the first extension 1040 and the second portion 1052 of the second extension 1050 of the guide 1030 housed in the first body 1010.

Causing the male coupler 110 to go forwardly into the first body 1010 in the direction A, the male coupler 110 pushes downwardly the second portion 1042 of the first extension 1040 and pushes upwardly the second portion 1052 of the second extension 1050.

When the male coupler 110 reaches at a location where the annular groove 111 of the male coupler 110 vertically aligns with both the second portion 1042 of the first extension 1040 and the second portion 1052 of the second extension 1050, the second portion 1042 of the first extension 1040 having been pushed downwardly by the male coupler 110 moves upwardly by virtue of the elastic force of the guide 1030, and the second portion 1052 of the second extension 1050 having been pushed upwardly by the male coupler 110 moves downwardly by virtue of the elastic force of the guide 1030, thus the second portions 1042 and 1052 engage with lower and upper areas of the annular groove 111 of the male coupler 110, respectively.

Thus, the male coupler 110 is fixed in the guide 1030 and accordingly in the female coupler 1001.

When the male coupler 110 is taken out of the guide 1030, the push buttons 1060 are pushed inwardly of the first body 1010.

Thus, the first wall 1032 and the second wall 1033 of the guide 1030 are deformed towards each other around the base wall 1031.

As a result, the second portion 1042 of the first extension 1040 moves downwardly and the second portion 1052 of the second extension 1050 moves upwardly, and accordingly, they are disengaged from the annular groove 111 of the male coupler 110.

Since the male coupler 110 and the guide 1030 are disengaged from each other by pushing the push buttons 1060, as mentioned above, the male coupler 110 can be pulled out of the guide 1030.

After the male coupler 110 was pulled out of the female coupler 1001, by stopping pushing the push buttons 1060 (specifically, releasing a user's fingers from the push buttons 1060), the first wall 1032 and the second wall 1033 of the guide 1030 return to an initial position (the position illustrated in FIG. 44) by virtue of the elastic force of the guide 1030.

As mentioned above, the coupler 1000 in accordance with the tenth embodiment provides the same advantages as those provided by the coupler 100 in accordance with the first embodiment.

The structure of the coupler 1000 in accordance with the tenth embodiment is not to be limited to the above-mentioned one, but may be varied in many ways.

Both the first body 1010 and the second body 1020 in the coupler 1000 are designed to be an almost rectangular parallelepiped, but may be designed to be other shapes. For instance, the first body 1010 and the second body 1020 may be designed to be cylindrical.

Furthermore, the guide 1030 may be designed to have another shape dependent on the shape of the first body 1010 and the second body 1020. For instance, if the first body 1010 and the second body 1020 were designed to be cylindrical, the guide 1030 may be designed to have a shape to be able to be housed in a cylinder.

Though the coupler 1000 in accordance with the tenth embodiment is designed to include the push buttons 1060, the coupler 1000 may be designed not to include the push buttons 1060, if necessary. That is, if the first wall 1032 and the second wall 1033 of the guide 1030 can be directly pushed through the holes 1013 of the first body 1010 to thereby disengage the guide 1030 and the male coupler 110 from each other, the coupler 1000 may be designed not to include the push buttons 1060.

The guide 1030 in the tenth embodiment is designed to include the first extension 1040 and the second extension 1050, however, the guide 1030 may be designed to include one of the first extension 1040 and the second extension 1050, in which case, the first body 1010 is designed to include a single hole 1013.

(Eleventh Embodiment)

Figure 45:
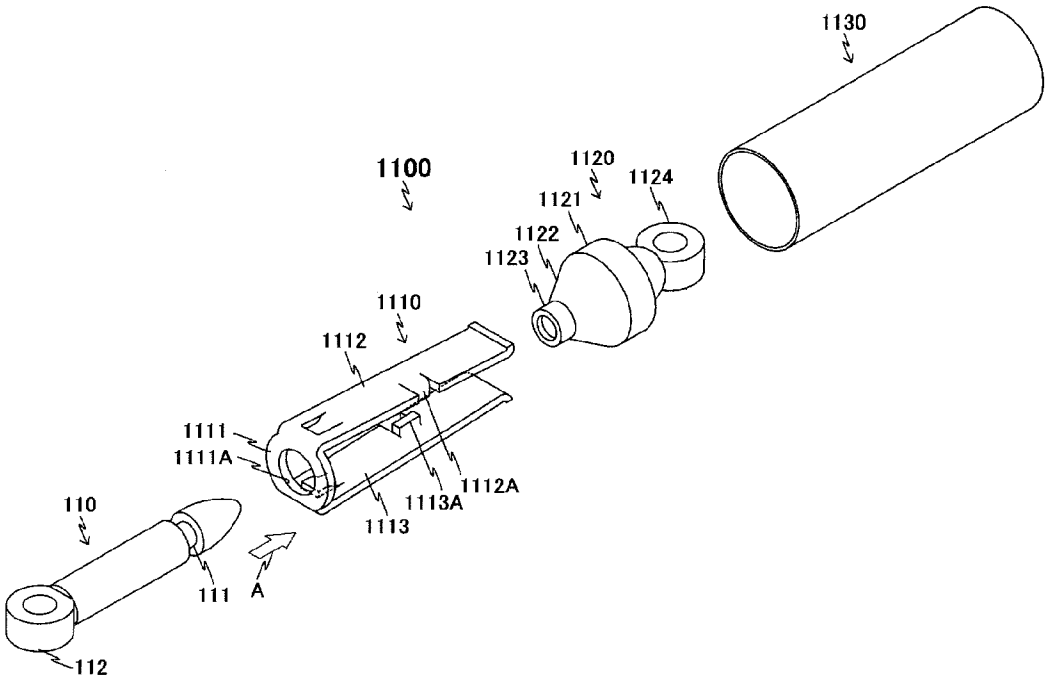
FIG. 45 is an exploded perspective view of a coupler in accordance with the eleventh embodiment.
Figure 46:
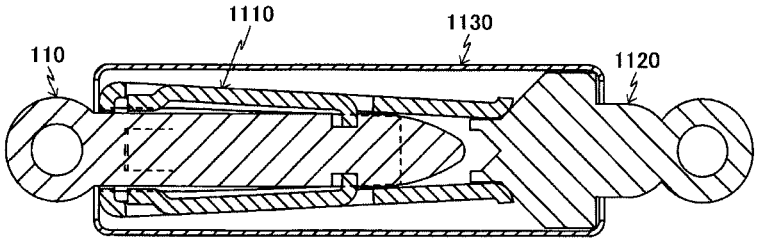
FIG. 46 is a longitudinal cross-sectional view of the coupler in the coupler in accordance with the eleventh embodiment, showing that the male coupler is inserted into the female coupler.
Figure 47:
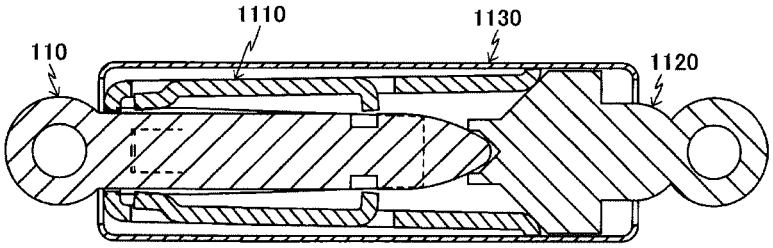
FIG. 47 is a longitudinal cross-sectional view of the coupler in accordance with the eleventh embodiment, showing that the male coupler is being taken out of the female coupler.
Figure 48:
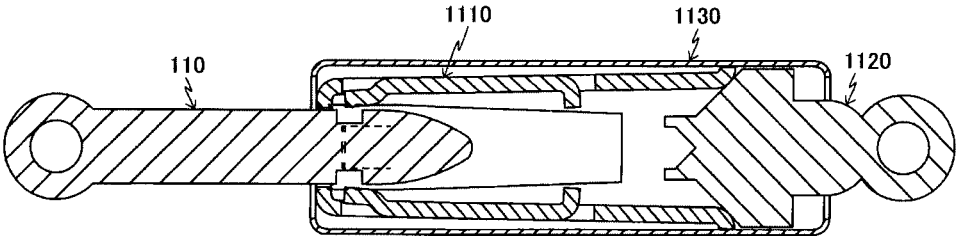
FIG. 48 is a longitudinal cross-sectional view of the coupler in accordance with the eleventh embodiment, showing that the male coupler is taken out of the female coupler.

FIG. 45 is an exploded perspective view of a coupler 1100 in accordance with the eleventh embodiment, FIG. 46 is a longitudinal cross-sectional view of the coupler 1100, showing that the male coupler is inserted into the female coupler, FIG. 47 is a longitudinal cross-sectional view showing that the male coupler is being taken out of the female coupler, and FIG. 48 is a longitudinal cross-sectional view showing that the male coupler is taken out of the female coupler.

As illustrated in FIG. 45, the coupler 1100 in accordance with the eleventh embodiment includes a male coupler 110 and a female coupler 1101. The female coupler 1101 includes a guide 1110, a connector 1120, and a hollow cylindrical housing 1130 opening at opposite ends thereof.

The guide 1110 includes a base wall 1111 formed with a through-hole 1111A through which the male coupler 110 can pass, a first wall 1112 extending from an upper edge of the base wall 1111 in a direction A in which the male coupler 110 is inserted, and a second wall 1113 extending from a lower edge of the base wall 1111 in the direction A.

The guide 1110 is composed of a material having elasticity, and hence, the first wall 1112 and the second wall 1113 can act as a spring around the base wall 1111. Specifically, the first wall 1112 and the second wall 1113 have elastic forces which cause distal ends of the first wall 1112 and the second wall 1113 to move towards each other.

The first wall 1112 and the second wall 1113 have projections 1112A and 1113A, respectively, at the same location between distal and proximal ends thereof. The projections 1112A and 1113A are formed by partially bending the first wall 1112 and the second wall 1113. As mentioned later, the projections 1112A and 1113A engage with upper and lower areas of the annular groove 111 of the male coupler 110, respectively.

The connector 1120 includes a first portion 1121 having an outer diameter allowing the first portion to slide along an inner wall of the housing 1130, a tapered portion 1122 having an outer diameter getting greater in the direction A, an annular second portion 1123 formed at a distal end of the tapered portion 1122, and a connection ring 1124 formed at a side opposite to the tapered portion 1122.

After the guide 1110 and the connector 1120 are housed in the housing 1130, as illustrated in FIGS. 46 to 48, the housing 1130 are inwardly bent at peripheral edges at opposite ends thereof. Thus, the guide 1110 and the connector 1120 are housed in the housing 1130 without sliding out of the housing 1130 with the connection ring 1124 exposed out of the housing 1130.

As illustrated in FIG. 46, the first wall 1112 and the second wall 1113 of the guide 1110 make contact at distal ends thereof with the tapered portion 1122 of the connector 1120 in the housing 1130.

The coupler 1100 in accordance with the eleventh embodiment, having the above-mentioned structure, is used as follows.

Inserting the male coupler 110 into the guide 1110 through the through-hole 1111A, the male coupler 110 pushes upwardly the projection 1112A of the first wall 1112 and pushes downwardly the projection 1113A of the second wall 1113.

When the male coupler 110 reaches at a location where the annular groove 111 of the male coupler 110 vertically aligns with both the projection 1112 of the first wall 1112 and the projection 1113A of the second wall 1113, the projection 1112A of the first wall 1112 moves downwardly by virtue of the elastic force of the first wall 1112, and the projection 1113A of the second wall 1113 moves upwardly by virtue of the elastic force of the second wall 1113, thus the projections 1112A and 1113A engaging with upper and lower areas of the annular groove 111, respectively.

Thus, as illustrated in FIG. 46, the male coupler 110 is fixed in the guide 1110 and accordingly in the housing 1030.

When the male coupler 110 is pulled out of the female coupler 1101, as illustrated in FIG. 47, the connector 1120 is pushed inwardly of the housing 1130 (as an alternative, as the same movement, the male coupler 110 and the housing 1130 are pulled in opposite directions to slide). When the connector 1120 is pushed inwardly of the housing 1030, the first wall 1112 and the second wall 1113 both making contact with the tapered portion 1122 of the connector 1120 start sliding along and on the tapered portion 1122. As illustrated in FIG. 47, since the first wall 1112 and the second wall 1113 move away from the male coupler 110, the projections 1112A and 1113A and the annular groove 111 of the male coupler 110 are disengaged from each other. Specifically, the connector 1120 situated at one of openings of the housing 1130 having openings at opposite ends thereof cause the first wall 1112 and the second wall 1113 to move away from each other.

Thereafter, as illustrated in FIG. 48, the male coupler 110 is pulled in a direction opposite to the direction A, and thus, the male coupler 110 can be pulled out of the female coupler 1101. In the case that the male coupler 110 and the housing 1030 are pulled in opposite directions to slide, the male coupler 110 is pulled out of the female coupler 1101 at the same time when the projections 1112A and 1113A and the annular groove 111 are disengaged from each other.

As mentioned above, the coupler 1100 in accordance with the eleventh embodiment provides the same advantages as those provided by the coupler 100 in accordance with the first embodiment. In the coupler 1100 in accordance with the eleventh embodiment, it is not necessary to form openings at a sidewall of the housing 1130, ensuring that the housing 1030 can be formed simple and at low costs.

The structure of the coupler 1100 in accordance with the eleventh embodiment is not to be limited to the above-mentioned one, but may be varied in many ways.

Both the first wall 1112 and the second wall 1113 in the coupler 1100 are formed with the projections 1112A and 1113A, respectively, however, only one of the first wall 1112 and the second wall 1113 may be formed with the projection 1112A or 1113A.

The projections 1112A and 1113A in the coupler 1100 are formed by bending a part of the first wall 1112 and the second wall 1113. As an alternative, for instance, the projection may be welded onto inner surfaces of the first wall 1112 and the second wall 1113.

Figure 55:
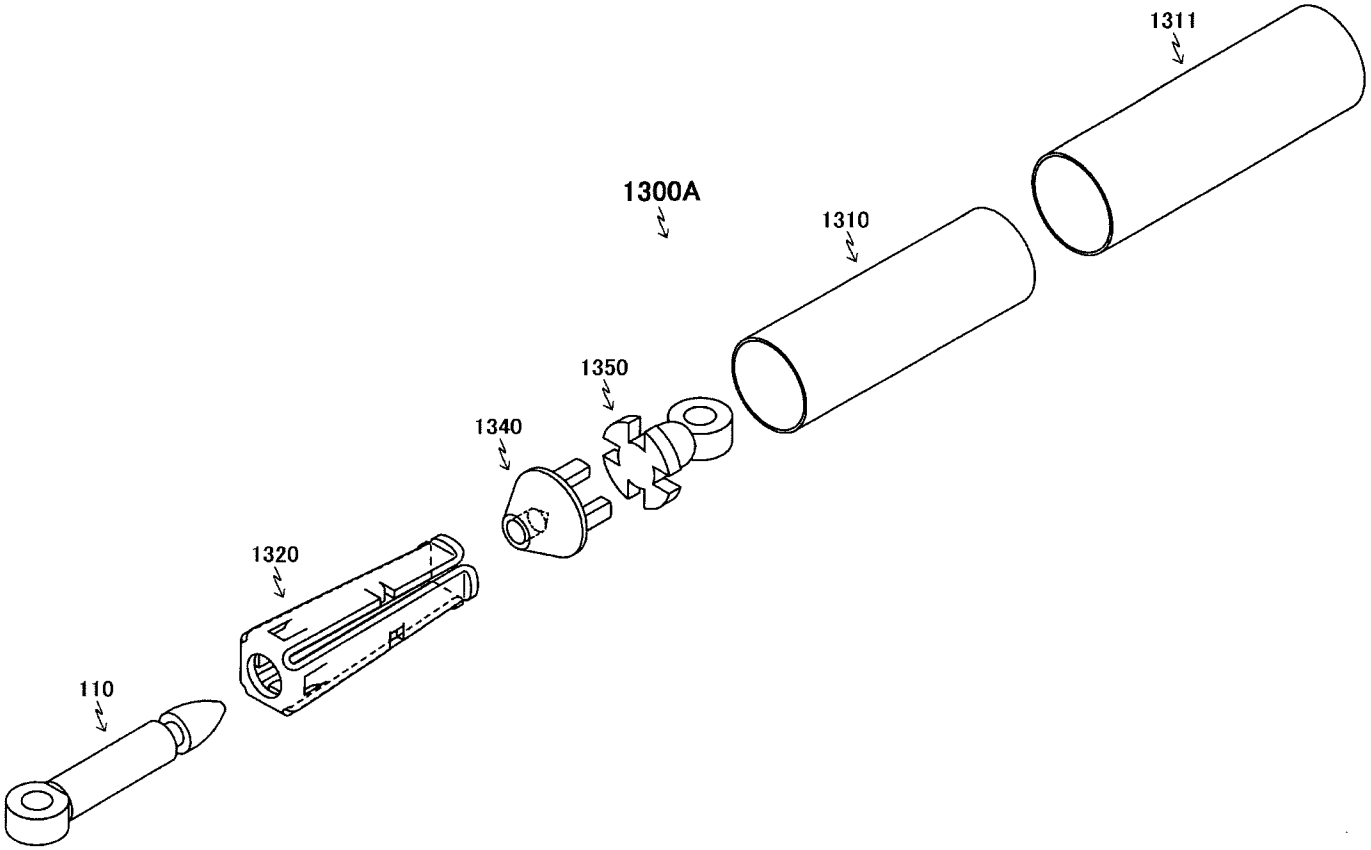
FIG. 55 is an exploded view of a coupler in accordance with a variation of the thirteenth embodiment.

The guide 1320 illustrated in FIG. 55 may be used in place of the guide 1110. In the case of using the guide 1320 illustrated in FIG. 55, the male coupler and the guide 1320 are engaged with each other by virtue of the elastic forces of all of the first to fourth walls 1322, 1323, 1324 and 1325, ensuring enhancement of engagement forces.

Figure 68:
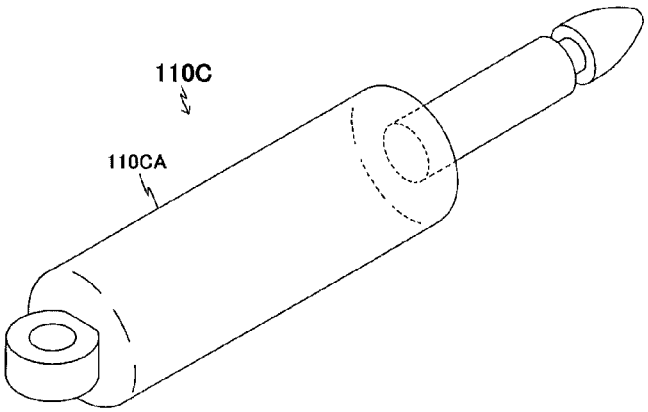
FIG. 68 is a perspective view of a male coupler in accordance with a variation.

The male coupler 110C illustrated in FIG. 68 may be used in place of the male coupler 110. The male coupler 110C illustrated in FIG. 68 includes a portion 110CA having an increased outer diameter. When the male coupler 110 is necessary to be pulled, for instance, the male coupler 110 can be readily pulled through the portion 110CA.

(Twelfth Embodiment)

Figure 49:
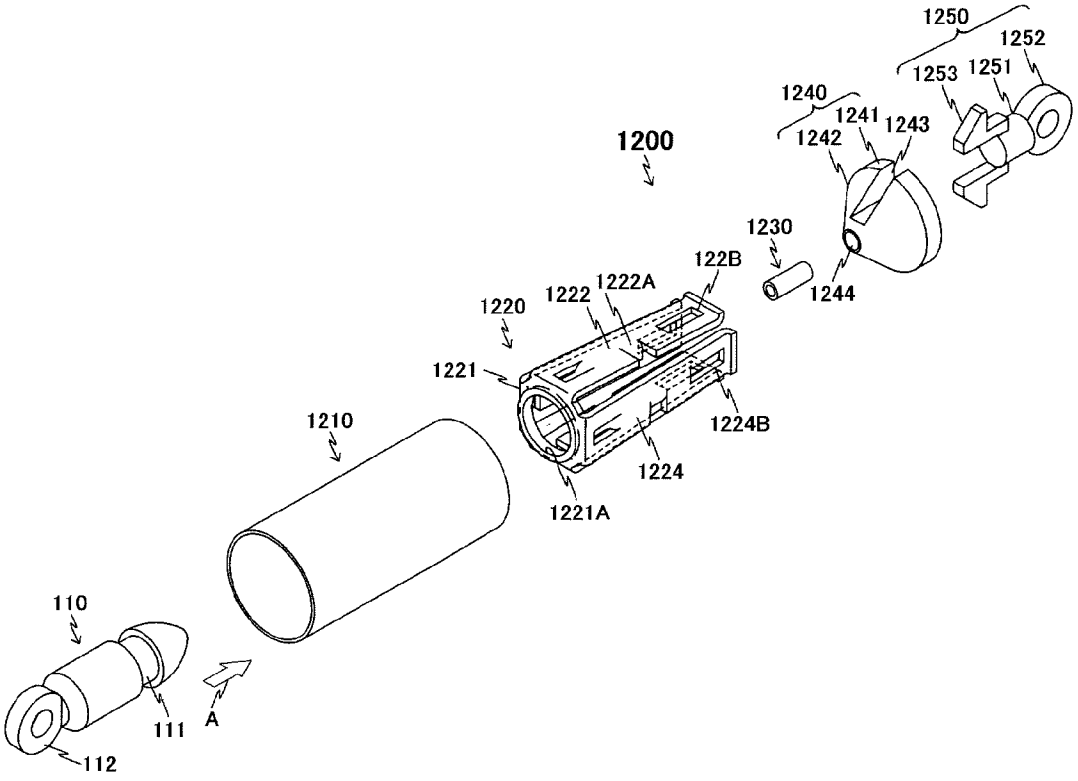
FIG. 49 is an exploded perspective view of a coupler in accordance with the twelfth embodiment.
Figure 50:
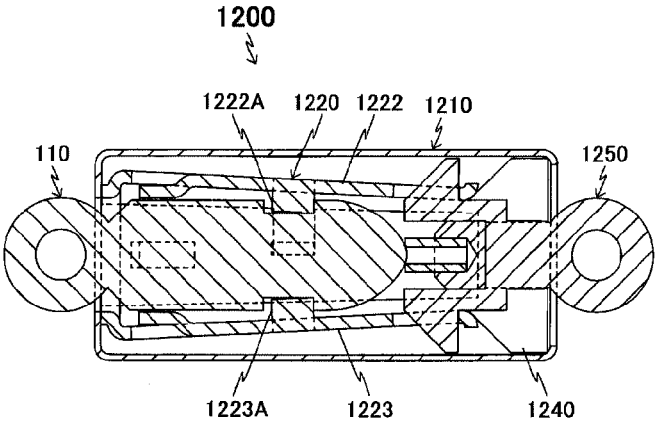
FIG. 50 is a longitudinal cross-sectional view of the coupler in accordance with the twelfth embodiment, showing that the male coupler is inserted into the female coupler.

FIG. 49 is an exploded perspective view of a coupler 1200 in accordance with the twelfth embodiment of the present invention, and FIG. 50 is a longitudinal cross-sectional view of the coupler 1200, showing that the male coupler is inserted into the female coupler.

As illustrated in FIG. 49, the 1200 in accordance with the twelfth embodiment includes a male coupler 110 and a female coupler 1201. The female coupler 1201 includes a hollow cylindrical first housing 1210 opening at opposite ends thereof, a guide 1220, an elastic part 1230, a connector 1240, and a connection ring 1250.

The guide 1220 includes a base wall 1221 formed with a through-hole 1221A through which the male coupler 110 can pass, a first wall 1222 extending from an upper edge of the base wall 1221 in a direction A in which the male coupler 110 is inserted, a second wall 1223 extending from a lower edge of the base wall 1221 in the direction A, a third wall 1224 extending from a right side edge of the base wall 1221 in the direction A, and a fourth wall 1225 extending from a left side edge of the base wall 1221 in the direction A.

The guide 1220 is composed of a material having elasticity, and hence, the first to fourth walls 1222 to 1225 can act as a spring around the base wall 1221. Specifically, the first to fourth walls 1222 to 1225 have elastic forces which cause distal ends thereof to move towards one another.

Each of the first to fourth walls 1222 to 1225 has projections 1222A to 1225A, respectively, at the same location between distal and proximal ends thereof. The projections 1222A to 1225A are formed by partially bending the first to fourth walls 1222 to 1225. As mentioned later, the projections 1222A to 1225A engage with upper, lower, right and left areas of the annular groove 111 of the male coupler 110, respectively.

The elastic part 1230 is a cylindrical part composed of an elastic material such as rubber.

The connector 1240 includes a first portion 1241 having an outer diameter allowing the first portion 1241 to slide along an inner wall of the first housing 1210, and a tapered portion 1242 having an outer diameter getting greater in the direction A.

The first portion 1241 and the tapered portion 1242 are formed with slits 1243 across a diameter of them. The tapered portion 1242 is formed at a top thereof with a through-hole 1244 into which the elastic part 1230 can be fit.

The connection ring 1250 includes a cylindrical main body 1251, a ring 1252 formed at an end of the main body 1251, and a pair of guides 1253 formed at the other end of the main body 1251.

The guides 1253 can slide through the slits 1243 of the connector 1240. That is, the connection ring 1250 has a shape such that the connection ring 1250 can be detachably connected to the connector 1240.

After the guide 1220, the connector 1240 and the connection ring 1250 were housed in the first housing 1210, as illustrated in FIG. 50, the first housing 1210 is inwardly bent at peripheral edges of openings at opposite ends thereof. Thus, the guide 1220, the connector 1240 and the connection ring 1250 are housed in the first housing 1210 without sliding out of the first housing 1210 with the ring 1252 exposed out of the first housing 1210.

As illustrated in FIG. 50, the first to fourth walls 1222 to 1225 of the guide 1220 make contact at distal ends thereof with the tapered portion 1242 of the connector 1240 in the first housing 1210. The elastic part 1230 is fit into the through-hole 1244 formed at a distal end of the tapered portion 1242. The connection ring 1250 is housed in the first housing 1210 such that the guides 1253 are fit into the slits 1243 of the connector 1240, distal ends of the guides 1253 project out of the openings 1222B to 1225B formed at the first to fourth walls 1222 to 1225 of the guide 1220, and the ring 1252 is exposed out of the first housing 1210. Thus, the guide 1220 is positioned in the first housing 1210.

The coupler 1200 in accordance with the twelfth embodiment, having the above-mentioned structure, is used as follows.

Inserting the male coupler 110 into the guide 1220 through the through-hole 1221A of the base wall 1211, the male coupler 110 goes into the guide 1220 in the direction A, outwardly pushing the projections 1222A to 1225A of the first to fourth walls 1222 to 1225.

When the male coupler 110 reaches at a location where the annular groove 111 of the male coupler 110 vertically aligns with the projections 1222A to 1225A of the first to fourth walls 1222 to 1225, the projections 1222A to 1225A engage to the annular groove 111 in four directions by virtue of the elastic forces of the first to fourth walls 1222 to 1225.

Thus, as illustrated in FIG. 50, the male coupler 110 is fixed in the guide 1220 and accordingly in the first housing 1210. In this situation, the male coupler 110 makes contact at a distal end thereof with the elastic part 1230.

When the male coupler 110 is pulled out of the female coupler 1201, the connection ring 1250 and accordingly the connector 1240 is pushed inwardly of the first housing 1210 (as an alternative, the connection ring 1250 and the first housing 1210 are pulled in opposite directions). When the connector 1240 is pushed inwardly of the first housing 1210, the distal ends of the first to fourth walls 1222 to 1225 making contact with the tapered portion 1242 of the connector 1240 start sliding along and on the tapered portion 1242. Since sliding of the distal ends of the first to fourth walls 1222 to 1225 on the tapered portion 1242 cause the first to fourth walls 1222 to 1225 to move away from the male coupler 110, the projections 1222A to 1225A and the annular groove 111 of the male coupler 110 are disengaged from each other.

Then, the male coupler 110 is pushed out by virtue of the elastic force of the elastic part 1230, and thus, the male coupler 110 is caused to leave the female coupler 1201.

As mentioned above, the coupler 1200 in accordance with the eleventh embodiment provides the same advantages as those provided by the coupler 100 in accordance with the first embodiment.

The guide 1220 in the coupler 1200 in accordance with the eleventh embodiment is designed to include the four walls 1222 to 1225, but may be designed to include one of them. However, the guide 1220 may include two walls facing each other (for instance, the first wall 1222 and the second wall 1223).

(Thirteenth Embodiment)

Figure 51:
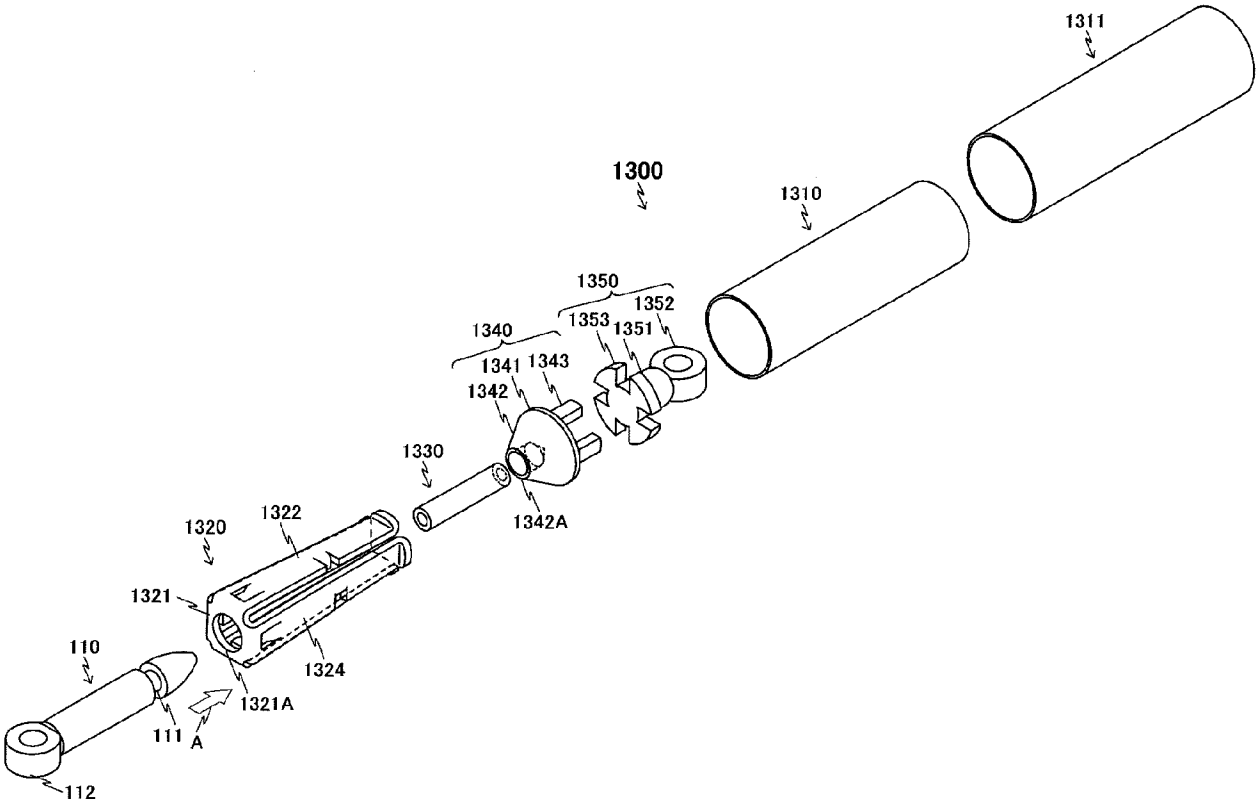
FIG. 51 is an exploded perspective view of a coupler in accordance with the thirteenth embodiment.
Figure 52:
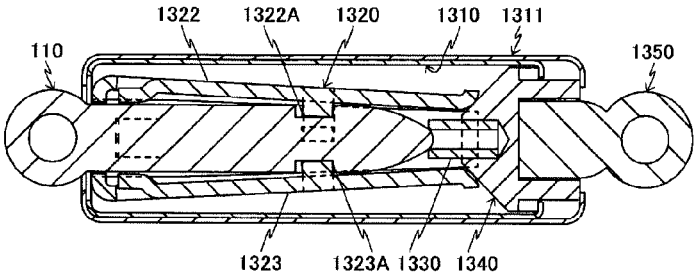
FIG. 52 is a longitudinal cross-sectional view of the coupler in accordance with the thirteenth embodiment, showing that the male coupler is inserted into the female coupler.
Figure 53:
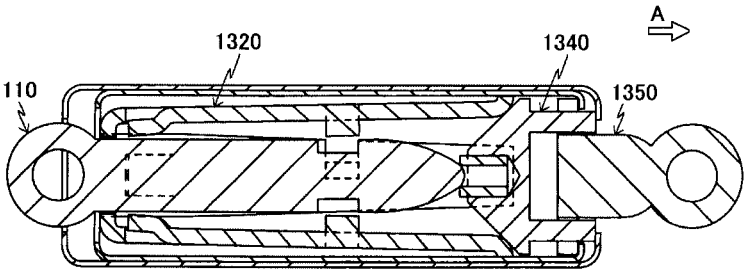
FIG. 53 is a longitudinal cross-sectional view of the coupler in accordance with the thirteenth embodiment, showing that the male coupler is being taken out of the female coupler.
Figure 54:
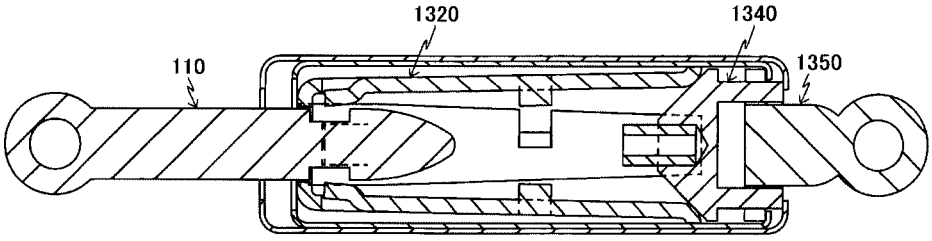
FIG. 54 is a longitudinal cross-sectional view of the coupler in accordance with the thirteenth embodiment, showing that the male coupler is taken out of the female coupler.

FIG. 51 is an exploded perspective view of a coupler 1300 in accordance with the thirteenth embodiment of the present invention, FIG. 52 is a longitudinal cross-sectional view of the coupler 1300, showing that the male coupler is inserted into the female coupler, FIG. 53 is a longitudinal cross-sectional view showing that the male coupler is being taken out of the female coupler, and FIG. 54 is a longitudinal cross-sectional view showing that the male coupler is taken out of the female coupler.

As illustrated in FIG. 51, the coupler 1300 in accordance with the thirteenth embodiment includes a male coupler 110 and a female coupler 1301. The female coupler 1301 includes a hollow cylindrical first housing 1310 opening at opposite ends thereof, a hollow cylindrical second housing 1311 opening at opposite ends thereof, a guide 1320, an elastic part 1330, a connector 1340, and the connection ring 1350.

The second housing 1311 has such a size that the second housing 1311 can slide along an outer wall of the first housing 1310.

The guide 1320 has the same structure as that of the guide 1220 (see FIG. 49) in the twelfth embodiment except for the openings 1222B to 1225B.

The elastic part 1330 is a cylindrical part composed of an elastic material such as rubber.

The connector 1340 includes a first portion 1341 having an outer diameter allowing the first portion to slide along an inner wall of the first housing 1310, a tapered portion 1342 having an outer diameter getting greater in the direction A, and four extensions 1343 extending from a bottom of the tapered portion 1342 in the direction A.

The tapered portion 1342 is formed at a top thereof with a hole 1342A into which the elastic part 1330 can be fit.

The connection ring 1350 includes a cylindrical main body 1351, a ring 1352 formed at an end of the main body 1351, and four guides 1353 slidable along the extensions 1343 of the connector 1340.

After the guide 1320, the connector 1340 and the connection ring 1350 were housed in the first housing 1310 and the second housing 1311, as illustrated in FIG. 52, the first housing 1310 and the second housing 1311 are inwardly bent at peripheral edges of openings at opposite ends thereof. Thus, the guide 1320, the connector 1340 and the connection ring 1350 are housed in the first housing 1310 and the second housing 1311 without sliding out of the first housing 1310 and the second housing 1311 with the ring 1352 exposed out of the first housing 1310 and the second housing 1311. The base wall 1321 of the guide 1320 makes contact with a peripheral edge of one of the openings of the first housing 1310, and, as mentioned later, the first to fourth walls 1322 to 1325 make contact at distal ends thereof with the tapered portion 1342 of the connector 1340. Thus, the guide 1320 is positioned in the first housing 1310.

As illustrated in FIG. 52, the first to fourth walls 1322 to 1325 of the guide 1320 make contact at distal ends thereof with the tapered portion 1342 of the connector 1340 in the first housing 1310 and the second housing 1311. The elastic part 1330 is fit into the hole 1342A formed at a top of the tapered portion 1342. The connection ring 1350 is housed in the first housing 1310 and the second housing 1311 such that the guides 1353 are slidably fit into the extensions 1343 of the connector 1340, and the ring 1352 is exposed out of the first housing 1310 and the second housing 1311.

The coupler 1300 in accordance with the thirteenth embodiment, having the above-mentioned structure, is used as follows.

Inserting the male coupler 110 into the guide 1320 through the hole 1321A of the base wall 1321 of the guide 1320, the male coupler 110 goes into the guide 1320 in the direction A, outwardly pushing the projections of the first to fourth walls 1322 to 1325.

When the male coupler 110 reaches at a location where the annular groove 111 of the male coupler 110 vertically aligns with the projections of the first to fourth walls 1322 to 1325, the projections engage to the annular groove 111 from four directions by virtue of the elastic forces of the first to fourth walls 1322 to 1325.

Thus, as illustrated in FIG. 52, the male coupler 110 is fixed in the guide 1320 and accordingly in the first housing 1310 and the second housing 1311. In this situation, the male coupler 110 makes contact at a distal end thereof with the elastic part 1330.

When the male coupler 110 is pulled out of the female coupler 1301, the second housing 1311 and the connection ring 1350 are pulled in opposite directions to slide. As an alternative, the connection ring 1350 and accordingly the connector 1340 is pushed inwardly of the first housing 1310. Thus, as illustrated in FIG. 53, since the second housing 1311 makes contact at a peripheral edge of the opening thereof with the extensions 1343 of the connector 1340, the connector 1340 moves in a direction opposite to the direction A. When the connector 1340 moves in a direction opposite to the direction A, the tapered portion 1342 spread the first to fourth walls 1322 to 1325 in contact with the tapered portion 1342 apart from one another. As a result, as illustrated in FIG. 53, the projections and the annular groove 111 of the male coupler 110 are disengaged from each other. In other words, the second housing 1311 has a function of a lever for disengaging the male coupler 110 and the guide 1320 from each other.

Then, as illustrated in FIG. 54, the male coupler 110 is pushed out by virtue of the elastic force of the elastic part 1330, and thus, the male coupler 110 is caused to leave the female coupler 1301.

As mentioned above, the coupler 1300 in accordance with the thirteenth embodiment provides the same advantages as those provided by the coupler 100 in accordance with the first embodiment.

Though the coupler 1300 in accordance with the thirteenth embodiment is designed to include the two housings 1310 and 1311, the coupler 1300 may be designed to include a single housing, similarly to the twelfth embodiment.

FIG. 55 is an exploded view of a coupler 1300A in accordance with a variation of the thirteenth embodiment.

As illustrated in FIG. 55, the coupler 1300A may be designed not to include the elastic part 1330.

(Fourteenth Embodiment)

Figure 56:
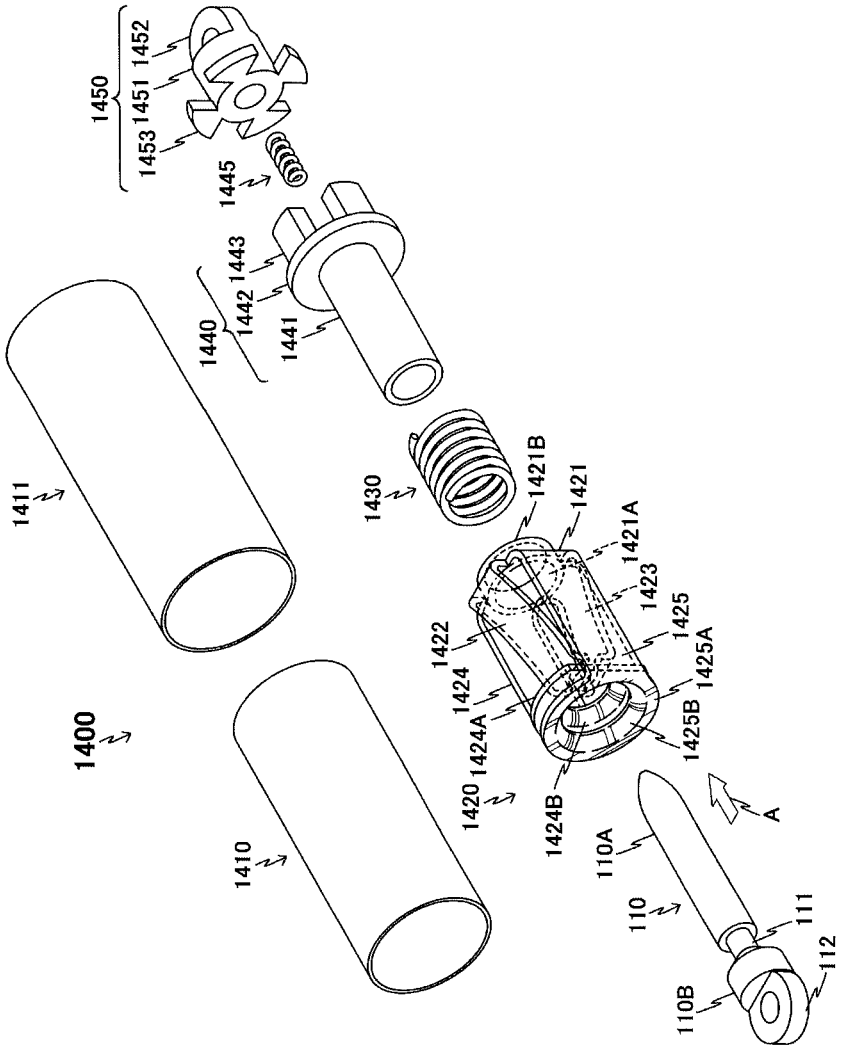
FIG. 56 is an exploded perspective view of a coupler in accordance with the fourteenth embodiment.
Figure 57:
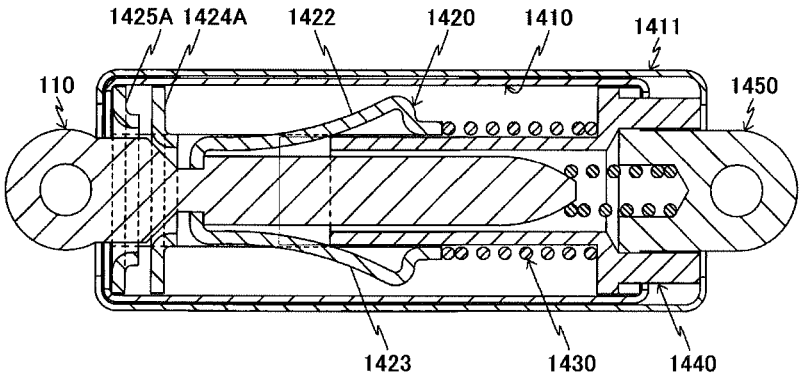
FIG. 57 is a longitudinal cross-sectional view of the coupler in accordance with the fourteenth embodiment, showing that the male coupler is inserted into the female coupler.
Figure 58:
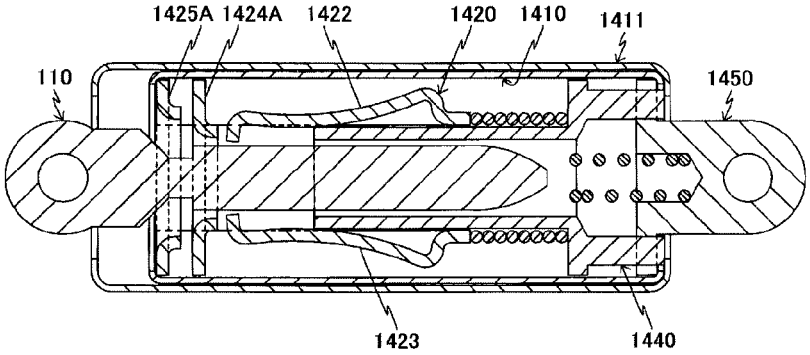
FIG. 58 is a longitudinal cross-sectional view of the coupler in accordance with the fourteenth embodiment, showing that the male coupler is being taken out of the female coupler.

FIG. 56 is an exploded perspective view of a coupler 1400 in accordance with the fourteenth embodiment of the present invention, FIG. 57 is a longitudinal cross-sectional view of the coupler 1400, showing that the male coupler is inserted into the female coupler, and FIG. 58 is a longitudinal cross-sectional view showing that the male coupler is being taken out of the female coupler.

As illustrated in FIG. 56, the coupler 1400 in accordance with the fourteenth embodiment includes a male coupler 110 and a female coupler 1401. The female coupler 1401 includes a hollow cylindrical first housing 1410 opening at opposite ends thereof, a hollow cylindrical second housing 1411 opening at opposite ends thereof, a guide 1420, an elastic part 1430, a connector 1440, and the connection ring 1450.

The second housing 1411 has such a size that the second housing 1411 can slide along an outer wall of the first housing 1410.

The guide 1420 includes a base wall 1421 formed with a through-hole 1421A through which the male coupler 110 can pass, a first wall 1422 extending from an upper edge of the base wall 1421 in a direction opposite to a direction A in which the male coupler 110 is inserted, a second wall 1423 extending from a lower edge of the base wall 1421 in a direction opposite to the direction A, a third wall 1424 extending from a right side edge of the base wall 1421 in a direction opposite to the direction A, and a fourth wall 1425 extending from a left side edge of the base wall 1421 in a direction opposite to the direction A.

The base wall 1421 is formed at a peripheral edge of the through-hole 1421A with a reinforcement 1421B extending in the direction A.

The guide 1420 is composed of a material having elasticity, and accordingly, the first wall 1422 and the second wall 1423 can act as a spring around the base wall 1421. Specifically, the first and second walls 1422 and 1423 have elastic forces which cause distal ends thereof to move towards one another.

The first and second walls 1422 and 1423 are bent at distal ends thereof to thereby be able to engage to the annular groove 111 of the male coupler 110.

The third wall 1424 is formed at a distal end thereof with an extension 1424A perpendicularly and inwardly extending. The extension 1424A is formed centrally with an opening 1424B through which a front portion 110A of the male coupler 110 located ahead of the annular groove 111 can pass, but a portion 110B having an increased diameter and located at the rear of the annular groove 111 cannot pass.

The fourth wall 1425 is formed at a distal end thereof with an extension 1425A perpendicularly and inwardly extending. The extension 1425A is formed centrally with an opening 1425B through which the male coupler 110 can pass. The extension 1425A of the fourth wall 1425 and the extension 1424A of the third wall 1424 are in parallel with each other in order to prevent them from interfering with each other. In the fourteenth embodiment, the extension 1425A of the fourth wall 1425 is located ahead of the extension 1424A of the third wall 1424.

The elastic part 1430 is comprised of a coil spring.

The connector 1440 includes a cylindrical first portion 1441 fittable into the elastic part 1430, a second portion 1442 having a diameter greater than the same of the elastic part 1430 and slidable along an inner wall of the first extension 1410, and four extensions 1443 extending from the second portion 1422 in the direction A.

The connection ring 1450 includes a cylindrical main body 1451, a ring 1452 formed at an end of the main body 1451, and four guides 1453 formed at the other end of the main body 1451, and slidable along the extensions 1443 of the connector 1440.

After the guide 1420, the elastic part 1430, the connector 1440 and the connection ring 1450 were housed in the first and second housings 1410 and 1411, as illustrated in FIG. 57, the first and second housings 1410 and 1411 are inwardly bent at peripheral edges of openings at opposite ends thereof. Thus, the guide 1420, the elastic part 1430, the connector 1440 and the connection ring 1450 are housed in the first and second housings 1410 and 1411 without sliding out of the first and second housings 1410 and 1411 with the ring 1452 exposed out of the first and second housings 1410 and 1411. The extension 1425A of the guide 1420 makes contact with a peripheral edge of one of the openings of the first housing 1410, and, as mentioned later, the first and second walls 1422 and 1423 make contact at inner walls thereof with the first portion 1441 of the connector 1440. Thus, the guide 1420 is positioned in the first housing 1410.

As illustrated in FIG. 57, the elastic part 1430 into which the first portion 1441 of the connector 1440 is fit is sandwiched between the second portion 1442 of the connector 1440 and the reinforcement 1421B of the guide 1420 in the first and second housings 1410 and 1411 to thereby exert a force on the connector 1440 and the guide 1420 such that the connector 1440 and the guide 1420 move away from each other. The connection ring 1450 is housed in the first and second housings 1410 and 1411 such that the guides 1453 are slidably fit into the extensions 1443 of the connector 1440, and the ring 1452 is exposed out of the first and second housings 1410 and 1411.

The elastic part 1445 is inserted into a hole formed at the other end of the connection ring 1450, and extends into the first portion 1441 of the connector 1440. The first portion 1441 makes contact at a distal end thereof with inner walls of the first and second walls 1422 and 1423.

Furthermore, the first portion 1441 of the connector 1440 extends into the guide 1420 through the reinforcement 1421B of the guide 1420.

The coupler 1400 in accordance with the fourteenth embodiment, having the above-mentioned structure, is used as follows.

Inserting the male coupler 110 into the guide 1420 through the openings 1424B and 1425B of the guide 1420, the portion 110A located ahead of the annular groove 111 of the male coupler 110 upwardly pushes a distal end of the first wall 1422 and downwardly pushes a distal end of the second wall 1423.

When the male coupler 110 reaches at a location where the annular groove 111 of the male coupler 110 vertically aligns with the distal ends of the first and second walls 1422 and 1423, as illustrated in FIG. 57, the distal ends of the first and second walls 1422 and 1423 engage to the annular groove 111 from above and below by virtue of the elastic forces of the first and second walls 1422 and 1423.

Thus, as illustrated in FIG. 57, the male coupler 110 is fixed in the guide 1420 and accordingly in the first and second housings 1410 and 1411. In this situation, the male coupler 110 makes contact at a distal end thereof with the elastic part 1445.

When the male coupler 110 is pulled out of the female coupler 1401, the second housing 1411 and the connection ring 1450 are pulled in opposite directions to slide. As an alternative, the connection ring 1450 is pushed inwardly of the first housing 1410. Thus, as illustrated in FIG. 58, the first portion 1441 of the connector 1440 moves in a direction opposite to the direction A, and hence, the distal ends of the first and second walls 1422 and 1423 leave the annular groove 111 of the male coupler 110.

Thereafter, the connector 1440 returns to an initial position (the position illustrated in FIG. 57) by virtue of the elastic forces of the first wall 1422, the second wall 1423 and the elastic part 1430.

As mentioned above, the coupler 1400 in accordance with the fourteenth embodiment provides the same advantages as those provided by the coupler 100 in accordance with the first embodiment.

(Fifteenth Embodiment)

Figure 59:
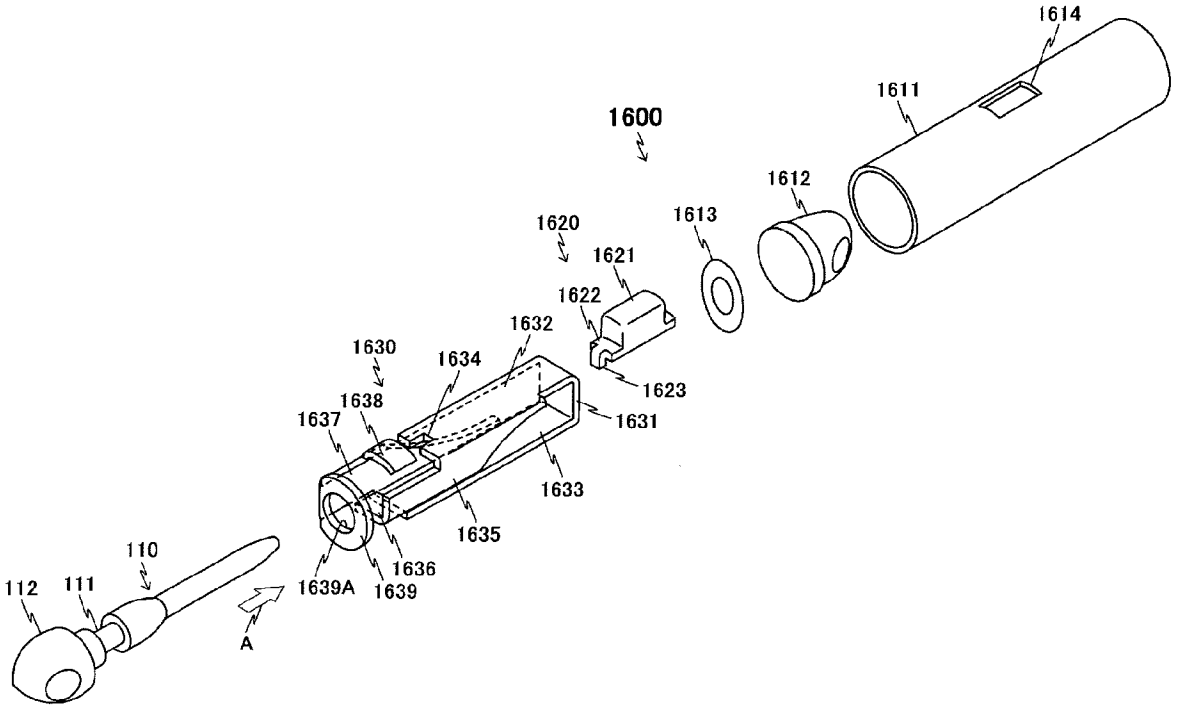
FIG. 59 is an exploded perspective view of a coupler in accordance with the fifteenth embodiment.
Figure 60:
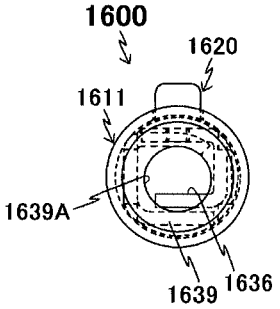
FIG. 60 is a front view of the coupler in accordance with the fifteenth embodiment, without a male coupler.
Figure 61:
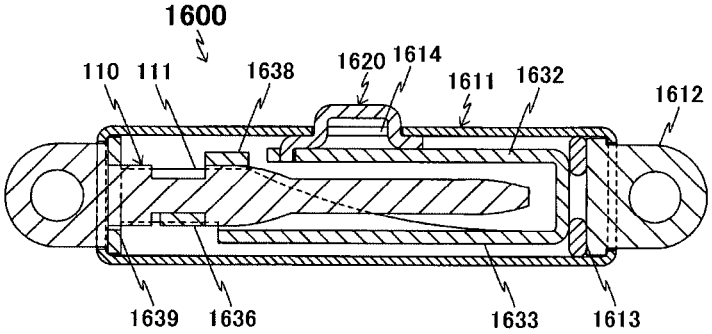
FIG. 61 is a longitudinal cross-sectional view of the coupler in accordance with the fifteenth embodiment, with a male coupler.

FIG. 59 is an exploded perspective view of a coupler 1600 in accordance with the fifteenth embodiment of the present invention, FIG. 60 is a front view of the coupler 1600 without a male coupler, and FIG. 61 is a longitudinal cross-sectional view of the coupler 1600 with a male coupler.

The coupler 1600 in accordance with the fifteenth embodiment includes a male coupler 110 and a female coupler 1601 into which the male coupler 110 can be inserted and out of which the male coupler 110 can be pulled.

The female coupler 1601 includes a cylindrical pipe 1611 opening at opposite ends thereof, a connection ring 1612 capable of passing through the pipe 1611, an annular elastic part 1613 capable of passing through the pipe 1611, a push button 1620, and a guide 1630.

As illustrated in FIG. 61, the connection ring 1612 is fixed in the pipe 1611 such that a ring portion thereof is exposed through an opening end of the pipe 1611.

The pipe 1611 is formed at a sidewall thereof with a rectangular opening 1614.

The guide 1630 includes a substantially square base wall 1631, a first wall 1632 extending from an upper edge of the base wall 1631 in a direction opposite to a direction A in which the male coupler 110 is inserted, and a second wall 1633 extending from a lower edge of the base wall 1631 in parallel with the first wall 1632.

The first wall 1632 is formed at a distal end thereof with a rectangular cut-out 1634.

A first extension wall 1635 extends from a left side edge of the first wall 1632 towards the second wall 1633, and is formed at a distal end thereof with an engagement portion 1636 inwardly bent from a distal end of the first extension wall 1635 in a direction almost perpendicular to the direction A. As illustrated in FIG. 61, the engagement portion 1636 is located ahead of the second wall 1633, and located higher than the second wall 1633. The engagement portion 1636 engages to a lower area of the annular groove 111 of the male coupler 110 when the male coupler 110 is inserted into the guide 1630.

As illustrated in FIGS. 59 and 61, the second wall 1633 is designed longer than the first wall 1632.

A second extension wall 1637 extends from a right side edge of the second wall 1633 towards the first wall 1632, and is formed at an upper edge thereof with an arcuate support 1638. The support 1638 is located ahead of the first wall 1632. As illustrated in FIG. 61, the support 1638 holds an upper area of the male coupler 110 to thereby support the male coupler 110 when the male coupler 110 is inserted into the guide 1630.

Furthermore, the second extension wall 1637 is formed at a distal end thereof with an extension 1639 bent substantially perpendicularly from a distal end of the second extension wall 1637 towards the inside. As illustrated in FIG. 59, the extension 1639 is located ahead of the engagement portion 1636 formed at the first extension wall 1635. The extension 1639 is formed with an opening 1639A through which the male coupler 110 can pass.

As illustrated in FIG. 61, the extension 1636 has a size sufficient to cover an open face of the pipe 1611 therewith when the guide 1630 is inserted into the pipe 1611.

The guide 1630 is composed of a material having elasticity. Accordingly, the first wall 1632 and the second wall 1633 can act as a spring around the base wall 1631. Specifically, the first wall 1632 and the second wall 1633 have elastic forces causing the first wall 1632 and the second wall 1633 to move away (in a vertical direction in FIG. 59) at distal ends thereof from each other around the base wall 1631.

Thus, when the engagement portion 1636 formed at the first wall 1632 engages to the annular groove 111 of the male coupler 110, the engagement portion 1636 upwardly pushes the male coupler 110 to thereby be kept fixed to the annular groove 111.

The support 1638 formed at the second wall 1633 downwardly pushes the male coupler 110.

Thus, when the male coupler 110 is inserted into the guide 1630, the male coupler 110 is downwardly pushed by the support 1638 from above, and further, is upwardly pushed by the engagement portion 1636 at the annular groove 111 from below, thereby the male coupler 110 being supported by both the support 1638 and the engagement portion 1636.

The push button 1620 includes a first portion 1621 fittable into the opening 1614 of the pipe 1611, a second portion 1622 having a size bigger than the opening 1614, and hence, not capable of passing through the opening 1614, and a hook 1623 formed at a distal end of the second portion 1622, and downwardly bent.

As illustrated in FIG. 61, the push button 1620 is housed in the pipe 1611, being sandwiched between the guide 1630 and the pipe 1611. In this situation, the first portion 1621 is exposed out of the opening 1614 of the pipe 1611, the second portion 1622 is sandwiched between the first wall 1632 of the guide 1630 and an inner wall of the pipe 1611, and the hook 1623 is engaged to the cut-out 1634 formed at the first wall 1632 of the guide 1630.

The reason why the push button 1620 includes the hook 1623 and the hook 1623 is engaged to the cut-out 1634 of the guide 1630 is to prevent the guide 1630 from rotating in the pipe 1611 when the guide 1630 is housed in the pipe 1611. Thus, the guide 1630 is positioned in the pipe 1611 by engaging the hook 1623 to the cut-out 1634 so as to be able to disengage the male coupler 110 and the guide 1630 from each other without failure.

The coupler 1600 in accordance with the fifteenth embodiment, having the above-mentioned structure, is used as follows.

The male coupler 110 is inserted into the guide 1630 through the opening 1639A of the extension 1639.

The male coupler 110 is inserted into the guide 1630, and then, the engagement portion 1636 engages to a lower area of the annular groove 111. Thus, the male coupler 110 is fixed to the guide 1630, and accordingly, to the pipe 1611. In this situation, the support 1638 supports the male coupler 110 from above.

That is, the male coupler 110, after inserted into the guide 1630, is supported by the support 1638 from above, and further, by the engagement portion 1636 from below at the annular groove 111.

When the male coupler 110 is taken out of the pipe 1611, the push button 1620 is pushed inwardly of the pipe 1611.

When the push button 1620 is pushed, the first wall 1632 is downwardly deformed relative to the base wall 1631, and hence, the engagement portion 1636 moves downwardly. When the engagement portion 1636 moves downwardly, the engagement portion 1636 and the annular groove 111 of the male coupler 110 are disengaged from each other. Then, the male coupler 110 can be taken out of the guide 1630 by pulling the male coupler 110 in a direction opposite to the direction A. The opening 1639A supports a portion of the male coupler 110 between the annular groove 111 and the connection ring 112. The support 1638 compresses the male coupler 110 from above, and the second wall 1633 supports the male coupler 110 from below because the second wall 1633 does not move even if the first wall 1632 moves downwardly. As mentioned above, the male coupler 110 is supported by the opening 1639A, the support 1638 and the second wall 1633 even when the male coupler 110 is pulled out of the guide 1630, the male coupler 110 does not interfere with the engagement portion 1636 when the male coupler 110 is pulled.

As mentioned above, the coupler 1600 in accordance with the fifteenth embodiment provides the same advantages as those provided by the coupler 100 in accordance with the first embodiment.

The structure of the coupler 1600 in accordance with the fifteenth embodiment is not to be limited to the above-mentioned one, but may be varied in many ways.

The pipe 1611 in the coupler 1600 is designed to be cylindrical, but may be designed to be of another shape such as a rectangular parallelepiped, in which case, the extension 1639 of the guide 1630 is designed to have a shape dependent on an open face of the rectangular parallelepiped.

The first extension wall 1635 and the second extension wall 1637 are designed to include the engagement portion 1636 and the support 1638, respectively. As an alternative, the first extension wall 1635 and the second extension wall 1637 may be designed to include the support 1638 and the engagement portion 1636, respectively.

The coupler 1600 is designed to include the push button 1620. However, if the first wall 1632 of the guide 1630 could be directly pushed through the opening 1614 of the pipe 1611, the coupler 1600 may be designed not to include the push button 1620.

The second extension wall 1637 is formed with the support 1638 in the coupler 1600. The second extension wall 1637 may be formed in place of the support 1638 with a second engagement portion engaging to the annular groove 111 of the male coupler 110 from above like the engagement portion 1636, in which case, the pipe 1611 is formed with a second opening opposite to the opening 1614, and the second engagement portion and the annular groove 111 can be disengaged from each other by pushing the second wall 1633 upwardly through the second opening.

Figure 62:
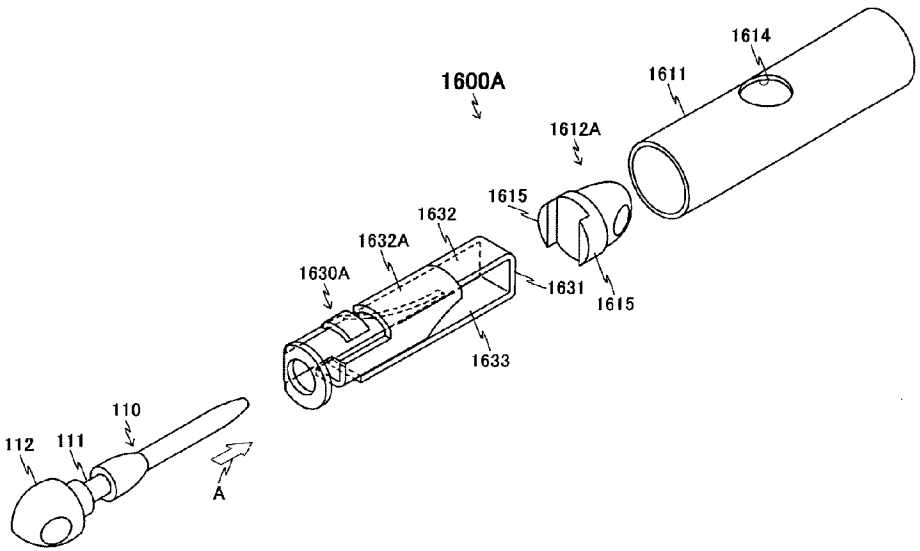
FIG. 62 is an exploded perspective view of a coupler in accordance with a first variation of the fifteenth embodiment.
Figure 63:
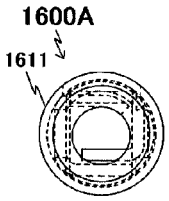
FIG. 63 is a front view of the coupler in accordance with a first variation of the fifteenth embodiment, without a male coupler.
Figure 64:
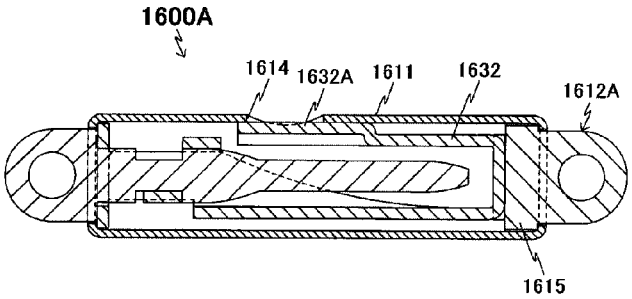
FIG. 64 is a longitudinal cross-sectional view of the coupler in accordance with a first variation of the fifteenth embodiment, with a male coupler.

FIG. 62 is an exploded perspective view of a coupler 1600A in accordance with a first variation of the fifteenth embodiment of the present invention, FIG. 63 is a front view of the coupler 1600A without a male coupler, and FIG. 64 is a longitudinal cross-sectional view of the coupler 1600A with a male coupler.

In comparison with the coupler 1600 in accordance with the fifteenth embodiment, the coupler 1600A is designed not to include the elastic part 1613 and the push button 1620.

Instead of the elastic part 1613, the connection ring 1612A of the coupler 1600A is designed to include a pair of projections 1615 between which the base wall 1631 of the guide 1630A is to be sandwiched.

Instead of the push button 1620, as illustrated in FIG. 62, the first wall 1632 of the guide 1632A is designed to include an arcuate wall 1632A including a distal end of the first wall 1632 (the guide 1630A is not formed with the cut-out 1634, because the push button 1620 is not used).

The arcuate wall 1632A has a curvature equal to the same of an inner wall of the pipe 1611. Accordingly, when the guide 1630A is inserted into the pipe 1611, the arcuate wall 1632A makes close contact with an inner wall of the pipe 1611.

By downwardly pushing the arcuate wall 1632A through the opening 1614 of the pipe 1611, the engagement portion 1636 moves downwardly, and thus, the engagement portion 1636 and the annular groove 111 of the male coupler 110 are disengaged from each other.

The first wall 1632 in the coupler 1600A is designed to include the arcuate wall 1632A. The second wall 1633 may be designed to include an arcuate wall like the arcuate wall 1632A.

Figure 65:
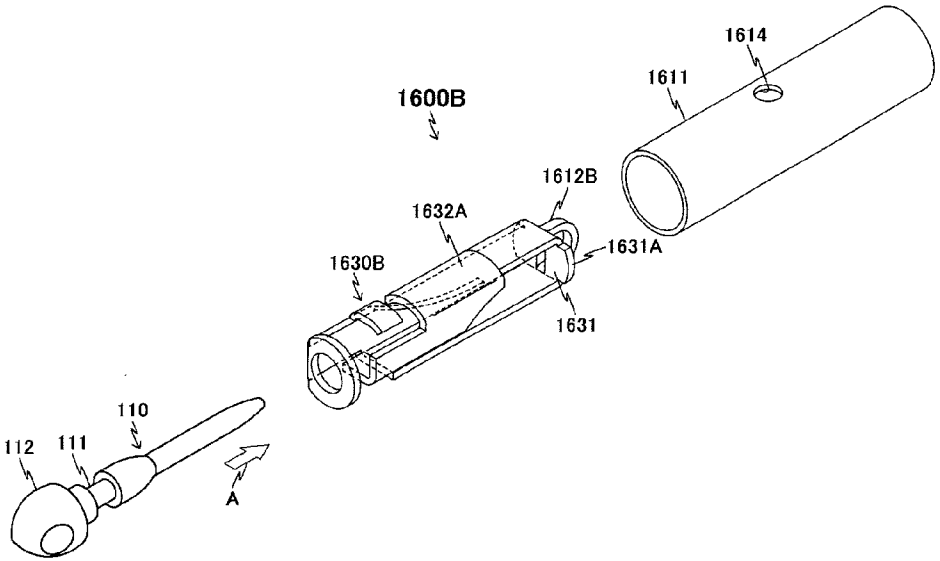
FIG. 65 is an exploded perspective view of a coupler in accordance with a second variation of the fifteenth embodiment.
Figure 66:
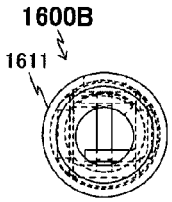
FIG. 66 is a front view of the coupler in accordance with a second variation of the fifteenth embodiment, without a male coupler.
Figure 67:
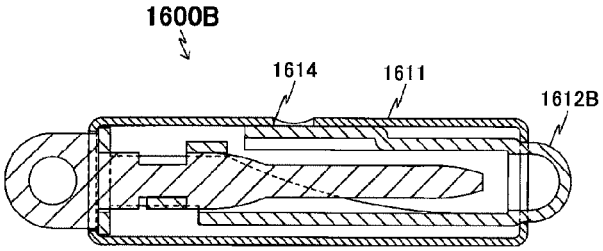
FIG. 67 is a longitudinal cross-sectional view of the coupler in accordance with a second variation of the fifteenth embodiment, with a male coupler.

FIG. 65 is an exploded perspective view of a coupler 1600B in accordance with a second variation of the fifteenth embodiment of the present invention, FIG. 66 is a front view of the coupler 1600B without a male coupler, and FIG. 67 is a longitudinal cross-sectional view of the coupler 1600B with a male coupler.

In comparison with the coupler 1600A in accordance with the first variation, the coupler 1600B is designed not to include the connection ring 1612A. In comparison with the guide 1630A in the first variation, the base wall 1631 in the coupler 1600B is designed to additionally include a connection ring 1612B.

The base wall 1631 has arcuate walls 1631A at left and right edges thereof. The arcuate walls 1631A have a curvature equal to the same of an inner wall of the pipe 1611. Accordingly, inserting the guide 1630B into the pipe 1611, the arcuate walls 1631A make close contact with an inner wall of the pipe 1611.

The coupler 1600B in accordance with the second variation has the same functions as those of the coupler 1600A in accordance with the first variation.

The coupler can be formed especially small-sized, if the coupler is designed to include a guide with a lock and an integrated housing such as the coupler in accordance with the fifteenth embodiment.

INDUSTRIAL APPLICABILITY

Though the coupler in accordance with the present invention is exemplified in the embodiments and the variations as a coupler used for a line-shaped ornament such as a necklace and a pendant, the coupler in accordance with the present invention can be applied not only to an ornament, but also to a tool for detachably connecting opposite ends of line-shaped goods. For instance, the coupler in accordance with the present invention can be applied to a string for suspending an ID card therefrom, a string for suspending a photo or a calendar therefrom, a string through which an ornament is attached to a lighting equipment, and a coupler used for interior goods.

Furthermore, the coupler in accordance with the present invention can be used as a coupler for detachably connecting not only opposite ends of a line-shaped good to each other, but also a first part to a second part. For instance, the coupler in accordance with the present invention can be used as a substitute of a button of cloths.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-096644 filed on Apr. 20, 2012 including specification, claims, drawings and summary is incorporated herein by reference in its entirety.

The invention claimed is:

1. A coupler including:

a female coupler into which a male coupler can be inserted; and a guide housed in said female coupler, and detachably supporting said male coupler, wherein at least one of said female coupler and said guide includes a lock that engages with said male coupler inserted in said female coupler to keep said male coupler inserted in said female coupler, said guide includes a base wall, and at least one pair of walls extending in a common direction from said base wall such that they face each other, at least one of said walls is elastic, said at least one of said walls moves towards and away from the other of said walls, said lock engages with said male coupler when the male coupler is inserted in the female coupler and disengages from said male coupler when said at least one of said walls moves towards or away from the other of said walls, the female coupler includes a first body part and a second body part that are rotatable relative to each other, the guide further includes a pair of position walls that each comprises a first portion that extends from the base wall in a direction in which the at least one pair of walls extends and a second portion that extends outward from a distal end of the first portion, and each of the pair of positioning walls is detachably engaged with at least one of the first body part and the second body part through the second portion.

2. The coupler as set forth in claim 1, wherein said base wall is formed with an opening through which said male coupler is able to pass.

3. The coupler as set forth in claim 2, further including a reinforcement formed along at least a part of a periphery of said opening and extending in a direction in which said male coupler is inserted into said female coupler or in a direction opposite to a direction in which said male coupler is inserted into said female coupler.

4. The coupler as set forth in claim 1, wherein said positioning wall has a two-layered structure formed by bending a single plate.

5. The coupler as set forth in claim 1, wherein said lock is comprised of a projection formed between a distal end and a proximal end of at least one of said at least one pair of walls, and engageable with said male coupler.

6. The coupler as set forth in claim 1. wherein said lock is comprised of an extension extending from a distal end of at least one of said at least one pair of walls towards the other of said at least one pair of walls.

7. The coupler as set forth in claim 1, wherein the first body part and second body part of the female coupler are detachably coupled to each other.

8. A guide housed in a female coupler composing a coupler together with a male coupler, said female coupler being able to house said male coupler therein, said guide detachably supporting said male coupler, said guide including:

a base wall; and a pair of walls extending in a common direction from said base wall such that they face each other, wherein at least one of said walls is elastic, said at least one of said walls moves towards and away from the other of said walls, said female coupler engages with and locks said male coupler when the male coupler is inserted in the female coupler, and disengages from said male coupler when said at least one of said walls moves through said female coupler towards or away from the other of said walls, the guide further includes a pair of positioning walls that each comprises a first portion that extends from the base wall in a direction in which said at least one pair of walls extends and a second portion that extends outward from a distal end of the first portion, and each of the pair of positioning walls is detachably engaged with at least one of a first body part and a second body part of the female coupler through the second portion.

9. The coupler as set forth in claim 1, wherein wherein the first body part is rotatably attached to the second body part by the second portion of each of the pair of positioning walls.

10. The guide as set forth in claim 8, wherein wherein the first body part is rotatably attached to the second body part by the second portion of each of the pair of positioning walls.

* * * * *